US009805676B2

(12) United States Patent
Koyama et al.

(10) Patent No.: US 9,805,676 B2
(45) Date of Patent: Oct. 31, 2017

(54) DISPLAY DEVICE

(71) Applicant: Semiconductor Energy Laboratory Co., Ltd., Atsugi-shi, Kanagawa-ken (JP)

(72) Inventors: Jun Koyama, Sagamihara (JP); Hiroyuki Miyake, Atsugi (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 14/086,290

(22) Filed: Nov. 21, 2013

(65) Prior Publication Data

US 2014/0146033 A1 May 29, 2014

(30) Foreign Application Priority Data

Nov. 28, 2012 (JP) ..... 2012-260345

(51) Int. Cl.
*G09G 3/36* (2006.01)

(52) U.S. Cl.
CPC ..... *G09G 3/3655* (2013.01); *G09G 3/3648* (2013.01); *G09G 3/3696* (2013.01); *G09G 2320/041* (2013.01); *G09G 2320/103* (2013.01); *G09G 2340/0435* (2013.01)

(58) Field of Classification Search
None
See application file for complete search history.

(56) References Cited

U.S. PATENT DOCUMENTS 5,534,884 A 7/1996 Mase et al.
5,731,856 A 3/1998 Kim et al.
5,744,864 A 4/1998 Cillessen et al.
(Continued)

FOREIGN PATENT DOCUMENTS

CN 101996595 3/2011
EP 1737044 A 12/2006
(Continued)

OTHER PUBLICATIONS

Amano et al., "43.4: Low Power LC Display Using In—Ga—Zn-Oxide TFTs Based on Variable Frame Frequency," SID Digest '10: SID International Symposium Digest of Technical Papers, 2010, pp. 626-629.

(Continued)

*Primary Examiner* — Antonio Xavier
(74) *Attorney, Agent, or Firm* — Robinson Intellectual Property Law Office; Eric J. Robinson

(57) ABSTRACT

To provide a novel display device without deterioration of display quality, the display device includes a display panel including a pixel portion that displays still images at a frame frequency of 30 Hz or less, a temperature sensing unit that senses the temperature of the display panel, a memory device that stores a correction table containing correction data, and a control circuit to which correction data selected from the correction table is input in accordance with an output of the temperature sensing unit. The pixel portion includes a plurality of pixels. Each of the pixels includes a transistor, a display element, and a capacitor. The control circuit outputs a voltage based on the correction data input to the control circuit, to the capacitor included in each of the pixels.

10 Claims, 34 Drawing Sheets

(56) References Cited

U.S. PATENT DOCUMENTS 5,748,169 A 5/1998 Okumura et al.
6,005,543 A 12/1999 Kimura
6,043,798 A 3/2000 Yamamoto et al.
6,052,103 A 4/2000 Fujiwara et al.
6,166,714 A 12/2000 Kishimoto
6,169,532 B1 1/2001 Sumi et al.
6,294,274 B1 9/2001 Kawazoe et al.
6,304,254 B1 * 10/2001 Johnson et al. ..... 345/204
6,310,651 B1 * 10/2001 Mizutome ..... G09G 3/3629 348/459
6,317,109 B1 11/2001 Lee
6,535,191 B1 3/2003 Miyachi
6,563,174 B2 5/2003 Kawasaki et al.
6,590,552 B1 7/2003 Yokoyama et al.
6,727,522 B1 4/2004 Kawasaki et al.
7,002,541 B2 2/2006 Yanagi et al.
7,049,190 B2 5/2006 Takeda et al.
7,061,014 B2 6/2006 Hosono et al.
7,064,346 B2 6/2006 Kawasaki et al.
7,105,868 B2 9/2006 Nause et al.
7,133,015 B1 * 11/2006 Yoshida et al. ..... 345/99
7,211,825 B2 5/2007 Shih et al.
7,282,782 B2 10/2007 Hoffman et al.
7,297,977 B2 11/2007 Hoffman et al.
7,321,353 B2 1/2008 Tsuda et al.
7,323,356 B2 1/2008 Hosono et al.
7,385,224 B2 6/2008 Ishii et al.
7,402,506 B2 7/2008 Levy et al.
7,411,209 B2 8/2008 Endo et al.
7,453,065 B2 11/2008 Saito et al.
7,453,087 B2 11/2008 Iwasaki
7,462,862 B2 12/2008 Hoffman et al.
7,468,304 B2 12/2008 Kaji et al.
7,501,293 B2 3/2009 Ito et al.
7,535,448 B2 * 5/2009 Hiroki ..... 345/89
7,674,650 B2 3/2010 Akimoto et al.
7,732,819 B2 6/2010 Akimoto et al.
7,807,515 B2 10/2010 Kato et al.
7,825,885 B2 11/2010 Sato et al.
8,106,382 B2 1/2012 Saitoh et al.
8,378,391 B2 2/2013 Koyama et al.
8,384,077 B2 2/2013 Yano et al.
8,487,967 B2 7/2013 Yoshiga
2001/0024187 A1 9/2001 Sato et al.
2001/0046027 A1 11/2001 Tai et al.
2002/0056838 A1 5/2002 Ogawa
2002/0075205 A1 6/2002 Kimura et al.
2002/0080131 A1 6/2002 Fujino
2002/0093473 A1 7/2002 Tanaka et al.
2002/0132454 A1 9/2002 Ohtsu et al.
2002/0180675 A1 12/2002 Tobita et al.
2003/0151581 A1 * 8/2003 Suyama ..... G09G 3/3655 345/98
2003/0156092 A1 * 8/2003 Suzuki ..... G09G 3/3685 345/98
2003/0156104 A1 8/2003 Morita
2003/0189401 A1 10/2003 Kido et al.
2003/0218222 A1 11/2003 Wager et al.
2004/0038446 A1 2/2004 Takeda et al.
2004/0073591 A1 * 4/2004 Giacalone ..... 708/650
2004/0127038 A1 7/2004 Carcia et al.
2005/0017302 A1 1/2005 Hoffman
2005/0078104 A1 4/2005 Matthies et al.
2005/0199959 A1 9/2005 Chiang et al.
2005/0225562 A1 * 10/2005 Higgins et al. ..... 345/604
2006/0007093 A1 1/2006 La
2006/0035452 A1 2/2006 Carcia et al.
2006/0043377 A1 3/2006 Hoffman et al.
2006/0091793 A1 5/2006 Baude et al.
2006/0108529 A1 5/2006 Saito et al.
2006/0108636 A1 5/2006 Sano et al.
2006/0110867 A1 5/2006 Yabuta et al.
2006/0113536 A1 6/2006 Kumomi et al.
2006/0113539 A1 6/2006 Sano et al.
2006/0113549 A1 6/2006 Den et al.
2006/0113565 A1 6/2006 Abe et al.
2006/0119755 A1 6/2006 Senda et al.
2006/0163583 A1 7/2006 Jiroku
2006/0169973 A1 8/2006 Isa et al.
2006/0170111 A1 8/2006 Isa et al.
2006/0187361 A1 * 8/2006 Fujine ..... G09G 3/3648 348/790
2006/0197092 A1 9/2006 Hoffman et al.
2006/0208977 A1 9/2006 Kimura
2006/0228974 A1 10/2006 Thelss et al.
2006/0231882 A1 10/2006 Kim et al.
2006/0238135 A1 10/2006 Kimura
2006/0244107 A1 11/2006 Sugihara et al.
2006/0284171 A1 12/2006 Levy et al.
2006/0284172 A1 12/2006 Ishii
2006/0284811 A1 * 12/2006 Huang ..... 345/92
2006/0292777 A1 12/2006 Dunbar
2007/0012897 A1 * 1/2007 Lee et al. ..... 252/299.1
2007/0024187 A1 2/2007 Shin et al.
2007/0046191 A1 3/2007 Saito
2007/0052025 A1 3/2007 Yabuta
2007/0054507 A1 3/2007 Kaji et al.
2007/0090365 A1 4/2007 Hayashi et al.
2007/0108446 A1 5/2007 Akimoto
2007/0146279 A1 * 6/2007 Oke ..... G09G 3/3614 345/94
2007/0152217 A1 7/2007 Lai et al.
2007/0152921 A1 7/2007 Osame
2007/0172591 A1 7/2007 Seo et al.
2007/0176882 A1 * 8/2007 Araki ..... G09G 3/3648 345/101
2007/0187678 A1 8/2007 Hirao et al.
2007/0187760 A1 8/2007 Furuta et al.
2007/0188431 A1 * 8/2007 Sato et al. ..... 345/90
2007/0194379 A1 8/2007 Hosono et al.
2007/0252928 A1 11/2007 Ito et al.
2007/0262972 A1 * 11/2007 Nakata ..... G09G 3/3696 345/204
2007/0272922 A1 11/2007 Kim et al.
2007/0273682 A1 11/2007 Yi et al.
2007/0287296 A1 12/2007 Chang
2008/0006877 A1 1/2008 Mardilovich et al.
2008/0038882 A1 2/2008 Takechi et al.
2008/0038929 A1 2/2008 Chang
2008/0050595 A1 2/2008 Nakagawara et al.
2008/0073653 A1 3/2008 Iwasaki
2008/0083950 A1 4/2008 Pan et al.
2008/0106191 A1 5/2008 Kawase
2008/0128689 A1 6/2008 Lee et al.
2008/0129195 A1 6/2008 Ishizaki et al.
2008/0166834 A1 7/2008 Kim et al.
2008/0170028 A1 7/2008 Yoshida
2008/0182358 A1 7/2008 Cowdery-Corvan et al.
2008/0204121 A1 * 8/2008 Huang ..... G09G 3/3655 327/536
2008/0224133 A1 9/2008 Park et al.
2008/0254569 A1 10/2008 Hoffman et al.
2008/0258139 A1 10/2008 Ito et al.
2008/0258140 A1 10/2008 Lee et al.
2008/0258141 A1 10/2008 Park et al.
2008/0258143 A1 10/2008 Kim et al.
2008/0284707 A1 * 11/2008 Katagawa ..... G01K 13/00 345/96
2008/0284931 A1 11/2008 Kimura
2008/0296568 A1 12/2008 Ryu et al.
2009/0015533 A1 * 1/2009 Fujita ..... G09G 3/3655 345/92
2009/0045397 A1 2/2009 Iwasaki
2009/0068773 A1 3/2009 Lai et al.
2009/0072226 A1 3/2009 Koo et al.
2009/0073325 A1 3/2009 Kuwabara et al.
2009/0114910 A1 5/2009 Chang
2009/0128527 A1 * 5/2009 Itakura et al. ..... 345/205
2009/0128540 A1 * 5/2009 Hsu ..... G09G 3/3611 345/213
2009/0134399 A1 5/2009 Sakakura et al.
2009/0152506 A1 6/2009 Umeda et al.
2009/0152541 A1 6/2009 Maekawa et al.

(56) References Cited

U.S. PATENT DOCUMENTS

| | | | | |
|---|---|---|---|---|
| 2009/0237391 | A1 | 9/2009 | Yanagi et al. | |
| 2009/0278122 | A1 | 11/2009 | Hosono et al. | |
| 2009/0280600 | A1 | 11/2009 | Hosono et al. | |
| 2009/0310077 | A1 | 12/2009 | Kim et al. | |
| 2010/0001259 | A1 | 1/2010 | Saitho et al. | |
| 2010/0020112 | A1* | 1/2010 | Jeon | G09G 3/3648 345/690 |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2010/0214272 | A1 | 8/2010 | Watsuda | |
| 2010/0225681 | A1* | 9/2010 | Yoshida et al. | 345/690 |
| 2010/0265168 | A1* | 10/2010 | Neugebauer | G09G 3/3614 345/87 |
| 2010/0289835 | A1* | 11/2010 | Holub | 345/690 |
| 2011/0032231 | A1* | 2/2011 | Maruyama | G09G 3/2096 345/208 |
| 2011/0037787 | A1* | 2/2011 | Yoshiga | G09G 3/3655 345/690 |
| 2011/0108706 | A1 | 5/2011 | Koyama | |
| 2011/0148846 | A1 | 6/2011 | Arasawa et al. | |
| 2011/0149185 | A1 | 6/2011 | Yamazaki | |
| 2011/0157131 | A1 | 6/2011 | Miyake | |
| 2011/0175873 | A1* | 7/2011 | Miyake | 345/207 |
| 2011/0175895 | A1* | 7/2011 | Hayakawa et al. | 345/212 |
| 2012/0169954 | A1* | 7/2012 | Liu | G09G 5/18 349/38 |
| 2012/0306728 | A1* | 12/2012 | Koyama et al. | 345/76 |
| 2013/0057518 | A1* | 3/2013 | Sugita et al. | 345/175 |
| 2014/0184484 | A1* | 7/2014 | Miyake et al. | 345/87 |

FOREIGN PATENT DOCUMENTS

| | | | |
|---|---|---|---|
| EP | 2226847 | A | 9/2010 |
| JP | 60-198861 | A | 10/1985 |
| JP | 63-088523 | A | 4/1988 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 05-251705 | A | 9/1993 |
| JP | 08-264794 | A | 10/1996 |
| JP | 11-505377 | | 5/1999 |
| JP | 11-202292 | A | 7/1999 |
| JP | 2000-044236 | A | 2/2000 |
| JP | 2000-150900 | A | 5/2000 |
| JP | 2001-282205 | A | 10/2001 |
| JP | 2002-076356 | A | 3/2002 |
| JP | 2002-289859 | A | 10/2002 |
| JP | 2003-086000 | A | 3/2003 |
| JP | 2003-086808 | A | 3/2003 |
| JP | 2004-045662 | A | 2/2004 |
| JP | 2004-103957 | A | 4/2004 |
| JP | 2004-273614 | A | 9/2004 |
| JP | 2004-273732 | A | 9/2004 |
| JP | 2007-047221 | A | 2/2007 |
| JP | 2007-096055 | A | 4/2007 |
| JP | 2007-123861 | A | 5/2007 |
| JP | 2009-025548 | A | 2/2009 |
| JP | 2011-039403 | A | 2/2011 |
| JP | 2011-170328 | A | 9/2011 |
| JP | 2011-237760 | A | 11/2011 |
| JP | 2012-230413 | A | 11/2012 |
| KR | 2012-0115521 | A | 10/2012 |
| TW | 201112218 | | 4/2011 |
| TW | 201137838 | | 11/2011 |
| TW | I360794 | | 3/2012 |
| WO | WO-2004/114391 | | 12/2004 |
| WO | WO-2011/089832 | | 7/2011 |

OTHER PUBLICATIONS

Nishi et al., "P-143: Possibility of Reflective LC Display Using Oxide Semiconductor TFTs as Electronic Paper Display," SID Digest '10: SID International Symposium Digest of Technical Papers, May 1, 2010, vol. 41, No. 1, pp. 1685-1688.

Godo et al., "Modeling and Measurement of Ultra-Low Leakage Current of IGZO TFTs and New Driving Method of LCDs," IDW '10: Proceedings of the 16th International Display Workshops, 2010, pp. 235-238.

Fortunato.E et al., "Wide-Bandgap High-Mobility ZnO Thin-Film Transistors Produced at Room Temperature,", Appl. Phys. Lett. (Applied Physics Letters) , Sep. 27, 2004, vol. 85, No. 13, pp. 2541-2543.

Dembo.H et al., "RFCPUS on Glass and Plastic Substrates Fabricated by TFT Transfer Technology,", IEDM 05: Technical Digest of International Electron Devices Meeting, Dec. 5, 2005, pp. 1067-1069.

Ikeda.T et al., "Full-Functional System Liquid Crystal Display Using CG-Silicon Technology,", SID Digest '04 : SID International Symposium Digest of Technical Papers, 2004, vol. 35, pp. 860-863.

Nomura.K et al., "Room-Temperature Fabrication of Transparent Flexible Thin-Film Transistors Using Amorphous Oxide Semiconductors,", Nature, Nov. 25, 2004, vol. 432, pp. 488-492.

Park.J et al., "Improvements in the Device Characteristics of Amorphous Indium Gallium Zinc Oxide Thin-Film Transistors by Ar Plasma Treatment,", Appl. Phys. Lett. (Applied Physics Letters) , Jun. 26, 2007, vol. 90, No. 26, pp. 262106-1-262106-3.

Takahashi.M et al., "Theoretical Analysis of IGZO Transparent Amorphous Oxide Semiconductor,", IDW '08 : Proceedings of the 15th International Display Workshops, Dec. 3, 2008, pp. 1637-1640.

Hayashi.R et al., "42.1: Invited Paper: Improved Amorphous In—Ga—Zn—O TFTs,", SID Digest '08 : SID International Symposium Digest of Technical Papers, May 20, 2008, vol. 39, pp. 621-624.

Prins.M et al., "A Ferroelectric Transparent Thin-Film Transistor,", Appl. Phys. Lett. (Applied Physics Letters) , Jun. 17, 1996, vol. 68, No. 25, pp. 3650-3652.

Nakamura.M et al., "The phase relations in the In2O3—Ga2ZnO4—ZnO system at 1350° C.,", Journal of Solid State Chemistry, Aug. 1, 1991, vol. 93, No. 2, pp. 298-315.

Kimizuka.N et al., "Syntheses and Single-Crystal Data of Homologous Compounds, In2O3(ZnO)m (m=3, 4, and 5), InGaO3(ZnO)3, and Ga2O3(ZnO)m (m=7, 8, 9, and 16) in the In2O3—ZnGa2O4—ZnO System,", Journal of Solid State Chemistry, Apr. 1, 1995, vol. 116, No. 1, pp. 170-178.

Nomura.K et al., "Thin-Film Transistor Fabricated in Single-Crystalline Transparent Oxide Semiconductor,", Science, May 23, 2003, vol. 300, No. 5623, pp. 1269-1272.

Masuda.S et al., "Transparent thin film transistors using ZnO as an active channel layer and their electrical properties,", J. Appl. Phys. (Journal of Applied Physics) , Feb. 1, 2003, vol. 93, No. 3, pp. 1624-1630.

Asakuma.N et al., "Crystallization and Reduction of Sol-Gel-Derived Zinc Oxide Films by Irradiation With Ultraviolet Lamp,", Journal of Sol-Gel Science and Technology, 2003, vol. 26, pp. 181-184.

Osada.T et al., "15.2: Development of Driver-Integrated Panel using Amorphous In—Ga—Zn-Oxide TFT,", SID Digest '09 : SID International Symposium Digest of Technical Papers, May 31, 2009, pp. 184-187.

Nomura.K et al., "Carrier transport in transparent oxide semiconductor with intrinsic structural randomness probed using single-crystalline InGaO3(ZnO)5 films,", Appl. Phys. Lett. (Applied Physics Letters) , Sep. 13, 2004, vol. 85, No. 11, pp. 1993-1995.

Li.C et al., "Modulated Structures of Homologous Compounds InMO3(ZnO)m (M=In,Ga; m=Integer) Described by Four-Dimensional Superspace Group,", Journal of Solid State Chemistry, 1998, vol. 139, pp. 347-355.

Son.K et al., "42.4L: Late-News Paper: 4 Inch QVGA AMOLED Driven by the Threshold Voltage Controlled Amorphous GIZO

(56) References Cited

OTHER PUBLICATIONS (Ga2O3—In2O3—ZnO) TFT,", SID Digest '08 : SID International Symposium Digest of Technical Papers, May 20, 2008, vol. 39, pp. 633-636.
Lee.J et al., "World's Largest (15-Inch) XGA AMLCD Panel Using IGZO Oxide TFT,", SID Digest '08 : SID International Symposium Digest of Technical Papers, May 20, 2008, vol. 39, pp. 625-628.
Nowatari.H et al., "60.2: Intermediate Connector With Suppressed Voltage Loss for White Tandem OLEDS,", SID Digest '09 : SID International Symposium Digest of Technical Papers, May 31, 2009, vol. 40, pp. 899-902.
Kanno.H et al., "White Stacked Electrophosphorecent Organic Light-Emitting Devices Employing MOO3 as a Charge-Generation Layer,", Adv. Mater. (Advanced Materials), 2006, vol. 18, No. 3, pp. 339-342.
Tsuda.K et al., "Ultra Low Power Consumption Technologies for Mobile TFT-LCDs ,", IDW '02 : Proceedings of the 9th International Display Workshops, Dec. 4, 2002, pp. 295-298.
Van de Walle.C, "Hydrogen as a Cause of Doping in Zinc Oxide,", Phys. Rev. Lett. (Physical Review Letters), Jul. 31, 2000, vol. 85, No. 5, pp. 1012-1015.
Fung.T et al., "2-D Numerical Simulation of High Performance Amorphous In—Ga—Zn—O TFTs for Flat Panel Displays,", AM-FPD '08 Digest of Technical Papers, Jul. 2, 2008, pp. 251-252, The Japan Society of Applied Physics.
Jeong.J et al., "3.1: Distinguished Paper: 12.1-Inch WXGA AMOLED Display Driven by Indium-Gallium-Zinc Oxide TFTs Array,", SID Digest '08 : SID International Symposium Digest of Technical Papers, May 20, 2008, vol. 39, No. 1, pp. 1-4.
Park.J et al., "High performance amorphous oxide thin film transistors with self-aligned top-gate structure,", IEDM 09: Technical Digest of International Electron Devices Meeting, Dec. 7, 2009, pp. 191-194.
Kurokawa.Y et al., "UHF RFCPUS on Flexible and Glass Substrates for Secure RFID Systems,", Journal of Solid-State Circuits , 2008, vol. 43, No. 1, pp. 292-299.
Ohara.H et al., "Amorphous In—Ga—Zn-Oxide TFTs with Suppressed Variation for 4.0 inch QVGA AMOLED Display,", AM-FPD '09 Digest of Technical Papers, Jul. 1, 2009, pp. 227-230, The Japan Society of Applied Physics.
Coates.D et al., "Optical Studies of the Amorphous Liquid-Cholesteric Liquid Crystal Transition:The "Blue Phase",", Physics Letters, Sep. 10, 1973, vol. 45A, No. 2, pp. 115-116.
Cho.D et al., "21.2:Al and Sn-Doped Zinc Indium Oxide Thin Film Transistors for AMOLED Back-Plane,", SID Digest '09 : SID International Symposium Digest of Technical Papers, May 31, 2009, pp. 280-283.
Lee.M et al., "15.4:Excellent Performance of Indium-Oxide-Based Thin-Film Transistors by DC Sputtering,", SID Digest '09 : SID International Symposium Digest of Technical Papers, May 31, 2009, pp. 191-193.
Jin.D et al., "65.2:Distinguished Paper:World-Largest (6.5") Flexible Full Color Top Emission AMOLED Display on Plastic Film and Its Bending Properties,", SID Digest '09 : SID International Symposium Digest of Technical Papers, May 31, 2009, pp. 983-985.
Sakata.J et al., "Development of 4.0-In. AMOLED Display With Driver Circuit Using Amorphous In—Ga—Zn-Oxide TFTS,", IDW '09 : Proceedings of the 16th Internationa Display Workshops, 2009, pp. 689-692.
Park.J et al., "Amorphous Indium-Gallium-Zinc Oxide TFTS and Their Application for Large Size AMOLED,", AM-FPD '08 Digest of Technical Papers, Jul. 2, 2008, pp. 275-278.
Park.S et al., "Challenge to Future Displays: Transparent AM-OLED Driven by Peald Grown ZnO TFT,", IMID '07 Digest, 2007, pp. 1249-1252.
Godo.H et al., "Temperature Dependence of Characteristics and Electronic Structure for Amorphous In—Ga—Zn-Oxide TFT,", AM-FPD '09 Digest of Technical Papers, Jul. 1, 2009, pp. 41-44.
Osada.T et al., "Development of Driver-Integrated Panel Using Amorphous In—Ga—Zn-Oxide TFT,", AM-FPD '09 Digest of Technical Papers, Jul. 1, 2009, pp. 33-36.
Hirao.T et al., "Novel Top-Gate Zinc Oxide Thin-Film Transistors (ZnO TFTS) for AMLCDS,", Journal of the SID, 2007, vol. 15, No. 1, pp. 17-22.
Hosono.H, "68.3:Invited Paper:Transparent Amorphous Oxide Semiconductors for High Performance TFT,", SID Digest '07 : SID International Symposium Digest of Technical Papers, 2007, vol. 38, pp. 1830-1833.
Godo.H et al., "P-9:Numerical Analysis on Temperature Dependence of Characteristics of Amorphous In—Ga—Zn-Oxide TFT,", SID Digest '09 : SID International Symposium Digest of Technical Papers, May 31, 2009, pp. 1110-1112.
Ohara.H et al., "21.3:4.0 In. QVGA AMOLED Display Using In—Ga—Zn-Oxide TFTS With a Novel Passivation Layer,", SID Digest '09 : SID International Symposium Digest of Technical Papers, May 31, 2009, pp. 284-287.
Miyasaka.M, "Suftla Flexible Microelectronics on Their Way to Business,", SID Digest '07 : SID International Symposium Digest of Technical Papers, 2007, vol. 38, pp. 1673-1676.
Chern.H et al., "An Analytical Model for the Above-Threshold Characteristics of Polysilicon Thin-Film Transistors,", IEEE Transactions on Electron Devices, Jul. 1, 1995, vol. 42, No. 7, pp. 1240-1246.
Kikuchi.H et al., "39.1 :Invited Paper:Optically Isotropic Nano-Structured Liquid Crystal Composites for Display Applications,", SID Digest '09 : SID International Symposium Digest of Technical Papers, May 31, 2009, pp. 578-581.
Asaoka.Y et al., "29.1:Polarizer-Free Reflective LCD Combined With Ultra Low-Power Driving Technology,", SID Digest '09 : SID International Symposium Digest of Technical Papers, May 31, 2009, pp. 395-398.
Lee.H et al., "Current Status of, Challenges to, and Perspective View of AM-OLED ,", IDW '06 : Proceedings of the 13th International Display Workshops, Dec. 7, 2006, pp. 663-666.
Kikuchi.H et al., "62.2:Invited Paper:Fast Electro-Optical Switching in Polymer-Stabilized Liquid Crystalline Blue Phases for Display Application,", SID Digest '07 : SID International Symposium Digest of Technical Papers, 2007, vol. 38, pp. 1737-1740.
Nakamura.M, "Synthesis of Homologous Compound with New Long-Period Structure,", NIRIM Newsletter, Mar. 1, 1995, vol. 150, pp. 1-4.
Kikuchi.H et al., "Polymer-Stabilized Liquid Crystal Blue Phases,", Nature Materials, Sep. 2, 2002, vol. 1, pp. 64-68.
Kimizuka.N et al., "Spinel,YBFe2O4, and YB2Fe3O7 Types of Structures for Compounds in the IN2O3 and SC2O3—A2O3—BO Systems [A; Fe, Ga, or Al; B: Mg, Mn, Fe, Ni, Cu,or Zn] at Temperatures Over 1000° C.,", Journal of Solid State Chemistry, 1985, vol. 60, pp. 382-384.
Kitzerow.H et al., "Observation of Blue Phases in Chiral Networks,", Liquid Crystals, 1993, vol. 14, No. 3, pp. 911-916.
Costello.M et al., "Electron Microscopy of a Cholesteric Liquid Crystal and Its Blue Phase,", Phys. Rev. A (Physical Review. A), May 1, 1984, vol. 29, No. 5, pp. 2957-2959.
Meiboom.S et al., "Theory of the Blue Phase of Cholesteric Liquid Crystals,", Phys. Rev. Lett. (Physical Review Letters), May 4, 1981, vol. 46, No. 18, pp. 1216-1219.
Park.Sang-Hee et al., "42.3: Transparent ZnO Thin Film Transistor for the Application of High Aperture Ratio Bottom Emission AM-OLED Display,", SID Digest '08 : SID International Symposium Digest of Technical Papers, May 20, 2008, vol. 39, pp. 629-632.
Orita.M et al., "Mechanism of Electrical Conductivity of Transparent InGaZnO4,", Phys. Rev. B (Physical Review. B), Jan. 15, 2000, vol. 61, No. 3, pp. 1811-1816.
Nomura.K et al., "Amorphous Oxide Semiconductors for High-Performance Flexible Thin-Film Transistors,", Jpn. J. Appl. Phys. (Japanese Journal of Applied Physics) , 2006, vol. 45, No. 5B, pp. 4303-4308.
Janotti.A et al., "Native Point Defects in ZnO,", Phys. Rev. B (Physical Review. B), Oct. 4, 2007, vol. 76, No. 16, pp. 165202-1-165202-22.

(56) References Cited

OTHER PUBLICATIONS

Park.J et al., "Electronic Transport Properties of Amorphous Indium-Gallium-Zinc Oxide Semiconductor Upon Exposure to Water,", Appl. Phys. Lett. (Applied Physics Letters) , 2008, vol. 92, pp. 072104-1-072104-3.
Hsieh.H et al., "P-29:Modeling of Amorphous Oxide Semiconductor Thin Film Transistors and Subgap Density of States,", SID Digest '08 : SID International Symposium Digest of Technical Papers, 2008, vol. 39, pp. 1277-1280.
Janotti.A et al., "Oxygen Vacancies in ZnO,", Appl. Phys. Lett. (Applied Physics Letters) , 2005, vol. 87, pp. 122102-1-122102-3.
Oba.F et al., "Defect energetics in ZnO: A hybrid Hartree-Fock density functional study,", Phys. Rev. B (Physical Review. B), 2008, vol. 77, pp. 245202-1-245202-6.
Orita.M et al., "Amorphous transparent conductive oxide InGaO3(ZnO)m (m<4):a Zn4s conductor,", Philosophical Magazine, 2001, vol. 81, No. 5, pp. 501-515.
Hosono.H et al., "Working hypothesis to explore novel wide band gap electrically conducting amorphous oxides and examples,", J. Non-Cryst. Solids (Journal of Non-Crystalline Solids), 1996, vol. 198-200, pp. 165-169.
Mo.Y et al., "Amorphous Oxide TFT Backplanes for Large Size AMOLED Displays,", IDW '08 : Proceedings of the 6th International Display Workshops, Dec. 3, 2008, pp. 581-584.
Kim.S et al., "High-Performance oxide thin film transistors passivated by various gas plasmas,", 214th ECS Meeting, 2008, No. 2317, ECS.
Clark.S et al., "First Principles Methods Using Castep,", Zeitschrift fur Kristallographie, 2005, vol. 220, pp. 567-570.
Lany.S et al., "Dopability, Intrinsic Conductivity, and Nonstoichiometry of Transparent Conducting Oxides,", Phys. Rev. Lett. (Physical Review Letters), Jan. 26, 2007, vol. 98, pp. 045501-1-045501-4.
Park.J et al., "Dry etching of ZnO films and plasma-induced damage to optical properties,", J. Vac. Sci. Technol. B (Journal of Vacuum Science & Technology B), Mar. 1, 2003, vol. 21, No. 2, pp. 800-803.
Oh.M et al., "Improving the Gate Stability of ZnO Thin-Film Transistors With Aluminum Oxide Dielectric Layers,", J. Electrochem. Soc. (Journal of Electrochemical Society), 2008, vol. 155, No. 12, pp. H1009-H1014.
Ueno.K et al., "Field-Effect Transistor on SrTiO3 With Sputtered Al2O3 Gate Insulator,", Appl. Phys. Lett. (Applied Physics Letters) , Sep. 1, 2003, vol. 83, No. 9, pp. 1755-1757.
International Search Report (Application No. PCT/JP2013/081578) Dated Feb. 10, 2014.
Written Opinion (Application No. PCT/JP2013/081578) Dated Feb. 10, 2014.
Miyake.H et al., "New Driving Method for Reducing Eye Strain Technology (REST) in Displaying Still Image Using CAAC IGZO LC Display", SID Digest '13 : SID International Symposium Digest of Technical Papers, 2013, pp. 935-938.

* cited by examiner

DISPLAY DEVICE

TECHNICAL FIELD

The present invention relates to an object, a method, a manufacturing method, a process, a machine, manufacture, or composition of matter. In particular, the present invention relates to, for example, a semiconductor device, a display device, a light-emitting device, a driving method thereof, or a manufacturing method thereof. The present invention particularly relates to, for example, a semiconductor device including an oxide semiconductor, a display device including an oxide semiconductor, or a light-emitting device including an oxide semiconductor.

BACKGROUND ART

The information revolution has progressed rapidly with technological innovation, mainly with innovation in information processing, and the variety of uses of displays, for example, for personal computers and mobile devices has increased at workplaces and homes. Accordingly, the frequency and time of use of displays have increased dramatically.

There have been demands for higher resolution and lower power consumption of small and middle-sized displays used for mobile devices and the like.

For example, a conventional liquid crystal display device includes a transistor using amorphous silicon, polycrystalline silicon, or the like. Since the off-state current of such a transistor is about 1 pA, display can be held only for 20 ms to 30 ms. Thus, images need to be written 60 times or more per second. Such write operation is perceived as a flicker by a user and causes eyestrain.

Moreover, a liquid crystal display device using an oxide semiconductor has been developed in recent years. The off-state current of a transistor using an oxide semiconductor is extremely low and can be less than 1 zA, so that the off-state current of the transistor is almost negligible. In driving a liquid crystal display device including a transistor using an oxide semiconductor, for example, in a structure disclosed in Patent Document 1, the number of write operations (refresh operations) of signals for the same image is reduced when one image (still image) is continuously displayed, whereby power consumption is reduced.

REFERENCE

Patent Document 1: Japanese Published Patent Application No. 2011-237760

DISCLOSURE OF INVENTION

In a general active matrix display device, a voltage applied to a pixel is required to be held without decay until the next write operation.

However, a voltage corresponding to a signal written into a pixel changes with time. Once the amount of change in voltage written into each pixel exceeds an amount corresponding to the allowable variation range of gray level in one image, a user perceives a flicker of the image, resulting in a reduction in display quality.

In view of the above, an object of one embodiment of the present invention is to provide a novel eye-friendly display device. An object of one embodiment of the present invention is to provide a novel display device causing less eye fatigue. An object of one embodiment of the present invention is to provide a novel display device without deterioration of display quality. An object of one embodiment of the present invention is to provide a novel display device with little influence of off-state current. An object of one embodiment of the present invention is to provide a novel display device with little influence of display degradation. An object of one embodiment of the present invention is to provide a novel display device with little influence of display flickers. An object of one embodiment of the present invention is to provide a novel display device with less variation in display luminance. An object of one embodiment of the present invention is to provide a novel display device with less variation in transmittance of a display element. An object of one embodiment of the present invention is to provide a novel display device capable of displaying a clear still image. An object of one embodiment of the present invention is to provide a novel display device with low power consumption. An object of one embodiment of the present invention is to provide a novel display device with little deterioration of a transistor. An object of one embodiment of the present invention is to provide a novel display device including a transistor with low off-state current.

Note that the descriptions of these objects do not disturb the existence of other objects. In one embodiment of the present invention, there is no need to achieve all the objects. Other objects will be apparent from and can be derived from the description of the specification, the drawings, the claims, and the like.

One embodiment of the present invention is a display device including a display panel including a pixel portion that displays a still image at a frame frequency of 30 Hz or less, a temperature sensing unit that senses the temperature of the display panel, a memory device that stores a correction table containing correction data, and a control circuit to which a piece of the correction data selected from the correction table is input in accordance with an output of the temperature sensing unit. The pixel portion includes a plurality of pixels. Each of the plurality of pixels includes a transistor, a display element, and a capacitor. The control circuit outputs a voltage based on the piece of the correction data input to the control circuit, to the capacitor included in each of the plurality of pixels.

With one embodiment of the present invention, a novel display device with high display quality can be provided.

BRIEF DESCRIPTION OF DRAWINGS

In the accompanying drawings:

FIGS. 10A-1, 10A-2, 10B-1, 10B-2, and 10C are diagrams for explaining source line inversion driving and dot inversion driving of a display device of an embodiment;

BEST MODE FOR CARRYING OUT THE INVENTION

Figure 1:
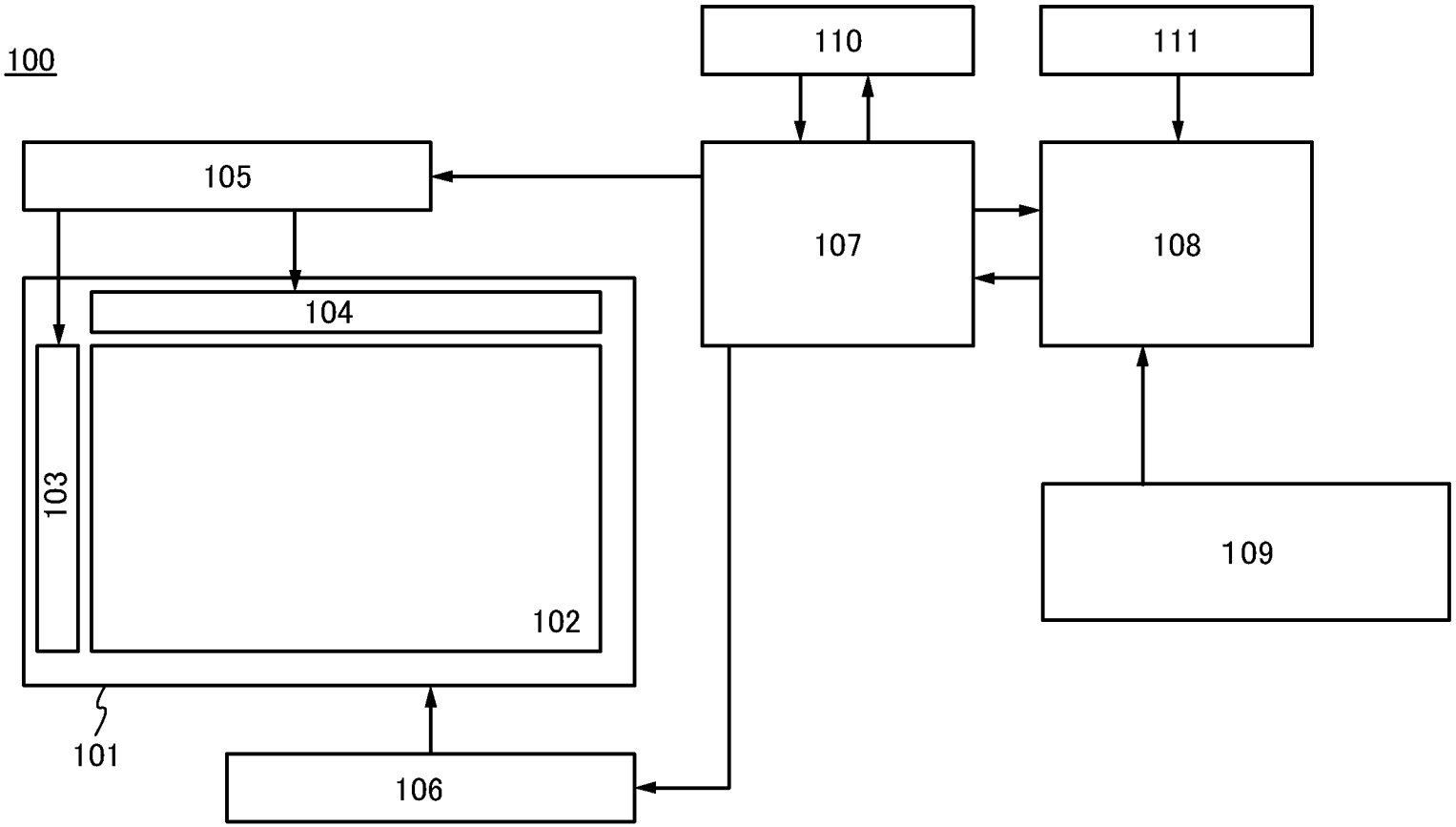
FIG. 1 is a block diagram illustrating the structure of a display device of an embodiment.

Embodiments will be hereinafter described with reference to the accompanying drawings. Note that the embodiments can be implemented with various modes, and it will be readily appreciated by those skilled in the art that modes and details can be changed in various ways without departing from the spirit and scope of the present invention. Thus, the present invention should not be interpreted as being limited to the following description of the embodiments.

In the drawings, the size, the thickness of layers, or regions may be exaggerated for clarity in some cases. Therefore, embodiments are not limited to such scales. Note that drawings are schematic views of ideal examples, and the embodiments are not limited to the shape or the value illustrated in the drawings. For example, variation in signal, voltage, or current due to noise or difference in timing can be included.

In this specification and the like, a transistor is an element having at least three terminals of a gate, a drain, and a source. In addition, the transistor has a channel region between a drain (a drain terminal, a drain region, or a drain electrode) and a source (a source terminal, a source region, or a source electrode), and current can flow through the drain, the channel region, and the source.

Here, since the source and the drain of the transistor change depending on the structure, the operating condition, and the like of the transistor, it is difficult to define which is a source or a drain. Thus, in some cases, a portion functioning as the source and a portion functioning as the drain are not called a source and a drain, and one of the source and the drain is referred to as a first electrode and the other thereof is referred to as a second electrode.

In this specification and the like, ordinal numbers such as first, second, and third are used in order to avoid confusion among components, and the terms do not limit the components numerically.

In this specification and the like, when it is described that "A and B are connected to each other", the case where A and B are electrically connected to each other is included in addition to the case where A and B are directly connected to each other. Here, the description "A and B are electrically connected to each other" means that an electric signal can be transmitted and received between A and B when an object having any electrical function exists between A and B.

In this specification and the like, terms for describing arrangement, such as "over" and "under", are used for convenience to indicate a positional relation between components with reference to drawings. A positional relation between components is changed as appropriate in accordance with a direction in which each component is described. Thus, the positional relation is not limited to that described with a term used in this specification and can be explained with another term as appropriate depending on the situation.

Note that the positional relations of circuit blocks in block diagrams are specified for description. Even when a block diagram shows that different functions are achieved by different circuit blocks, the circuit blocks in an actual circuit or an actual region may be provided in the same circuit or the same region to achieve different functions. Functions of circuit blocks in block diagrams are specified for description, and even when a block diagram shows one circuit block performing given processing, a plurality of circuit blocks may be provided in an actual circuit or an actual region to perform the processing.

Note that a pixel corresponds to a display unit controlling the luminance of one color component (e.g., any one of R (red), G (green), and B (blue)). Thus, in a color display device, the minimum display unit of a color image is composed of three pixels of an R pixel, a G pixel, and a B pixel. Note that the colors of the color elements for displaying color images are not limited to three colors and may be more than three colors or may include a color other than RGB.

Embodiment 1

In Embodiment 1, an example of the structure of a display device in one embodiment of the present invention will be described with reference to FIG. 1, FIGS. 2A and 2B, FIG. 3, FIG. 4, and FIG. 5.

In this specification and the like, a display device includes display elements. Examples of display elements are liquid crystal elements (also referred to as liquid crystal display elements), light-emitting elements (also referred to as light-emitting display elements), electrophoretic elements, and electrowetting elements. A light-emitting element includes, in its category, an element whose luminance is controlled by current or voltage, and specifically includes an inorganic electroluminescent (EL) element and an organic EL element. Further, a display medium whose contrast is changed by an electric effect, such as electronic ink, can be used.

In addition, the display device includes, in its category, a panel in which a display element is sealed and a module in which an IC including a controller or the like is mounted on the panel. The display device also includes, in its category, an element substrate that corresponds to one embodiment before the display element is completed in a manufacturing process of the display device. The element substrate is provided with a means for supplying current to the display element in each of a plurality of pixels. Specifically, the element substrate may be in a state in which only a pixel electrode of the display element is provided, a state after formation of a conductive film to be a pixel electrode and before etching of the conductive film to form the pixel electrode, or any other state.

Note that a display device in this specification and the like refers to an image display device or a light source (including a lighting device). Further, the display device includes any of the following modules in its category: a module including a connector such as an flexible printed circuit (FPC), a tape automated bonding (TAB) tape, or a tape carrier package (TCP); a module having a TAB tape provided with a printed wiring board at the end thereof; and a module having an integrated circuit (IC) directly mounted on a display panel by a chip-on-glass (COG) method.

In this embodiment, a liquid crystal display device including a liquid crystal element is described as a display device.

FIG. 1 is a block diagram illustrating a display device of one embodiment of the present invention. As illustrated in FIG. 1, a display device 100 of one embodiment of the present invention includes a display panel 101 having a pixel portion 102, a first driver circuit 103, and a second driver circuit 104; a control circuit 105; a control circuit 106; an image processing circuit 107; an arithmetic processing unit 108; an input means 109; a memory device 110; and a temperature sensing unit 111.

Figure 2A:
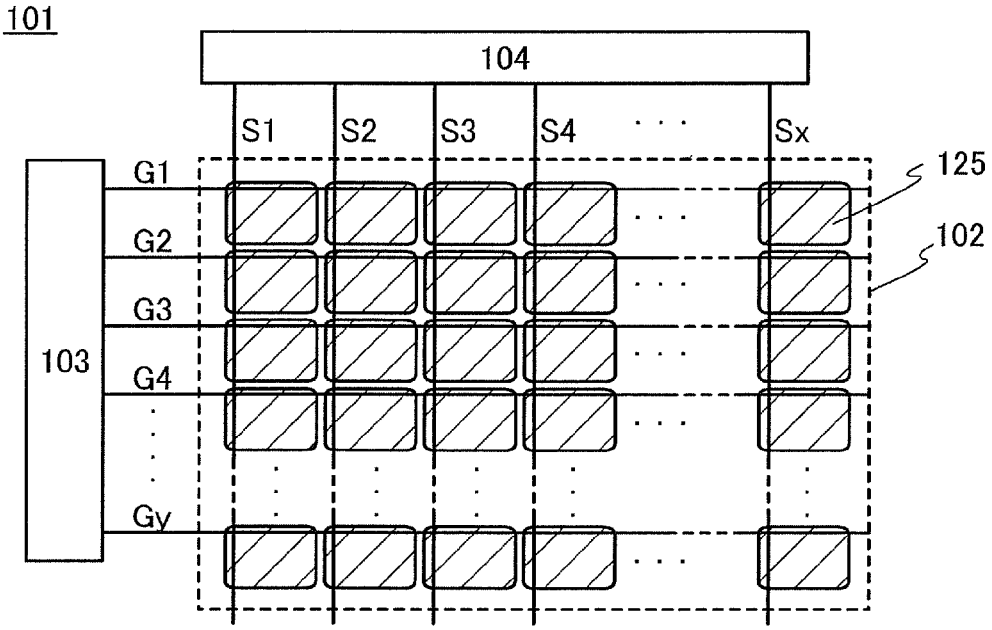
FIGS. 2A and 2B illustrate the structure of a display device of an embodiment.

FIG. 2A illustrates an example of the display panel 101. The pixel portion 102, the first driver circuit 103, and the second driver circuit 104 are arranged in the display panel 101.

The pixel portion 102 includes y first wirings G1 to Gy, x second wirings S1 to Sx, and a plurality of pixels 125 arranged in a matrix of y rows and x columns. The y first wirings G1 to Gy function as gate lines, and the x second wirings S1 to Sx function as source lines. The y first wirings G1 to Gy are electrically connected to the first driver circuit 103. The x second wirings S1 to Sx are electrically connected to the second driver circuit 104.

The first driver circuit 103 functions as a gate driver circuit, and the second driver circuit 104 functions as a source driver circuit. The first driver circuit 103 outputs a first driving signal for selecting a pixel to the pixel portion 102. The second driver circuit 104 outputs a second driving signal to the pixel portion 102.

Each of the plurality of pixels 125 includes a transistor, a display element, and a capacitor. In addition to the transistor, the display element, and the capacitor, the pixel 125 may also include another transistor, a diode, a resistor, another capacitor, an inductor, and/or the like.

Figure 2B:
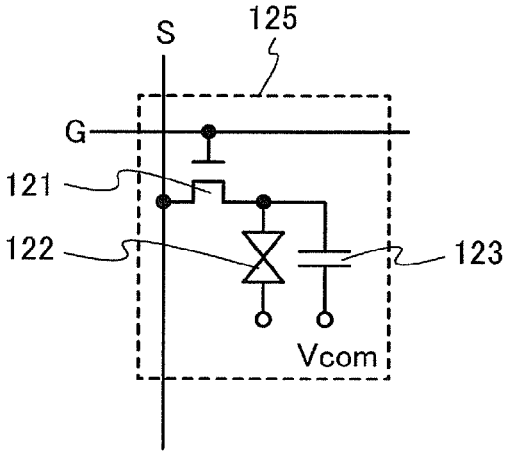

FIG. 2B illustrates one of the plurality of pixels 125. As illustrated in FIG. 2B, a gate of a transistor 121 is electrically connected to the first wiring G. One of a source and a drain of the transistor 121 is electrically connected to the second wiring S. The other of the source and the drain of the transistor 121 is electrically connected to a first electrode of a display element 122. A predetermined reference potential is applied to a second electrode of the display element 122.

As the display element 122, a liquid crystal element can be used, for example. The liquid crystal element includes a first electrode, a second electrode, and a liquid crystal layer containing a liquid crystal material to which a voltage between the first electrode and the second electrode is applied. The transmittance of the liquid crystal element is changed in accordance with orientation of liquid crystal molecules that changes depending on a voltage applied between the first electrode and the second electrode. Thus, the transmittance is controlled by the potential of the second driving signal, so that the liquid crystal element can express gray level.

The transistor 121 controls whether to apply the potential of the second wiring S to the first electrode of the display element 122.

As the transistor 121, a transistor including an oxide semiconductor can be used. Since the off-state current of this transistor is extremely low, the off-state current of the transistor is almost negligible. The transistor including an oxide semiconductor will be described in detail in a latter embodiment. However, depending on the case, the transistor 121 can be a transistor that does not include an oxide semiconductor, for example, a transistor including silicon.

Extremely low off-state current of the transistor including an oxide semiconductor enables a longer signal retention time. In a general liquid crystal display device, data is written 60 times per second. With the use of the transistor including an oxide semiconductor, however, the frame frequency can be lowered in such a manner that write operation is performed as less frequently as possible when images do not need to be switched, for example, when a still image is displayed. Thus, power consumption of the display device 100 can be reduced.

For example, the first driver circuit 103 has a function of outputting the first driving signal to the pixel portion 102 through one of the first wirings G1 to Gy 30 or more times per second, preferably 60 or more times and less than 960 times per second (a first mode), and a function of outputting the first driving signal to the pixel portion 102 one or more times per day and less than 0.1 times per second, preferably one or more times per hour and less than one time per second (a second mode). For instance, in displaying a still image, the display device is driven in the second mode. The mode of the first driver circuit 103 is switched between the first mode and the second mode by a mode switching signal input to the first driver circuit 103.

Note that when the display device is driven in the second mode with lower frame frequency, it is necessary to prevent a change of a still image over time from being recognized by a user.

Figure 3:
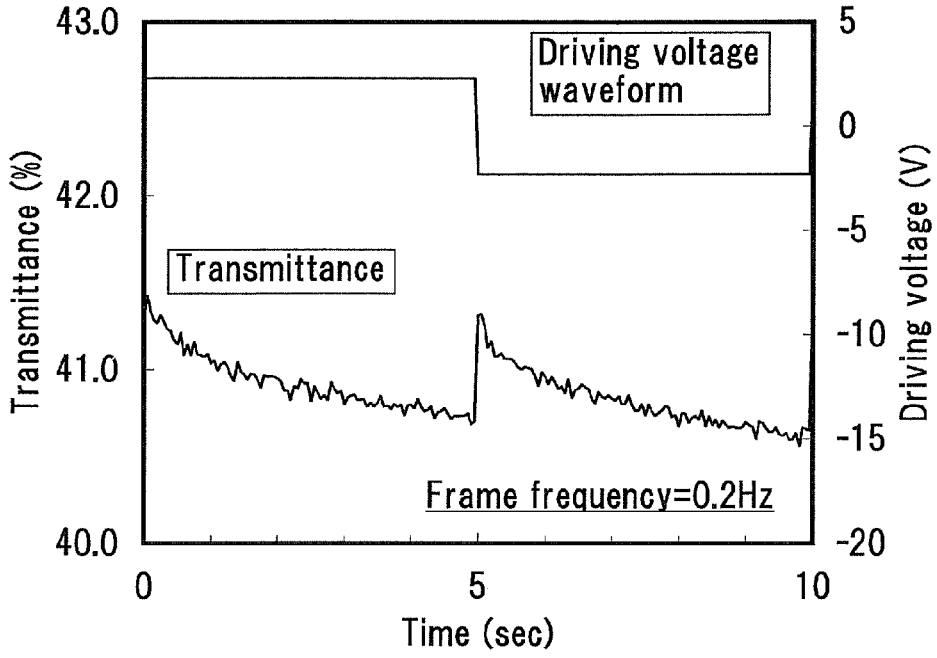
FIG. 3 is a graph showing change over time in the transmittance of a liquid crystal layer.

FIG. 3 shows a change over time of the transmittance of a liquid crystal element including a TN-mode liquid crystal layer under voltage application. A driving voltage (with the rectangular waveform shown on the upper side in FIG. 3) is applied to the first electrode at a frame frequency of 0.2 Hz. A voltage of 0 V is applied to the second electrode. The sawtooth waveform on the lower side in FIG. 3 represents a change over time of the transmittance of the liquid crystal element in which a voltage Vmid that alternates between +2.5 V and −2.5V is applied to the liquid crystal layer.

As shown in FIG. 3, the gray level expressed by the liquid crystal element including the TN-mode liquid crystal layer varies within the range of 2.2 gray levels (transmittance range of 0.7%).

As described above, in the pixel 125 illustrated in FIGS. 2A and 2B, the transistor 121 is a transistor including an oxide semiconductor. The off-state current of the transistor is as low as less than 1 zA; thus, leakage due to the off-state current is almost negligible. It is therefore likely that a reduction in the transmittance shown in FIG. 3 is due to leakage current caused by the liquid crystal material.

A liquid crystal display device driven in the second mode can be regarded as operating with pseudo DC voltage driving. Consequently, when voltage of one polarity is applied to a liquid crystal layer for a long time, localization of ionic impurities included in the liquid crystal material, for example, may cause voltage change, which is the cause of transmittance variation of the liquid crystal layer.

When the transmittance of the liquid crystal layer changes with time as above, a luminance varies every time an image is rewritten, and the variation in luminance is perceived as a flicker by a user and thus causes eyestrain. In the second mode with lower frame frequency, suppression of transmittance variation is important in reducing such eyestrain.

In view of this, in one embodiment of the present invention, a luminance variation is reduced in the display device in such a manner that variation in the transmittance of the display element is corrected by application of voltage opposite in polarity to voltage causing a luminance variation to a common terminal (also referred to as second electrode) of a capacitor 123.

A first electrode of the capacitor 123 illustrated in FIG. 2B is electrically connected to the first electrode of the display element 122 and the second electrode thereof is electrically connected to the control circuit 106 illustrated in FIG. 1.

The memory device 110 in FIG. 1 stores a correction table containing data for correction. For example, since the properties of the liquid crystal material included in the liquid crystal layer vary depending on temperature, it is necessary to acquire transmittance variation depending on the temperature of the liquid crystal material. In addition, correction data for changing the voltage of the second electrode of the capacitor so as to cancel out the variation in the transmittance of the display element 122 is prepared for different temperatures and stored in the correction table in the memory device 110.

Figure 4:
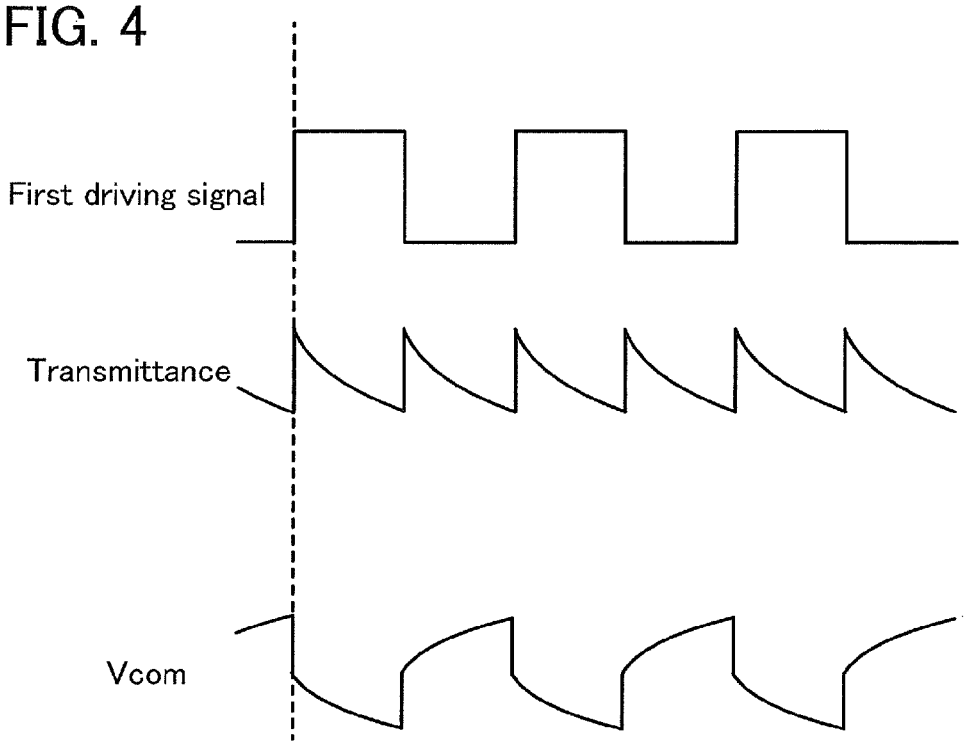
FIG. 4 is a timing chart for explaining a display device of an embodiment.

Here, an example of the voltage applied to the second electrode of the capacitor 123 is shown in FIG. 4. The first driving signal and the transmittance in FIG. 4 are shown schematically based on the results in FIG. 3. Moreover, Vcom shown in FIG. 4 is an example of the voltage applied to the second electrode of the capacitor 123.

The temperature sensing unit 111 illustrated in FIG. 1 includes at least a temperature sensor and an A/D converter. Here, the temperature sensor can be a thermistor (a resistive element whose resistance varies depending on temperature) or an IC temperature sensor (using temperature dependence of base-emitter voltage of an NPN transistor), for example. Alternatively, the temperature sensor may consist of two or more kinds of semiconductor elements with different temperature characteristics.

When the temperature is sensed by the temperature sensor in the temperature sensing unit 111 while the first driver circuit 103 is driven in the second mode, a potential corresponding to the sensed temperature is input to the A/D converter, and a potential obtained by conversion of the analog signal into a digital signal by the A/D converter is output to the arithmetic processing unit 108. Then, the arithmetic processing unit 108 outputs, to the image processing circuit 107, a signal instructing to select and read correction data corresponding to the temperature from the correction table stored in the memory device 110.

The image processing circuit 107 selects and reads correction data corresponding to the temperature from the correction table and outputs the data to the control circuit 106. The control circuit 106 controls the voltage of the common terminal of the capacitor 123 in each pixel 125.

Figure 5:
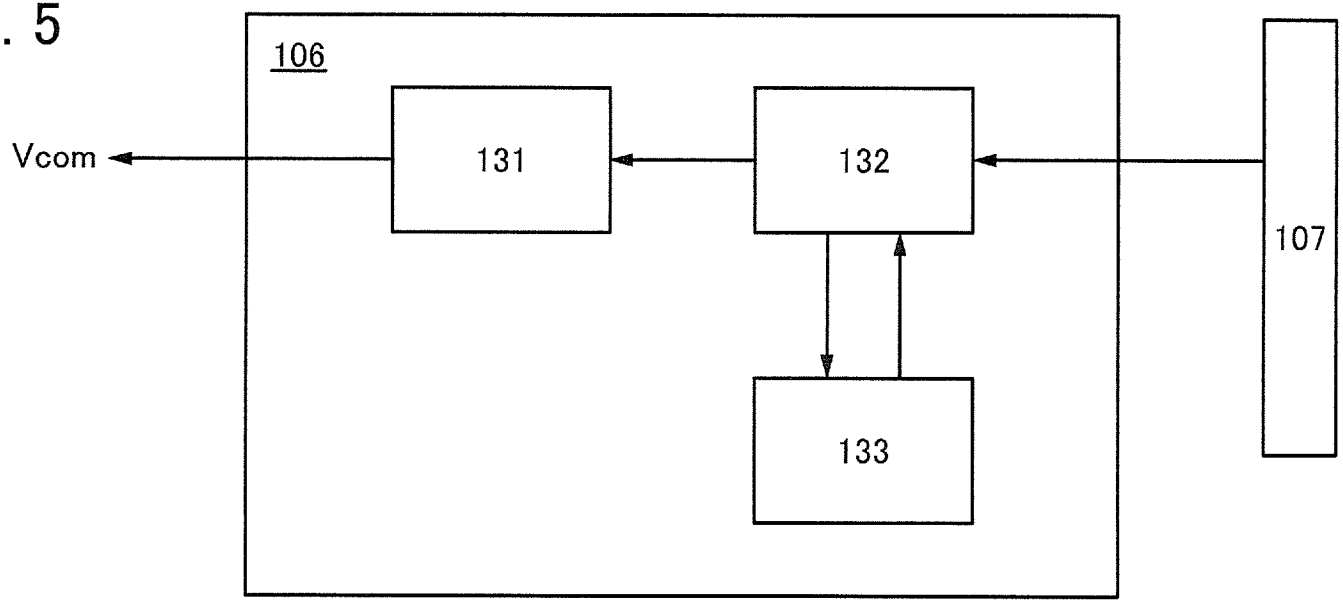
FIG. 5 illustrates the structure of a display device of an embodiment.

FIG. 5 illustrates an example of the control circuit 106. The control circuit 106 includes a D/A converter 131, a D/A converter control circuit 132, and a memory device 133, for example. The D/A converter control circuit 132 outputs the correction data input from the image processing circuit 107, to the D/A converter 131 as correction data corresponding to the frame frequency. The memory device 133 stores a correction table including correction data corresponding to frame frequencies.

When the correction data corresponding to the temperature is input to the control circuit 106 from the image processing circuit 107, the data is input to the D/A converter control circuit 132. Then, the D/A converter control circuit 132 reads correction data corresponding to the frame frequency from the memory device 133 and outputs the data to the D/A converter 131. A potential obtained by conversion of the digital signal into an analog signal by the D/A converter 131 is applied to the second electrode of the capacitor 123 in each of the pixels 125 in the pixel portion 102.

When the frame frequency is changed by the arithmetic processing unit 108 and a signal representing the change is input to the D/A converter control circuit 132, the D/A converter control circuit 132 reads correction data corresponding to the frame frequency from the memory device 133 and outputs the data to the D/A converter 131. A potential obtained by conversion of the digital signal into an analog signal by the D/A converter 131 is applied to the second electrode of the capacitor 123 in each pixel 125 in the pixel portion 102.

By application of the potential based on correction data to the common terminal of the capacitor 123 in each pixel 125, the variation in the transmittance of the display element 122 in each pixel 125 can be cancelled out, thereby suppressing a variation in the transmittance. Thus, a luminance variation can be prevented from occurring when an image is rewritten in the display device driven in the second mode. Accordingly, it is possible to provide a display device with higher display quality and to provide an eye-friendly display device that gives less eye fatigue to a user.

This embodiment can be freely combined with any of the other embodiments in this specification.

Embodiment 2

In Embodiment 2, an example of a method of driving the display device shown in Embodiment 1 will be described with reference to FIG. 1, FIGS. 2A and 2B, FIG. 6, and FIG. 7.

Specifically, the description is made on a method of switching between a first mode where a first driving signal (also referred to as G signal) for selecting a pixel is output at 60 Hz or more and a second mode where the G signal is output at 30 Hz or less, preferably 1 Hz or less, more preferably 0.2 Hz or less.

Figure 6:
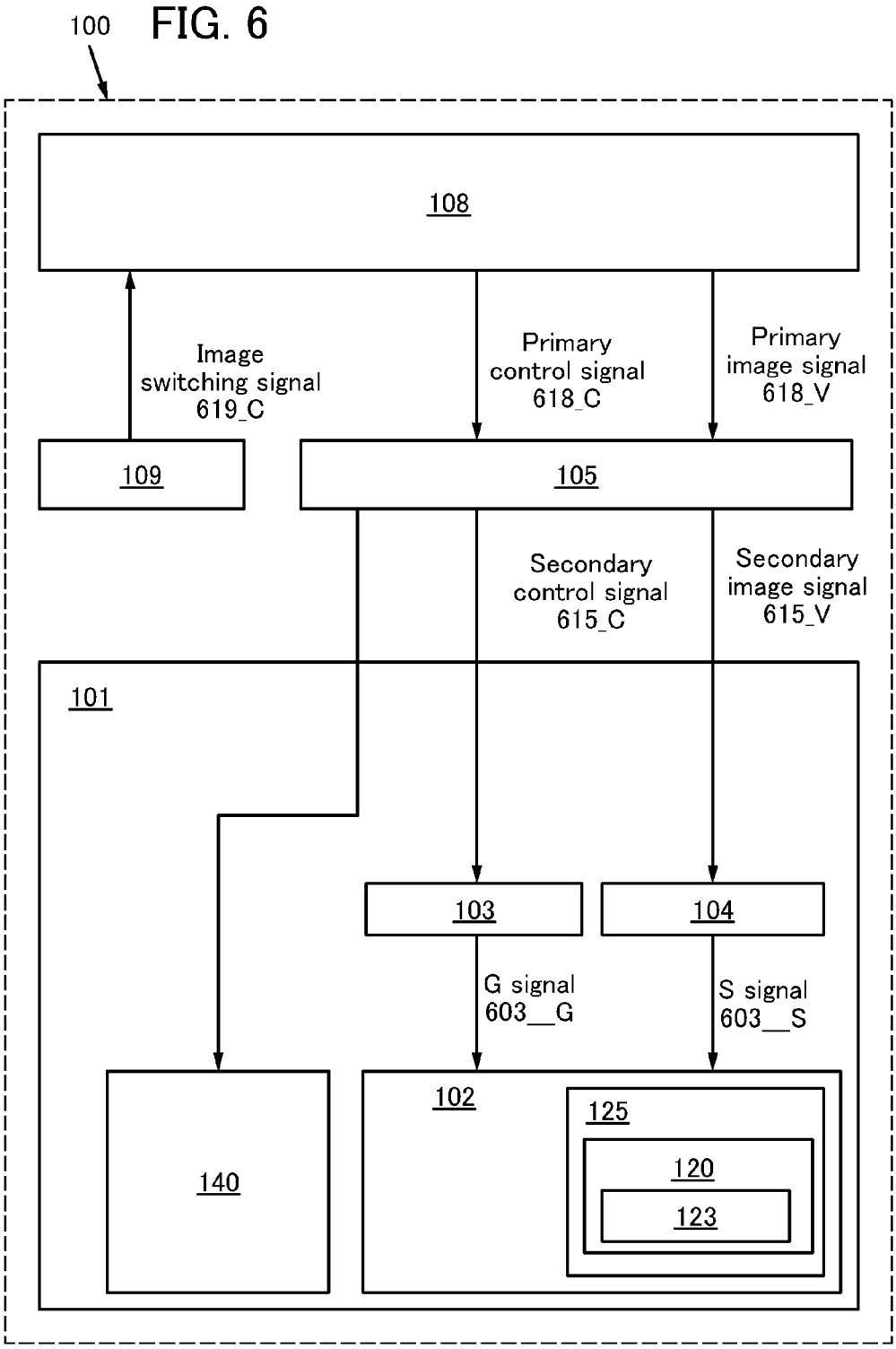
FIG. 6 is a block diagram illustrating the structure of a display device of an embodiment.

FIG. 6 is a block diagram of the display device 100 in FIG. 1, in which the control circuit 106, the image processing circuit 107, the memory device 110, and the temperature sensing unit 111 are not shown.

The arithmetic processing unit 108 generates a primary control signal 618_C and a primary image signal 618_V. The arithmetic processing unit 108 may generate the primary control signal 618_C including a mode switching signal in accordance with an image switching signal 619_C input from the input means 109.

For example, when the first driver circuit 103 driven in the second mode is supplied with the image switching signal 619_C from the input means 109 through the arithmetic processing unit 108 and the control circuit 105, the first driver circuit 103 switches from the second mode to the first mode, outputs the G signal to the pixel portion 102 one or more times, and then switches to the second mode.

For example, when the input means 109 senses page turning operation, the input means 109 outputs the image switching signal 619_C to the arithmetic processing unit 108.

Then, the arithmetic processing unit 108 generates the primary image signal 618_V including the page turning operation and the primary control signal 618_C including the image switching signal 619_C, and outputs the primary image signal 618_V and the primary control signal 618_C to the control circuit 105.

The control circuit 105 outputs a secondary control signal 615_C including the image switching signal 619_C to the first driver circuit 103, and outputs a secondary image signal 615_V including the page turning operation to the second driver circuit 104.

By input of the secondary control signal 615_C, the first driver circuit 103 switches from the second mode to the first mode, outputs a G signal 603_G, and rewrites an image at such a speed that a user cannot recognize a change in the image due to each image rewrite operation.

Meanwhile, the second driver circuit 104 outputs, to the pixel portion 102, an S signal 603_S that is generated from the secondary image signal 615_V including the page turning operation and contains information on gray level or the like of an image.

Thus, the pixel portion 102 can display an image with a large number of frames including the page turning operation in a short time, thereby displaying a smooth image.

It is possible to employ a structure in which the arithmetic processing unit 108 determines whether the primary image signal 618_V output to the display panel 101 is for a moving image or a still image, and outputs a switching signal for selecting the first mode when the primary image signal 618_V is for a moving image and outputs a switching signal for selecting the second mode when the primary image signal 618_V is for a still image.

Note that whether the image to be displayed is a moving image or a still image is determined on the basis of a difference between a signal for one frame and signals for the previous and next frames included in the primary image signal 618_V; the image is judged to be a moving image when the difference is larger than a predetermined difference, and judged to be a still image when the difference does not exceed the predetermined difference.

It is possible to employ a structure in which the first driver circuit 103 outputs the G signal 603_G one or more predetermined times when switching from the second mode to the first mode, and then switches to the second mode.

The control circuit 105 outputs the secondary image signal 615_V, which is generated from the primary image signal 618_V. Note that the primary image signal 618_V may be input directly to the display panel 101.

The control circuit 105 has functions of generating the secondary control signal 615_C such as a start pulse signal SP, a latch signal LP, and a pulse width control signal PWC by using the primary control signal 618_C including a synchronization signal such as a vertical synchronization signal and a horizontal synchronization signal and supplying the secondary control signal 615_C to the display panel 101. Note that a clock signal CLK is also included in the secondary control signal 615_C.

An inversion control circuit may be provided in the control circuit 105, in which case the control circuit 105 can have a function of inverting the polarity of the secondary image signal 615_V in accordance with the timing informed by the inversion control circuit. Specifically, the polarity of the secondary image signal 615_V may be inverted in the control circuit 105, or may be inverted in the display panel 101 in accordance with an instruction from the control circuit 105.

The inversion control circuit has a function of determining the timing of inverting the polarity of the secondary image signal 615_V by using a synchronization signal. For example, the inversion control circuit includes a counter and a signal generator circuit.

The counter has a function of counting the number of frame periods by using the pulse of a horizontal synchronization signal.

The signal generator circuit has a function of informing the control circuit 105 of the timing of inverting the polarity of the secondary image signal 615_V so that the polarity of the secondary image signal 615_V is inverted every several successive frame periods by using information on the number of frame periods obtained by the counter.

As shown in FIGS. 2A and 2B, the display panel 101 includes the pixel portion 102 including the pixels 125 each having the display element 122, and the driver circuits such as the first driver circuit 103 and the second driver circuit 104.

The secondary image signal 615_V input to the display panel 101 is supplied to the second driver circuit 104. A power supply potential and the secondary control signal 615_C are supplied to the first driver circuit 103 and the second driver circuit 104.

Note that the secondary control signal 615_C includes a start pulse signal SP for the second driver circuit, a clock signal CLK for the second driver circuit, and a latch signal LP that are used for controlling the operation of the second driver circuit 104; and a start pulse signal SP for the first driver circuit, a clock signal CLK for the first driver circuit, and a pulse width control signal PWC that are used for controlling the operation of the first driver circuit 103.

A light supply unit 140 illustrated in FIG. 6 is provided with a plurality of light sources. The control circuit 105 controls driving of the light sources included in the light supply unit 140.

As the light sources of the light supply unit 140, a cold cathode fluorescent lamp, a light-emitting diode (LED), an OLED element that generates luminescence (electroluminescence) by application of an electric field, or the like can be used.

In particular, the intensity of blue light emitted from the light source is preferably lower than that of light of any other color. Since blue light included in light emitted from the light source is not absorbed by the cornea and lens of the eye and reaches the retina, this structure can reduce long-term effects of blue light on the retina (e.g., age-related macular degeneration), adverse effects of exposure to blue light until midnight on the circadian rhythm, and the like. In addition, light emitted from the light source preferably has a wavelength longer than 420 nm, more preferably longer than 440 nm.

Figure 7:
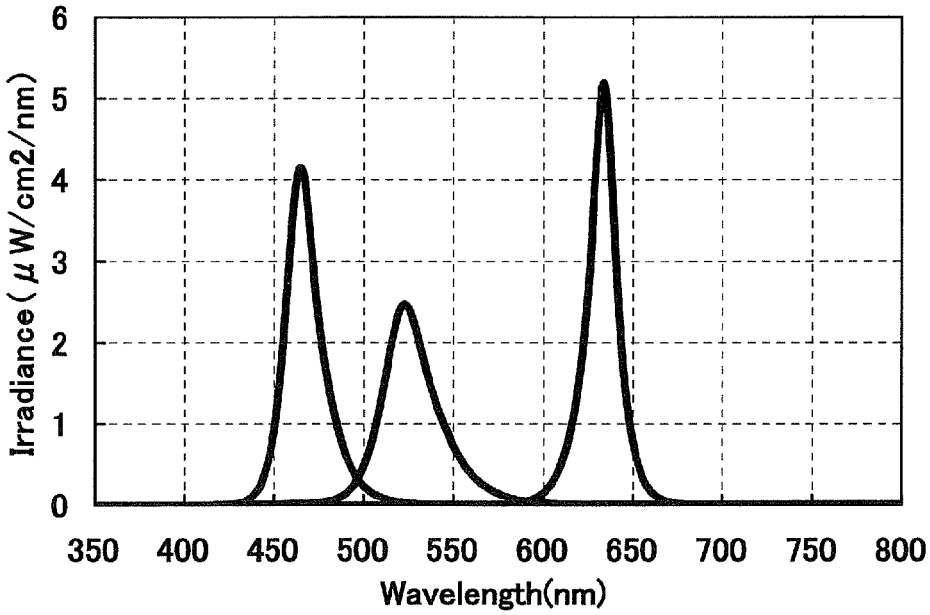
FIG. 7 shows emission spectra of a backlight.

Here, spectra of light emitted from a preferred backlight are shown in FIG. 7. FIG. 7 shows an example of spectra of light emitted from LEDs of three colors of R (red), G (green), and B (blue) used as the light source of the backlight. In FIG. 7, irradiance is hardly measured below 420 nm. A display portion using such a light source for the backlight can suppress eye fatigue of a user. Note that irradiance is radiant flux incident on a unit area. Radiant flux is radiant power released, transported, or received per unit time.

The luminance of short-wavelength light is reduced with such a light source, whereby eyestrain and damage to the retina of the user can be suppressed, and the detriment of the user's health can be prevented as a result.

The input means 109 can be a touch panel, a touchpad, a mouse, a joystick, a trackball, a data glove, an imaging device, or the like. The arithmetic processing unit 108 can relate an electric signal input from the input means 109 with coordinates in the display portion; thus, the user can input an instruction to process information displayed on the display portion.

Examples of information that the user inputs with the input means 109 are a drag instruction to change the position of an image displayed on the display portion, a swipe instruction to move from the current image to the next, an instruction to scroll through an image, an instruction to select a particular image, a pinch instruction to change the size of a displayed image, and an instruction to perform handwriting input.

The display device 100 includes the control circuit 105 that controls the first driver circuit 103 and the second driver circuit 104.

In the case where the display element 122 is used as a display element, the light supply unit 140 is provided in the display panel 101. The light supply unit 140 supplies light to the pixel portion 102 where liquid crystal elements are provided, and functions as a backlight.

By controlling the G signal 603_G output from the first driver circuit 103, the display device 100 can reduce the rate of selecting one of the plurality of pixels 125 provided in the pixel portion 102. Moreover, in the display device, variation in the transmittance of the display element is corrected by application of voltage opposite in polarity to voltage causing a luminance variation to the common terminal of the capacitor 123, whereby a luminance variation can be prevented from occurring. Accordingly, it is possible to provide a display device with higher display quality and to provide an eye-friendly display device that gives less eye fatigue to a user.

This embodiment can be freely combined with any of the other embodiments in this specification.

Embodiment 3

In Embodiment 3, another example of a method of driving the display device shown in Embodiment 1 will be described with reference to FIGS. 2A and 2B and FIG. 8.

<1. Method of Writing S Signal into Pixel Portion>

An example of a method of writing the S signal 603_S into the pixel portion 102 illustrated in FIG. 2A will be described. Specifically, a method of writing the S signal 603_S into each pixel 125 in FIG. 2B of the pixel portion 102 will be described. Note that the description of FIG. 6 can be referred to for the details of the S signal and the G signal; therefore, the detailed description is not repeated in this embodiment.

<Signal Writing into Pixel Portion>

In a first frame period, the pulsed G signal 603_G is input to the first wiring G1, so that the first wiring G1 is selected. In each of the plurality of pixels 125 connected to the selected first wiring G1, the transistor 121 is turned on.

When the transistors 121 are on (in one line period), the potential of the S signal 603_S generated from the secondary image signal 615_V is applied to the second wirings S1 to Sx. Then, electric charge corresponding to the potential of the S signal 603_S is accumulated in the capacitor 123 through the on-state transistor 121, and the potential of the S signal 603_S is applied to the first electrode of the display element 122.

In a period during which the first wiring G1 is selected in the first frame period, the S signals 603_S with positive polarity are sequentially input to all the second wirings S1 to Sx. The S signals 603_S with positive polarity are applied to first electrodes (G1S1 to G1Sx) in the pixels 125 connected to the first wiring G1 and the respective second wirings S1 to Sx. Thus, the transmittance of the display element 122 is controlled by the potential of the S signal 603_S, and grayscale is expressed by the pixels.

Similarly, the first wirings G2 to Gy are sequentially selected, and the pixels 125 connected to the first wirings G2 to Gy are sequentially subjected to the same operation as that performed while the first wiring G1 is selected. Through the above operations, an image for the first frame can be displayed on the pixel portion 102.

Note that in one embodiment of the present invention, the first wirings G1 to Gy are not necessarily selected sequentially.

It is possible to employ dot sequential driving in which the S signals 603_S are sequentially input to the second wirings S1 to Sx from the second driver circuit 104 or line sequential driving in which the S signals 603_S are input all at once. Alternatively, a driving method in which the S signals 603_S are sequentially input to every several second wirings S may be employed.

The method of selecting the first wirings G is not limited to progressive scan and may be interlaced scan.

In given one frame period, the polarities of the S signals 603_S input to all the second wirings S may be the same, or the polarities of the S signals 603_S to be input to the pixels may be inverted every other second wiring S.

<Signal Writing into Pixel Portion Divided into a Plurality of Regions>

Figure 8:
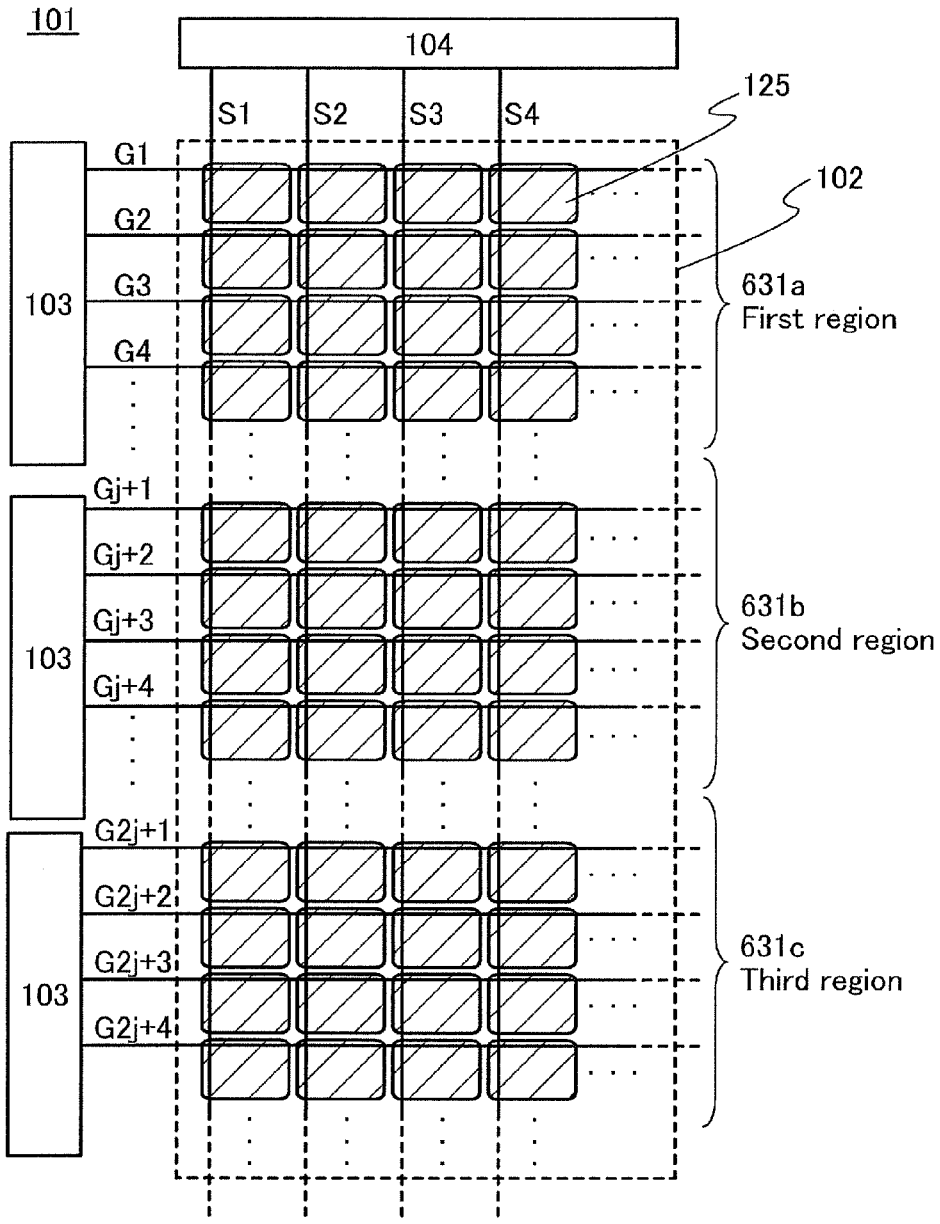
FIG. 8 illustrates the structure of a display portion in a display device of an embodiment.

FIG. 8 illustrates a variation of the structure of the display panel 101.

In the display panel 101 illustrated in FIG. 8, the pixel portion 102 divided into a plurality of regions (specifically, a first region 631*a*, a second region 631*b*, and a third region 631*c*) is provided with a plurality of pixels 125, a plurality of first wirings G for selecting the pixels 125 row by row, and a plurality of second wirings S for supplying the S signals 603_S to the selected pixels 125.

Input of the G signals 603_G to the first wirings G in each region is controlled by the corresponding first driver circuit 103. Input of the S signals 603_S to the second wirings S is controlled by the second driver circuit 104. Each of the plurality of pixels 125 is connected to at least one of the first wirings G and at least one of the second wirings S.

Such a structure allows the pixel portion 102 to be driven region by region independently.

For example, when information is input with a touch panel used as the input means 109, coordinates specifying a region to which the information is input are obtained, and only the first driver circuit 103 that drives the region corresponding to the coordinates may be put in the first mode and the first driver circuits 103 for the other regions may be put in the second mode. By this operation, the operation of the first driver circuit 103 for a region to which the information is not input with the touch panel, that is, a region where a displayed image is not necessary to be rewritten can be stopped.

<2. First Driver Circuit in First Mode and Second Mode>

The first driver circuit 103 operates in the first mode or the second mode. The S signal 603_S is input to the pixel 125 to which the G signal 603_G output from the first driver circuit 103 has been input. For example, when the first driver circuit 103 operates in the second mode, the pixel 125 holds the potential of the S signal 603_S while the G signal 603_G is not input. In other words, the pixel 125 holds a state where the potential of the S signal 603_S is written.

The pixel 125 into which display data is written maintains a display state corresponding to the S signal 603_S. Note that the expression "maintaining a display state" means keeping the amount of change in display state so as not to exceed a given range. This given range is set as appropriate and is preferably set so that a user watching images recognizes the displayed images as one image, for example.

<2-1. First Mode>

The first driver circuit 103 in the first mode outputs the G signal 603_G to pixels 30 times or more per second, preferably 60 times or more and less than 960 times per second.

The first driver circuit 103 in the first mode rewrites an image at such a speed that the user cannot recognize a change in the image due to each image rewrite operation. As a result, a smooth moving image can be displayed.

<2-2. Second Mode>

The first driver circuit 103 in the second mode outputs the G signal 603_G to pixels one or more times per day and less than 0.1 times per second, preferably one or more times per hour and less than one time per second.

While the G signal 603_G is not input, the pixel 125 holds the S signal 603_S and maintains the display state corresponding to the potential of the S signal 603_S.

At this time, as has been described in the foregoing embodiment, variation in the transmittance can be corrected by application of voltage opposite in polarity to voltage causing a luminance variation in the display element 122 to the common terminal of the capacitor 123 included in the pixel 125.

Thus, in the second mode, images without flickers due to display rewriting in the pixels can be displayed.

As a result, eye fatigue of the user of the display device having the above display function can be suppressed. That is, the display device can perform easy-on-the-eyes display.

Note that power consumed by the first driver circuit 103 is reduced while the first driver circuit 103 does not operate.

Note that the pixel driven by the first driver circuit 103 having the second mode is preferably configured to hold the S signal 603_S for a long time. For example, the off-state leakage current of the transistor 121 is preferably as low as possible.

Embodiments 8 and 9 can be referred to for examples of the transistor 121 having low off-state leakage current.

This embodiment can be freely combined with any of the other embodiments in this specification.

Embodiment 4

In Embodiment 4, another example of a method of driving the display device shown in Embodiment 1 will be described with reference to FIG. 9, FIGS. 10A-1, 10A-2, 10B-1, 10B-2, and 10C, and FIG. 11.

Figure 9:
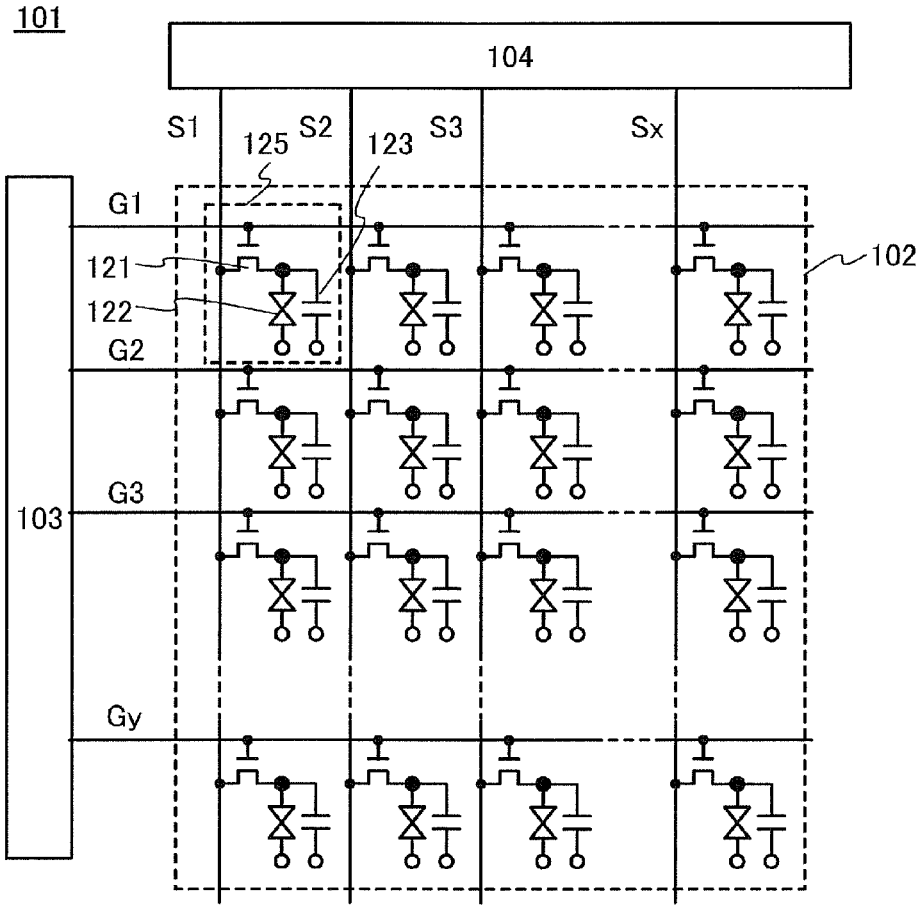
FIG. 9 is a circuit diagram illustrating a display device of an embodiment.

FIG. 9 is a circuit diagram illustrating a display panel.

FIGS. 10A-1, 10A-2, 10B-1, 10B-2, and 10C are diagrams for explaining source line inversion driving and dot inversion driving of the display device.

Figure 11:
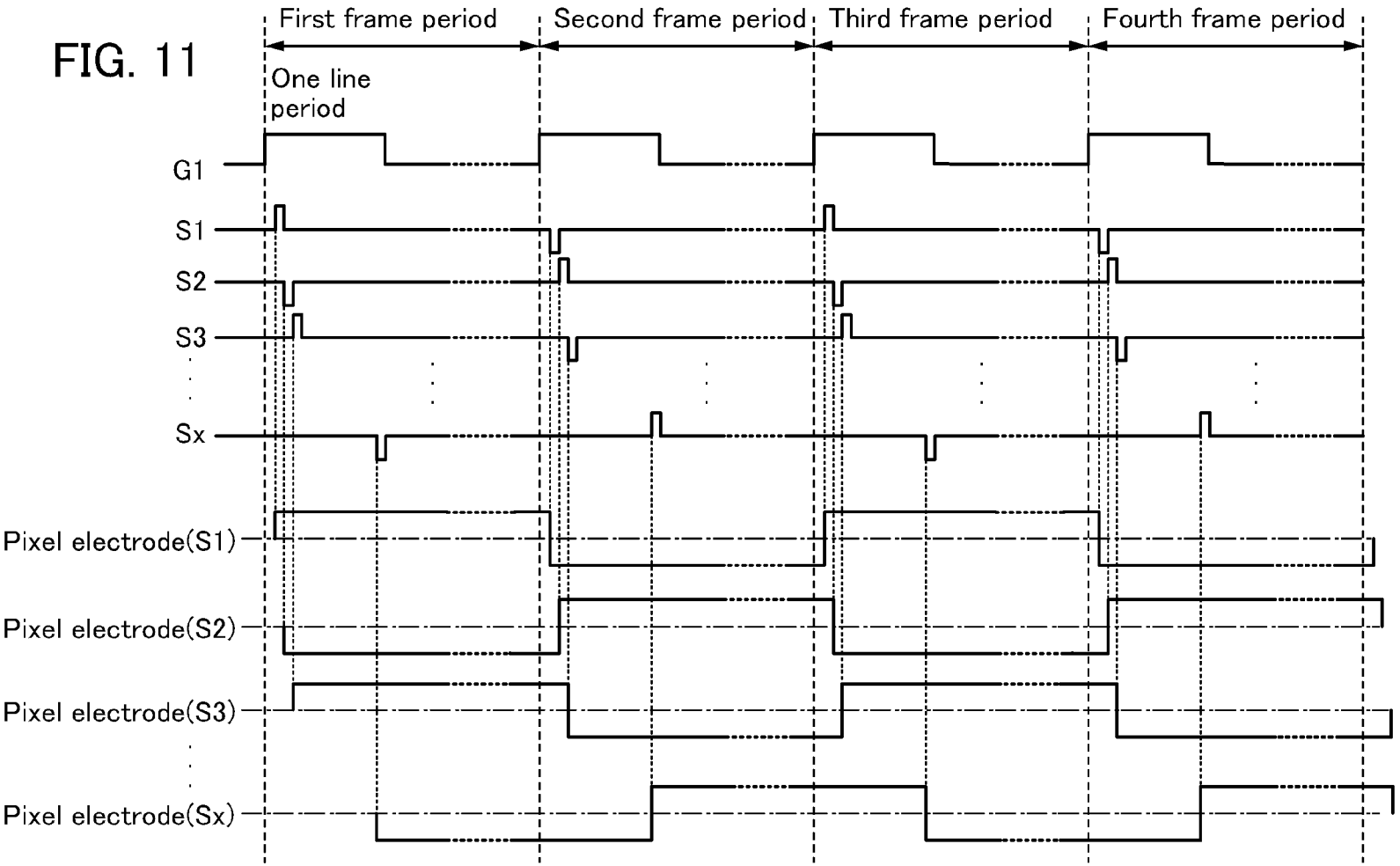
FIG. 11 is a timing chart showing source line inversion driving of a display device of an embodiment.

FIG. 11 is a timing chart showing source line inversion driving of the display device.

<1. Overdriving>

The response time of liquid crystal from application of voltage to saturation of the change in transmittance is generally about ten milliseconds. Thus, the slow response of the liquid crystal tends to be perceived as a blur of a moving image.

As a countermeasure, in one embodiment of the present invention, overdriving may be employed in which the voltage applied to the display element 122 that is a liquid crystal element is temporarily increased so that the orientation of liquid crystal changes quickly. By overdriving, the response speed of the liquid crystal can be increased, a blur of a moving image can be prevented, and the quality of the moving image can be improved.

If the transmittance of the display element 122, which is the liquid crystal element, keeps changing without being saturated after the transistor 121 is turned off, the relative permittivity of the liquid crystal also changes; accordingly, the voltage held in the liquid crystal element as the display element 122 is likely to change.

For example, when a capacitor is not connected in parallel with the display element 122, which is the liquid crystal element, or when the capacitor 123 connected to the display element 122 has small capacitance, the voltage held in the display element 122 is likely to change markedly. However, the overdriving can shorten the response time, thereby suppressing a change in the transmittance of the liquid crystal element as the display element 122 after the transistor 121 is turned off. Accordingly, even if the capacitor 123 connected in parallel with the display element 122 has small capacitance, the voltage held in the display element 122 can be prevented from changing after the transistor 121 is turned off.

<2. Source Line Inversion Driving and Dot Inversion Driving>

Figures 1, 10A:
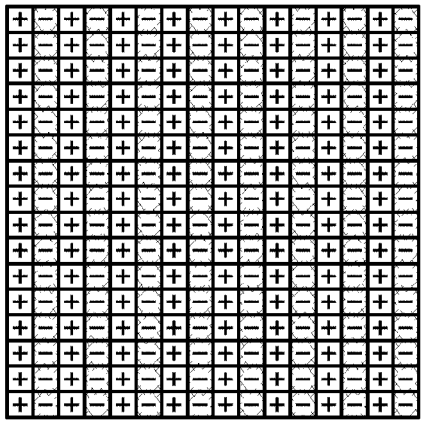
Figures 2, 10A:
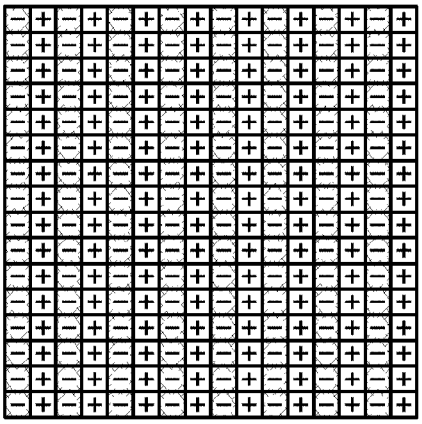
Figures 1, 10B:
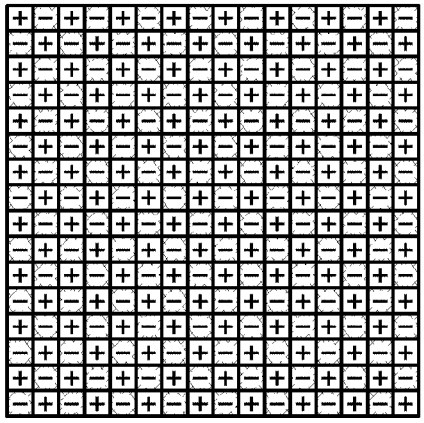
Figures 2, 10B:
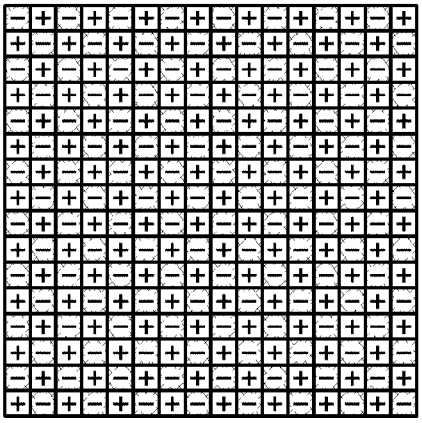
Figure 10C:
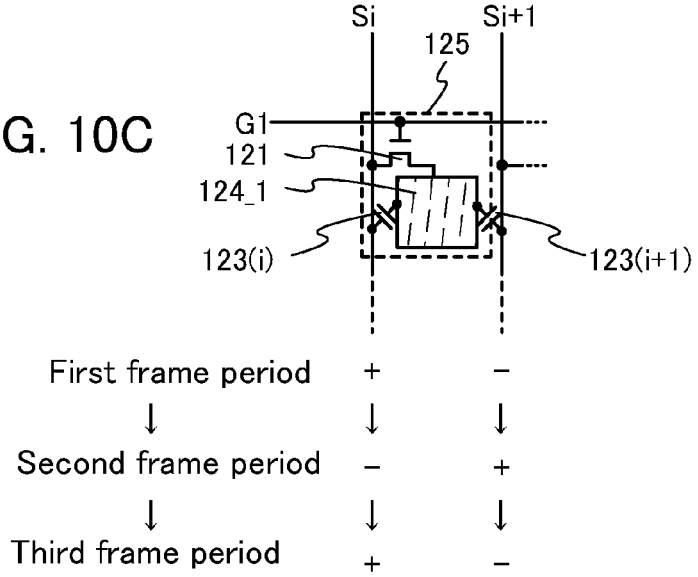

In the pixel 125 connected to the second wiring Si illustrated in FIG. 10C, a pixel electrode 124_1 is placed between the second wiring Si and the second wiring Si+1 adjacent to the second wiring Si. It is ideal that the pixel electrode 124_1 and the second wiring Si are electrically separated from each other while the transistor 121 is off, and that the pixel electrode 124_1 and the second wiring Si+1 are electrically separated from each other. In reality, however, there are a parasitic capacitor 123(*i*) between the pixel electrode 124_1 and the second wiring Si and a parasitic capacitor 123(*i*+1) between the pixel electrode 124_1 and the second wiring Si+1 (see FIG. 10C). Note that FIG. 10C illustrates the pixel electrode 124_1 functioning as the first electrode or the second electrode of the display element 122, instead of illustrating the display element 122 as in FIG. 9.

When the first electrode and the second electrode of the display element 122 are provided to overlap each other, for example, overlap of the two electrodes can substantially act as a capacitor, so that in some cases, the capacitor 123 formed using a capacitor wiring is not connected to the display element 122 or the capacitance of the capacitor 123 connected to the display element 122 is small. In such a case, the potential of the pixel electrode 124_1 serving as the first electrode or the second electrode of the liquid crystal element is likely to be affected by the parasitic capacitor 123(*i*) and the parasitic capacitor 123(*i*+1).

Accordingly, even when the transistor 121 is off in a period during which the potential of an image signal is held, the potential of the pixel electrode 124_1 is likely to vary in response to change in the potential of the second wiring Si or the second wiring Si+1.

A phenomenon where the potential of a pixel electrode varies in accordance with change in the potential of the second wiring S in a period during which the potential of the pixel electrode is held is called crosstalk. Crosstalk causes reduction in display contrast. For example, an image is whitish when normally white liquid crystal is used for the display element 122.

In view of the above, one embodiment of the present invention may employ a driving method in which image signals having opposite polarities are input to the second wiring Si and the second wiring Si+1 provided with the pixel electrode 124_1 therebetween in given one frame period.

Note that the "image signals having opposite polarities" mean, on the assumption that the potential of a common electrode of the liquid crystal element is a reference potential, an image signal having a potential higher than the reference potential and an image signal having a potential lower than the reference potential.

Two methods (source line inversion and dot inversion) can be given as examples of a method of sequentially writing image signals having alternating opposite polarities into selected pixels.

In either method, in a first frame period, an image signal having positive (+) polarity is input to the second wiring Si and an image signal having negative (−) polarity is input to the second wiring Si+1. Next, in a second frame period, an image signal having negative (−) polarity is input to the second wiring Si and an image signal having positive (+) polarity is input to the second wiring Si+1. Then, in a third frame period, an image signal having a positive (+) polarity is input to the second wiring Si and an image signal having a negative (−) polarity is input to the second wiring Si+1 (see FIG. 10C).

With the use of such a driving method, the potentials of a pair of second wirings S change in opposite directions, whereby variation in the potentials affecting one pixel electrode is cancelled out. Thus, generation of crosstalk can be suppressed.

<2-1. Source Line Inversion Driving>

In source line inversion, image signals having opposite polarities are input in given one frame period so that the polarity of image signals input to a plurality of pixels connected to one second wiring S and the polarity of image signals input to a plurality of pixels connected to another second wiring S adjacent to the second wiring S are opposite to each other.

FIGS. 10A-1 and 10A-2 schematically show the polarities of image signals supplied to pixels by source line inversion driving. Here, "+" indicates a pixel supplied with an image signal having positive polarity and "−" indicates a pixel supplied with an image signal having negative polarity in given one frame period. The frame shown in FIG. 10A-2 follows the frame shown in FIG. 10A-1.

<2-2. Dot Inversion Driving>

In dot inversion, image signals having opposite polarities are input in given one frame period so that the polarity of image signals input to a plurality of pixels connected to one second wiring S and the polarity of image signals input to a plurality of pixels connected to another second wiring S adjacent to the second wiring S are opposite to each other, and so that in the plurality of pixels connected to one second wiring S, the polarity of an image signal input to one pixel and the polarity of an image signal input to another pixel adjacent to the pixel are opposite to each other.

FIGS. 10B-1 and 10B-2 schematically show the polarities of image signals supplied to pixels by dot inversion driving. Here, "+" indicates a pixel supplied with an image signal having positive polarity and "−" indicates a pixel supplied with an image signal having negative polarity in given one frame period. The frame shown in FIG. 10B-2 follows the frame shown in FIG. 10B-1.

<2-3. Timing Chart>

FIG. 11 is a timing chart of the operation of the pixel portion 102 illustrated in FIG. 9 by source line inversion driving. Specifically, FIG. 11 shows changes over time of the potential of a signal supplied to the first wiring G1, the potentials of image signals supplied to the second wirings S1 to Sx, and the potentials of the pixel electrodes included in the pixels connected to the first wiring G1.

First, the pulsed signal is input to the first wiring G1, so that the first wiring G1 is selected. In each of the pixels 125 connected to the selected first wiring G1, the transistor 121 is turned on. When the potential of an image signal is supplied to the second wirings S1 to Sx while the transistor 121 is on, the potential of the image signal is supplied to the pixel electrode of the display element 122 through the on-state transistor 121.

The timing chart of FIG. 11 shows an example where in a period during which the first wiring G1 is selected in the first frame period, image signals having positive polarity are sequentially input to the odd-numbered second wirings S1, S3 . . . and image signals having negative polarity are input to the even-numbered second wirings S2, S4 . . . Sx. Accordingly, image signals having positive polarity are supplied to the pixel electrodes (S1), (S3) . . . in the pixels 125 connected to the odd-numbered second wirings S1, S3 . . . . Moreover, image signals having negative polarity are supplied to the pixel electrodes (S2), (S4) . . . (Sx) in the pixels 125 connected to the even-numbered second wirings S2, S4 . . . Sx.

In the display element 122, the orientation of liquid crystal molecules is changed in accordance with the level of voltage applied between the pixel electrode and the common electrode, whereby the transmittance is changed. Thus, the transmittance is controlled by the potential of the image signal, so that the display element 122 can express gray level.

When input of image signals to the second wirings S1 to Sx is completed, selection of the first wiring G1 is terminated. When the selection of the first wiring G1 is terminated, the transistors 121 in the pixels 125 connected to the first wiring G1 are turned off. At the same time, the display element 122 keeps the gray level by holding the voltage applied between the pixel electrode and the common electrode. Then, the first wirings G2 to Gy are sequentially selected, and the pixels connected to the first wirings G2 to Gy are sequentially subjected to the same operation as that performed while the first wiring G1 is selected.

Next, the first wiring G1 is selected again in the second frame period. In a period during which the first wiring G1 is selected in the second frame period, unlike in the period during which the first wiring G1 is selected in the first frame period, image signals having negative polarity are sequentially input to the odd-numbered second wirings S1, S3 . . . and image signals having positive polarity are input to the even-numbered second wirings S2, S4 . . . Sx. Accordingly, image signals having negative polarity are supplied to the pixel electrodes (S1), (S3) . . . in the pixels 125 connected to the odd-numbered second wirings S 1, S3 . . . . Moreover, image signals having positive polarity are supplied to the pixel electrodes (S2), (S4) . . . (Sx) in the pixels 125 connected to the even-numbered second wirings S2, S4 . . . Sx.

Also in the second frame period, when input of image signals to the second wirings S1 to Sx is finished, the selection of the first wiring G1 is terminated. Then, the first wirings G2 to Gy are sequentially selected, and the pixels connected to the first wirings G2 to Gy are sequentially subjected to the same operation as that performed while the first wiring G1 is selected.

Operation similar to the above is repeated in the third frame period and the fourth frame period.

Although the timing chart of FIG. 11 shows the example in which image signals are sequentially input to the second wirings S1 to Sx, the present invention is not limited to this structure. Image signals may be input to the second wirings S1 to Sx all at once, or image signals may be sequentially input every several second wirings S.

In this embodiment, the first wirings G are selected by progressive scan; however, interlace scan may be employed to select the first wirings G.

By inversion driving in which the polarity of the potential of an image signal is inverted using the reference potential of a common electrode as a reference, degradation of liquid crystal called burn-in can be prevented.

However, in the inversion driving, the change in a potential supplied to the second wiring S is increased when the polarity of an image signal is changed, thereby increasing a potential difference between a source electrode and a drain electrode of the transistor 121 functioning as a switching element. Thus, deterioration of the characteristics of the transistor 121, such as threshold voltage shift, is likely to occur.

Furthermore, in order to maintain the voltage held in the display element 122, the off-state current of the transistor 121 needs to be low even when the potential difference between the source electrode and the drain electrode is large.

This embodiment can be freely combined with any of the other embodiments in this specification.

Embodiment 5

Embodiment 5 will explain a method of producing an image that can be displayed on a liquid crystal display device of one embodiment of the present invention, and in particular, a method of switching images in an eye friendly way, a method of switching images with less eye fatigue given to a user, or a method of switching images without strain on the eyes of a user.

A user may have eyestrain when display is performed by switching images rapidly, for example, when scenes switch frequently in a moving image or when a still image switches to a different still image.

When display is performed by switching an image to a different image, it is preferable to switch images gradually (smoothly) and naturally, instead of instantaneously.

For example, when display switches from a first image to a different second image, fade-out images of the first image and/or fade-in images of the second image are preferably inserted between the first image and the second image. Moreover, it is possible to insert images obtained by overlapping the first image and the second image so that the first image fades out and the second image fades in at the same time (such effect is called cross-fading), or to insert a moving image for displaying a state where the first image is gradually changed into the second image (such effect is called morphing).

Specifically, a first still image is displayed at a low frame frequency, then an image for switching display is displayed at a high frame frequency, and after that, a second still image is displayed at a low frame frequency.

<Fade-In and Fade-Out>

An example of a method of switching display between an image A and an image B that are different from each other will be described below.

Figure 12A:
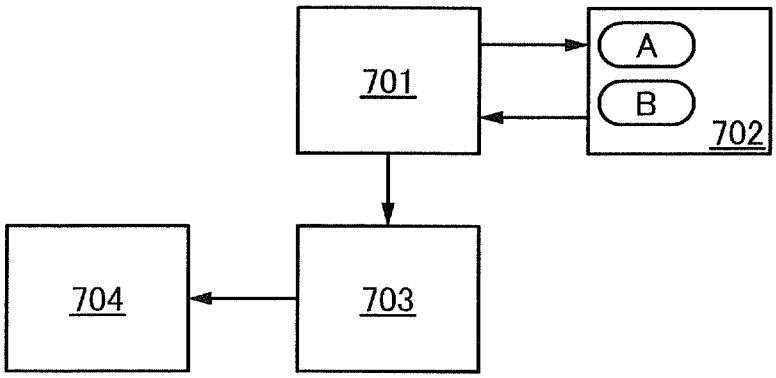
FIG. 12A is a block diagram illustrating the structure of a display device of an embodiment.

FIG. 12A is a block diagram illustrating the structure of a display device capable of switching images. The display device illustrated in FIG. 12A includes an arithmetic unit 701, a memory device 702, a graphics processing unit 703, and a display panel 704.

In a first step, the arithmetic unit 701 makes the memory device 702 store data of the image A and data of the image B from an external memory device or the like.

In a second step, the arithmetic unit 701 sequentially generates new image data based on the data of the image A and the data of the image B in accordance with the predetermined number into which the period is divided.

In a third step, the generated image data is output to the graphics processing unit 703. The graphics processing unit 703 makes the inputted image data displayed on the display panel 704.

Figure 12B:
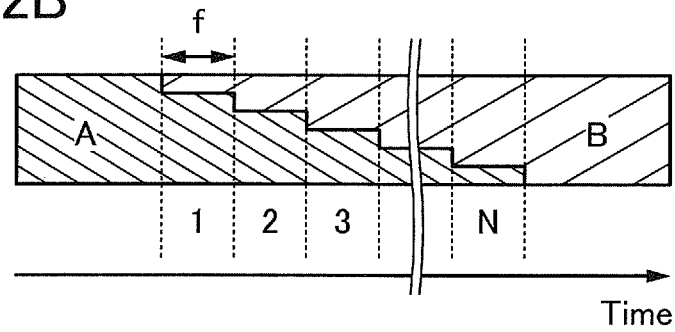
FIG. 12B is a schematic diagram explaining image data.

FIG. 12B is a schematic diagram explaining image data generated for gradually switching display from the image A to the image B.

FIG. 12B shows the case where N pieces of image data (N is a natural number) are generated to be displayed between the image A and the image B and each piece of the image data is displayed for f frame periods (f is a natural number). Thus, it takes f×N frames to switch display from the image A to the image B.

Here, it is preferable that the above parameters such as N and f be capable of setting freely by a user. The arithmetic unit 701 obtains these parameters in advance and generates image data in accordance with the parameters.

Image data generated for the i-th time (i is an integer of 1 to N) can be generated by weighting the data of the image A and the data of the image B and adding the weighted data. For example, when the luminance (gray level) of a pixel displaying the image A is denoted by a and that of the pixel displaying the image B is denoted by b, the luminance (gray level) c of the pixel displaying an image corresponding to the image data generated for the i-th time is represented by Formula 1.

[Formula 1]

$$c = \frac{(N - i)a + ib}{N} \tag{1}$$

Display switches from the image A to the image B with the use of the image data generated by the above method, whereby discontinuous image can be switched gradually (smoothly) and naturally.

Note that in Formula 1, the case where a=0 in all the pixels corresponds to fade-in by which a black image switches gradually to the image B. Moreover, the case where b=0 in all the pixels corresponds to fade-out by which the image A switches gradually to a black image.

Although the method of switching images by temporarily overlapping two images is described above, a method without overlapping operation may be employed.

In the case of not overlapping two images when display switches from the image A to the image B, a black image may be inserted between the image A and the image B. At this time, the above method of switching images may be employed when the image A changes into a black image and/or when a black image changes into the image B. Further, an image inserted between the image A and the image B is not limited to a black image, and may be a single-color image such as a white image or a multi-color image different from the image A and the image B.

When an image, particularly a single-color image such as a black image is inserted between the image A and the image B, the user can perceive that image switching is more natural, so that images can be switched without making the user feel stress.

Embodiment 6

In Embodiment 6, an example of the structure of a panel module that can be used as a display means of a liquid crystal display device in one embodiment of the present invention will be described with reference to drawings.

Figure 13A:
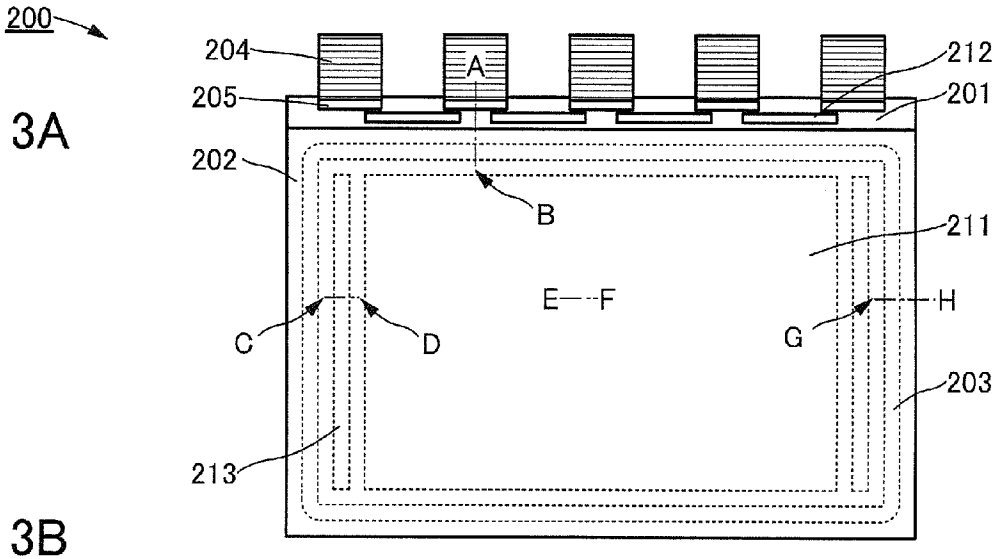
FIGS. 13A and 13B illustrate the structure of a display device of an embodiment.

FIG. 13A is a top schematic diagram of a panel module 200 described in this embodiment.

The panel module 200 includes a pixel portion 211 including a plurality of pixels and a gate driver circuit 213 in a sealed region surrounded by a first substrate 201, a second substrate 202, and a sealant 203. The panel module 200 also includes an external connection electrode 205 and an IC 212 functioning as a source driver circuit in a region outside the sealed region over the first substrate 201. Power and signals for driving the pixel portion 211, the gate driver circuit 213, the IC 212, and the like can be input from an FPC 204 electrically connected to the external connection electrode 205.

Figure 13B:
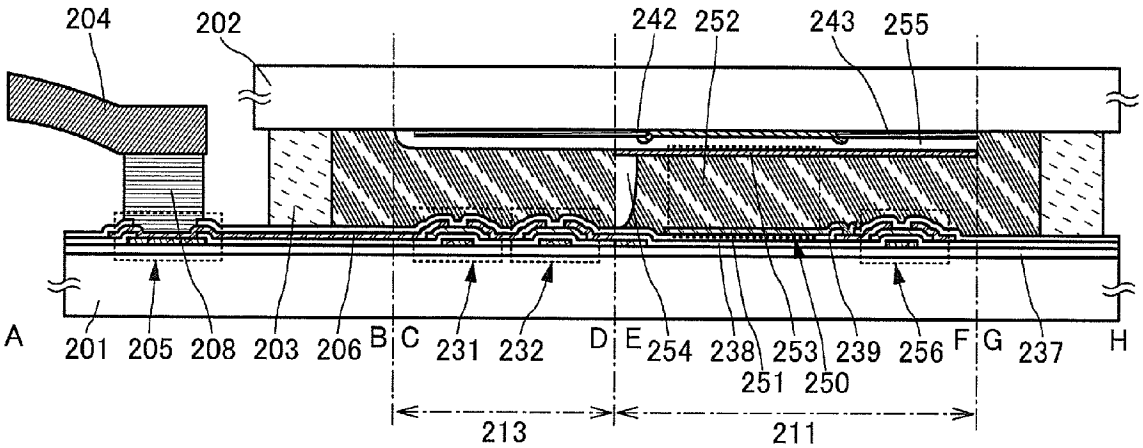

FIG. 13B is a cross-sectional schematic diagram of a region including the FPC 204 and the sealant 203 along line A-B, a region including the gate driver circuit 213 along line C-D, a region including the pixel portion 211 along line E-F, and a region including the sealant 203 along line G-H in FIG. 13A.

The first substrate 201 and the second substrate 202 are bonded to each other at their outer edge regions with the sealant 203. In the region surrounded by the first substrate 201, the second substrate 202, and the sealant 203, at least the pixel portion 211 is provided FIGS. 13A and 13B illustrate an example where the gate driver circuit 213 includes a circuit composed of n-channel transistors 231 and 232. Note that the gate driver circuit 213 is not limited to having this structure and may include various CMOS circuits, in which an n-channel transistor and a p-channel transistor are used in combination, or a circuit composed of p-channel transistors. In this structure example, the panel module is a driver-integrated module in which the gate driver circuit 213 is formed over the first substrate 201; however, one or both of the gate driver circuit and the source driver circuit may be provided over another substrate. For example, a driver circuit IC may be mounted by a COG method, or a flexible substrate (FPC) mounted with a driver circuit IC by a COF method may be mounted. In this structure example, the IC 212, which serves as the source driver circuit, is provided over the first substrate 201 by a COG method.

Note that there is no particular limitation on the structures of the transistors included in the pixel portion 211 and the gate driver circuit 213. For example, a forward staggered transistor or an inverted staggered transistor may be used. Further, a top-gate transistor or a bottom-gate transistor may be used. As a semiconductor material used for the transistors, a semiconductor material such as silicon or germanium or an oxide semiconductor containing at least one of indium, gallium, and zinc may be used, for example.

Further, there is no particular limitation on the crystallinity of a semiconductor used for the transistors, and an amorphous semiconductor or a semiconductor having crystallinity (a microcrystalline semiconductor, a polycrystalline semiconductor, a single crystal semiconductor, or a semiconductor partly including crystal regions) may be used. The use of a semiconductor having crystallinity is preferable because deterioration of transistor characteristics can be reduced.

A typical example of an oxide semiconductor containing at least one of indium, gallium, and zinc is an In—Ga—Zn-based metal oxide. An oxide semiconductor having a wider band gap and lower carrier density than silicon is preferably used because off-state leakage current can be reduced. The details of preferred oxide semiconductors will be described in Embodiments 8 and 9.

FIG. 13B illustrates a cross-sectional structure of one pixel as an example of the pixel portion 211. The pixel portion 211 includes a liquid crystal element 250 in vertical alignment (VA) mode.

One pixel includes at least a switching transistor 256 and may also include a storage capacitor (not shown). A first electrode 251 electrically connected to a source electrode or a drain electrode of the transistor 256 is provided over an insulating layer 239.

The liquid crystal element 250 provided in the pixel includes the first electrode 251 over the insulating layer 239, a second electrode 253 on the second substrate 202, and liquid crystal 252 sandwiched between the first electrode 251 and the second electrode 253.

The first electrode 251 and the second electrode 253 are formed using a light-transmitting conductive material. As the light-transmitting conductive material, a conductive oxide such as indium oxide, indium tin oxide, indium zinc oxide, zinc oxide, zinc oxide to which gallium is added, or graphene can be used.

A color filter 243 and a black matrix 242 are provided on the second substrate 202 in at least a region overlapping with the pixel portion 211.

The color filter 243 is provided in order to adjust the color of light transmitted through a pixel to increase the color purity. For example, in a full-color panel module using a white backlight, a plurality of pixels provided with color filters of different colors are used. In this case, the color filters may be those of three colors of red (R), green (G), and blue (B) or four colors (yellow (Y) in addition to these three colors). Further, a white (W) pixel may be added to R, G, and B pixels (and a Y pixel). That is, color filters of four colors (or five colors) may be used.

The black matrix 242 is provided between the adjacent color filters 243. The black matrix 242 blocks light entering from adjacent pixels, thereby preventing color mixture between the adjacent pixels. The black matrix 242 may be provided only between adjacent pixels of different emission colors and not between pixels of the same emission color. When the color filter 243 is provided so that its end portion overlaps with the black matrix 242, light leakage can be reduced. The black matrix 242 can be formed using a material that blocks light transmitted through the pixel, for example, a metal material or a resin material including a pigment.

An overcoat 255 is provided to cover the color filter 243 and the black matrix 242. The overcoat 255 can suppress diffusion of impurities included in the color filter 243 and the black matrix 242, such as a pigment, into the liquid crystal 252. For the overcoat 255, a light-transmitting material is used, and an inorganic insulating material or an organic insulating material can be used.

The second electrode 253 is provided over the overcoat 255.

A spacer 254 is provided in a region where the overcoat 255 overlaps with the black matrix 242. The spacer 254 is preferably formed using a resin material because it can be formed thick. For example, the spacer 254 can be formed using a positive or negative photosensitive resin. When a light-blocking material is used for the spacer 254, the spacer 254 blocks light entering from adjacent pixels, thereby preventing color mixture between the adjacent pixels. Although the spacer 254 is provided on the second substrate 202 side in this structure example, the spacer 254 may be provided on the first substrate 201 side. Alternatively, for the spacer 254, spherical particles of silicon oxide or the like may be used and scattered in a region where the liquid crystal 252 is provided.

An image can be displayed in such a manner that by application of voltage between the first electrode 251 and the second electrode 253, an electric field is generated in a direction vertical to surfaces of the electrodes and controls orientation of the liquid crystal 252, and polarization of light from a backlight provided outside the panel module is controlled in each pixel.

An alignment film for controlling orientation of the liquid crystal 252 may be provided on a surface in contact with the liquid crystal 252. A light-transmitting material is used for the alignment film.

In this structure example, the color filter is provided in a region overlapping with the liquid crystal element 250, so that a full-color image with higher color purity can be displayed. With the use of a plurality of light-emitting diodes (LEDs) that emit light of different colors as a backlight, a time-division display method (a field sequential driving method) can be employed. In the case of employing a time-division display method, the aperture ratio of the pixel or the number of pixels per unit area can be increased because neither color filters nor subpixels from which light of red (R), green (G), or blue (B), for example, is obtained are needed.

As the liquid crystal 252, a thermotropic liquid crystal, a low molecular weight liquid crystal, a polymer liquid crystal, a ferroelectric liquid crystal, an anti-ferroelectric liquid crystal, or the like can be used. Moreover, a liquid crystal exhibiting a blue phase is preferably used because an alignment film is not necessary and the viewing angle is wide. It is possible to use a polymer stabilized liquid crystal material obtained by adding a monomer and a polymerization initiator to any of the above liquid crystals and polymerizing the monomer after injection or dropping and sealing.

Although the liquid crystal element 250 in VA mode is described in this structure example, the liquid crystal element 250 is not limited to having this structure and can employ a different mode.

The first substrate 201 is provided with an insulating layer 237 in contact with an upper surface of the first substrate 201, an insulating layer 238 functioning as a gate insulating layer of the transistors, and an insulating layer 239 covering the transistors.

The insulating layer 237 is provided in order to prevent diffusion of impurities included in the first substrate 201. The insulating layers 238 and 239, which are in contact with semiconductor layers of the transistors, are preferably formed using a material preventing diffusion of impurities that promote degradation of the transistors. For these insulating layers, oxide, nitride, or oxynitride of a semiconductor such as silicon or a metal such as aluminum can be used, for example. Alternatively, a stack of such inorganic insulating materials or a stack of such an inorganic insulating material and an organic insulating material may be used. Note that the insulating layers 237 and 239 are not necessarily provided when not needed.

An insulating layer may be provided between the insulating layer 239 and the first electrode 251 as a planarization layer that covers steps due to a transistor, a wiring, or the like placed below the insulating layer 239. For such an insulating layer, a resin material such as polyimide or acrylic is preferably used. An inorganic insulating material may be used as long as high planarity is obtained.

With the structure illustrated in FIG. 13B, the number of photomasks necessary for forming the transistor and the first electrode 251 of the liquid crystal element 250 over the first substrate 201 can be reduced. Specifically, only five photomasks are necessary for the following respective steps: a step of processing a gate electrode, a step of processing a semiconductor layer, a step of processing source and drain electrodes, a step of forming an opening in the insulating layer 239, and a step of processing the first electrode 251.

A wiring 206 over the first substrate 201 is provided to extend to the outside of the region sealed with the sealant 203 and is electrically connected to the gate driver circuit 213. Part of an end portion of the wiring 206 is included in the external connection electrode 205. In this structure example, the external connection electrode 205 is formed by a stack of a conductive film used for the source and drain electrodes of the transistor and a conductive film used for the gate electrode of the transistor. The external connection electrode 205 is preferably formed by a stack of a plurality of conductive films as described above because mechanical strength against a pressure bonding step performed on the FPC 204 or the like can be increased.

Although not illustrated, a wiring and an external connection electrode that electrically connect the IC 212 and the pixel portion 211 can have the same structures as the wiring 206 and the external connection electrode 205.

A connection layer 208 is provided in contact with the external connection electrode 205. The FPC 204 and the external connection electrode 205 are electrically connected to each other through the connection layer 208. For the connection layer 208, a known anisotropic conductive film, a known anisotropic conductive paste, or the like can be used.

The end portions of the wiring 206 and the external connection electrode 205 are preferably covered with an insulating layer so that surfaces thereof are not exposed because oxidation of the surfaces and defects such as undesired short circuits can be suppressed.

This embodiment can be combined with any of the other embodiments disclosed in this specification as appropriate.

Embodiment 7

The panel module in Embodiment 6 provided with a touch sensor (contact detector) can function as a touch panel. In this embodiment, a touch panel will be described with reference to FIGS. 14A and 14B and FIG. 15. Hereinafter, the description of the same portions as the above embodiments is omitted in some cases.

Figure 14A:
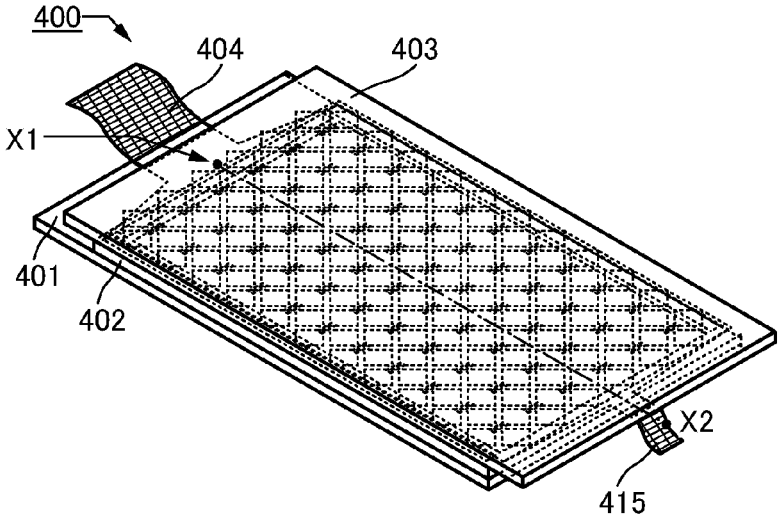
FIGS. 14A and 14B illustrate a touch panel.
Figure 14B:
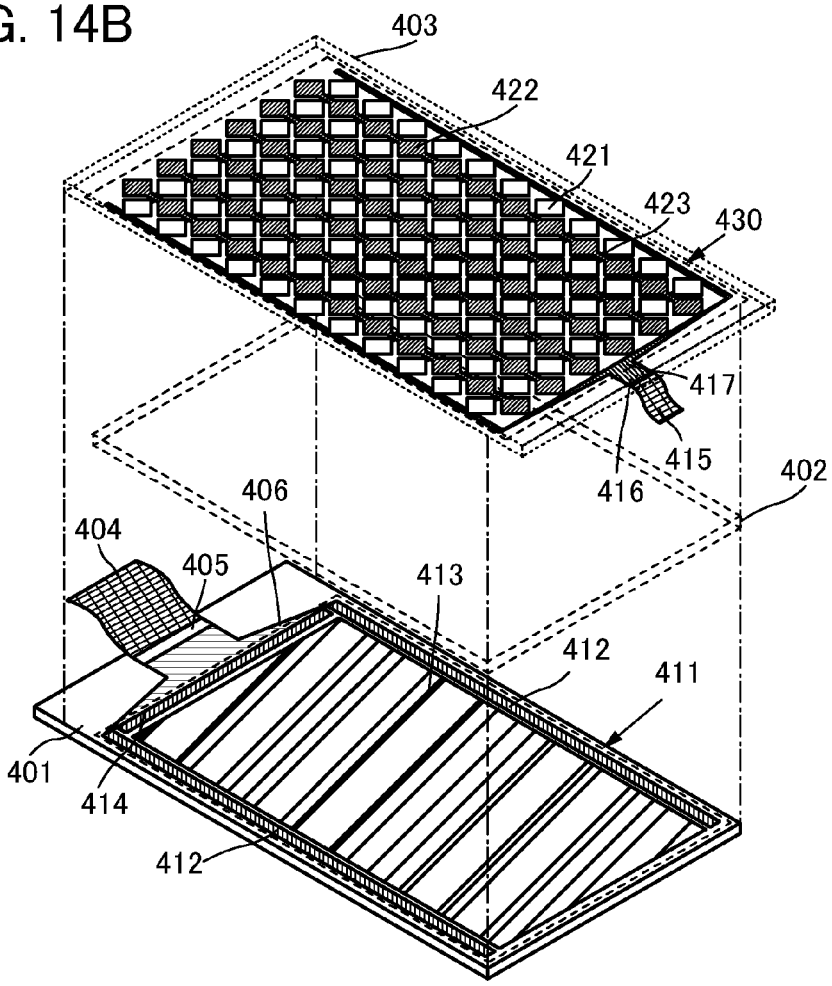

FIG. 14A is a perspective schematic diagram of a touch panel 400 shown in this embodiment. Note that FIGS. 14A and 14B illustrate only major components for simplicity. FIG. 14B is a perspective schematic diagram of the dismantled touch panel 400.

The touch panel 400 includes a display portion 411 sandwiched between a first substrate 401 and a second substrate 402, and a touch sensor 430 sandwiched between the second substrate 402 and a third substrate 403.

The first substrate 401 is provided with the display portion 411 and a plurality of wirings 406 electrically connected to the display portion 411. The plurality of wirings 406 are led to the outer edge portion of the first substrate 401, and part of the wirings 406 forms part of an external connection electrode 405 electrically connected to an FPC 404.

The display portion 411 includes a pixel portion 413 including a plurality of pixels, a gate driver circuit 412, and a source driver circuit 414 and is sealed between the first substrate 401 and the second substrate 402. Although FIG. 14B illustrates a structure in which two gate driver circuits 412 are positioned on both sides of the pixel portion 413, one gate driver circuit 412 may be positioned along one side of the pixel portion 413.

As a display element that can be used in the pixel portion 413 of the display portion 411, any of a variety of display elements such as an organic EL element, a liquid crystal element, and a display element performing display with electrophoresis, electronic liquid powder, or the like can be used. In this embodiment, a liquid crystal element is used as the display element.

The third substrate 403 is provided with the touch sensor 430 and a plurality of wirings 417 electrically connected to the touch sensor 430. The touch sensor 430 is provided on a surface of the third substrate 403 facing the second substrate 402. The plurality of wirings 417 are led to the outer edge portion of the third substrate 403, and part of the wirings 417 forms part of an external connection electrode 416 electrically connected to an FPC 415. Note that in FIG. 14B, electrodes, wirings, and the like of the touch sensor 430 that are provided on the back side of the third substrate 403 (the side facing the second substrate 402) are shown by solid lines for clarity.

The touch sensor 430 illustrated in FIG. 14B is an example of a projected capacitive touch sensor. The touch sensor 430 includes an electrode 421 and an electrode 422. Each of the electrodes 421 and 422 is electrically connected to any one of the plurality of wirings 417.

Here, the electrode 422 is in the form of a series of quadrangles arranged in one direction as illustrated in FIGS. 14A and 14B. Each of the electrodes 421 is in the form of a quadrangle. The plurality of electrodes 421 arranged in a line in a direction intersecting with the direction of extension of the electrode 422 are electrically connected to each other by a wiring 423. The electrode 422 and the wiring 423 are preferably arranged so that the area of the intersections of the electrode 422 and the wiring 423 is as small as possible. Such shapes of the electrodes can reduce the area of a region where the electrodes are not provided and decrease luminance unevenness of light passing through the touch sensor 430 due to a difference in transmittance depending on existence of the electrodes.

Note that the shapes of the electrodes 421 and the electrode 422 are not limited to the above and can be a variety of shapes. For example, it is possible that a plurality of electrodes 421 are arranged so that the gaps therebetween are reduced as much as possible, and a plurality of electrodes 422 are provided over the electrodes 421 with an insulating layer therebetween to be spaced apart from each other and have regions not overlapping with the electrodes 421. In this case, it is preferable to provide, between two adjacent electrodes 422, a dummy electrode electrically insulated from these electrodes because the area of regions having different transmittances can be reduced.

Figure 15:
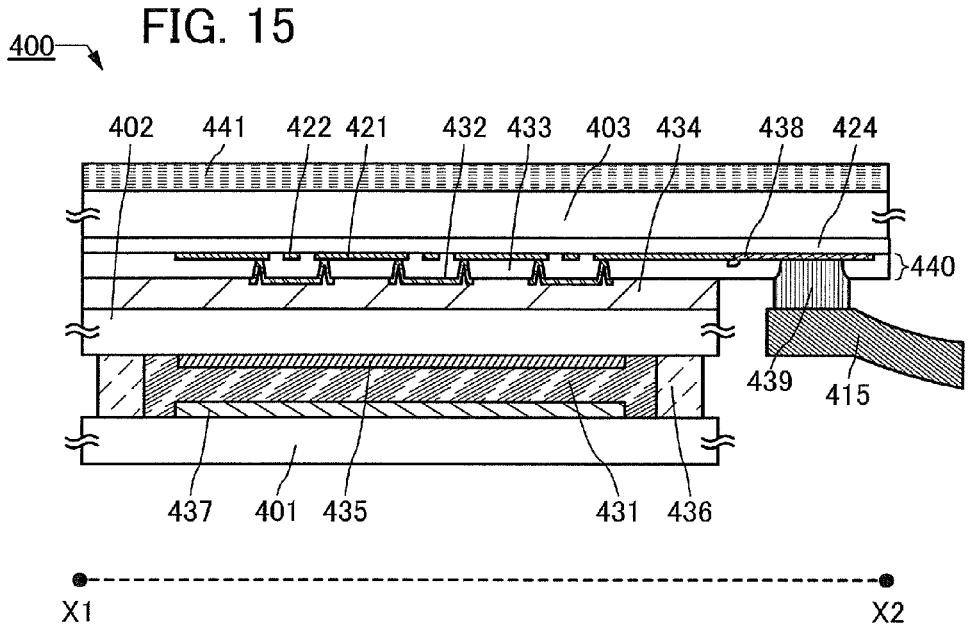
FIG. 15 illustrates a touch panel.

FIG. 15 is a cross-sectional view of the touch panel 400 along X1-X2 in FIG. 14A. Note that some of the components of the panel module are not shown in FIG. 15.

A switching element layer 437 is provided over the first substrate 401. The switching element layer 437 includes at least a transistor. The switching element layer 437 may also include a capacitor or the like in addition to the transistor. Further, the switching element layer 437 may include a driver circuit (a gate driver circuit, a source driver circuit), a wiring, an electrode, and/or the like.

A color filter layer 435 is provided on one surface of the second substrate 402. The color filter layer 435 includes a color filter that overlaps with the liquid crystal element. When the color filter layer 435 includes color filters of three colors of red (R), green (G), and blue (B), a full-color liquid crystal display device is obtained.

For example, the color filter layer 435 is formed using a photosensitive material including a pigment by a photolithography process. In the color filter layer 435, a black matrix may be provided between color filters of different colors. Further, an overcoat that covers the color filters and the black matrix may be provided.

Note that one of electrodes of the liquid crystal element may be formed on the color filter layer 435 depending on the structure of the liquid crystal element. Note that the electrode serves as part of the liquid crystal element to be formed later. An alignment film may be provided on the electrode.

Liquid crystal 431 sandwiched between the first substrate 401 and the second substrate 402 is sealed by a sealant 436. The sealant 436 is provided to surround the switching element layer 437 and the color filter layer 435.

For the sealant 436, a thermosetting resin or an ultraviolet curable resin can be used, and an organic resin such as an acrylic resin, a urethane resin, an epoxy resin, or a resin having a siloxane bond can be used. The sealant 436 may be formed using glass frit including low-melting-point glass. Alternatively, the sealant 436 may be formed with a combination of any of the above organic resins and glass frit. For example, the organic resin may be provided in contact with the liquid crystal 431 and glass frit may be provided on the outer surface of the organic resin, in which case water or the like can be prevented from being mixed into the liquid crystal from the outside.

The touch sensor is provided over the second substrate 402. In the touch sensor, a sensor layer 440 is provided on one surface of the third substrate 403 with an insulating layer 424 placed therebetween and is bonded to the second substrate 402 with a bonding layer 434. A polarizing plate 441 is provided on the other surface of the third substrate 403.

The touch sensor can be provided over the panel module in such a manner that the sensor layer 440 is formed over the third substrate 403 and then attached to the second substrate 402 with the bonding layer 434 provided over the sensor layer 440.

The insulating layer 424 can be formed using oxide such as silicon oxide, for example. The light-transmitting electrodes 421 and 422 are provided in contact with the insulating layer 424. The electrodes 421 and 422 are formed in such a manner that a conductive film is formed by sputtering over the insulating layer 424 formed over the third substrate 403 and then unnecessary portions of the conductive film are removed by a known patterning technique such as photolithography. As a light-transmitting conductive material, conductive oxide such as indium oxide, indium tin oxide, indium zinc oxide, zinc oxide, or zinc oxide to which gallium is added can be used.

A wiring 438 is electrically connected to the electrode 421 or the electrode 422. Part of the wiring 438 serves as an external connection electrode electrically connected to the FPC 415. The wiring 438 can be formed using a metal material such as aluminum, gold, platinum, silver, nickel, titanium, tungsten, chromium, molybdenum, iron, cobalt, copper, or palladium or an alloy material containing any of these metal materials.

The electrodes 422 are provided in the form of stripes extending in one direction. The electrodes 421 are arranged so that one electrode 422 is placed between a pair of electrodes 421. A wiring 432 that electrically connects the electrodes 421 is provided to cross the electrode 422. Here, one electrode 422 and a plurality of electrodes 421 electrically connected to each other by the wiring 432 do not necessarily cross orthogonally and may form an angle of less than 90°.

An insulating layer 433 is provided to cover the electrodes 421 and 422. Examples of a material for the insulating layer 433 are a resin such as an acrylic resin, an epoxy resin, and a resin having a siloxane bond and an inorganic insulating material such as silicon oxide, silicon oxynitride, and aluminum oxide. An opening reaching the electrode 421 is formed in the insulating layer 433, and the wiring 432, which is electrically connected to the electrode 421, is provided in the opening. The wiring 432 is preferably formed using a light-transmitting conductive material similar to that of the electrodes 421 and 422, in which case the aperture ratio of the touch panel can be increased. Although the wiring 432 may be formed using the same material as the electrodes 421 and 422, it is preferably formed using a material having higher conductivity than the material of the electrodes 421 and 422.

An insulating layer that covers the insulating layer 433 and the wiring 432 may be provided. The insulating layer can function as a protection layer.

An opening reaching the wiring 438 is formed in the insulating layer 433 (and the insulating layer serving as the protection layer), and the FPC 415 and the wiring 438 are electrically connected to each other with a connection layer 439 provided in the opening. For the connection layer 439, a known anisotropic conductive film (ACF), a known anisotropic conductive paste (ACP), or the like can be used.

The bonding layer 434 for bonding the sensor layer 440 and the second substrate 402 preferably has light-transmitting properties. For example, a thermosetting resin or an ultraviolet curable resin can be used, and specifically an acrylic resin, a urethane resin, an epoxy resin, a resin having a siloxane bond, or the like can be used.

The polarizing plate 441 is a known polarizing plate and is formed using a material capable of producing linearly polarized light from natural light or circularly polarized light. For example, a material whose optical anisotropy is obtained by disposing dichroic substances in one direction can be used. The polarizing plate 441 can be formed, for example, in such a manner that an iodine-based compound or the like is adsorbed to a film of polyvinyl alcohol or the like and the film is stretched in one direction. As the dichroic substance, a dye-based compound or the like as well as an iodine-based compound is used. A film-like, sheet-like, or plate-like material can be used for the polarizing plate 441.

Although this embodiment shows the example where a projected capacitive touch sensor is used for the sensor layer 440, the sensor layer 440 is not limited to this, and it is possible to use a sensor functioning as a touch sensor that senses proximity or touch of a conductive object to be sensed, such as a finger, on the outer side of the polarizing plate. As the touch sensor provided in the sensor layer 440, a capacitive touch sensor is preferably used. Examples of a capacitive touch sensor are a surface capacitive touch sensor and a projected capacitive touch sensor. Examples of a projected capacitive touch sensor are a self capacitive touch sensor and a mutual capacitive touch sensor, which differ mainly in the driving method. The use of a mutual capacitive touch sensor is preferable because multiple points can be sensed simultaneously.

In the touch panel described in this embodiment, the frame frequency of a still image can be reduced, so that a user can see the same image as long as possible, and screen flickers perceived by the user are reduced. In addition, high-resolution display can be performed with smaller-size pixels, whereby a precise and smooth image can be displayed. Further, degradation of image quality due to change in gray level can be reduced and power consumed by the touch panel can be reduced during still image display.

Embodiment 8

In Embodiment 8, examples of the structure of a transistor that can be used in a pixel of a display device will be described with reference to drawings.

<Structure Example of Transistor>

Figure 16A:
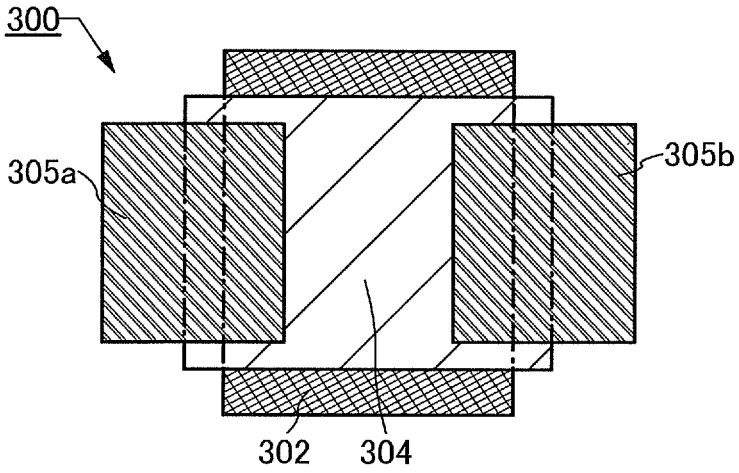
FIGS. 16A and 16B illustrate an example of the structure of a transistor.
Figure 16B:
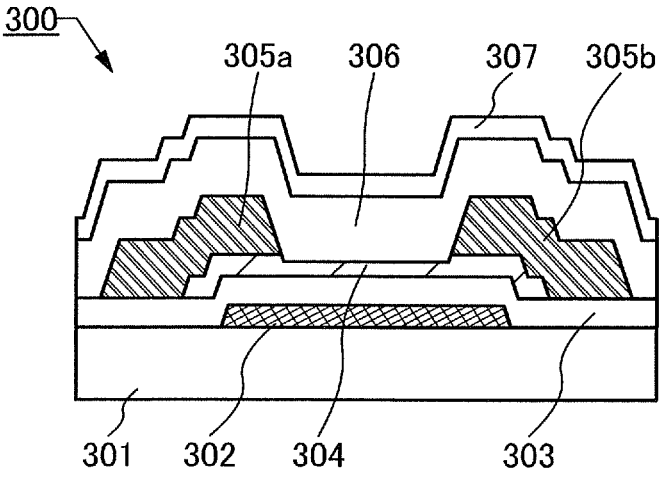

FIG. 16A is a top schematic diagram of a transistor 300 described below. FIG. 16B is a cross-sectional schematic diagram of the transistor 300 along line A-B in FIG. 16A. The transistor 300 exemplified by this structure example is a bottom-gate transistor.

The transistor 300 includes a gate electrode 302 over a substrate 301, an insulating layer 303 over the substrate 301 and the gate electrode 302, an oxide semiconductor layer 304 placed over the insulating layer 303 to overlap with the gate electrode 302, and a pair of electrodes 305*a* and 305*b* in contact with the top surface of the oxide semiconductor layer 304. An insulating layer 306 covers the insulating layer 303, the oxide semiconductor layer 304, and the pair of electrodes 305*a* and 305*b*. An insulating layer 307 is placed over the insulating layer 306.

<<Substrate 301>>

There is no particular limitation on the properties of a material and the like of the substrate 301 as long as the material has heat resistance high enough to withstand at least heat treatment performed later. For example, a glass substrate, a ceramic substrate, a quartz substrate, a sapphire substrate, or an yttria-stabilized zirconia (YSZ) substrate may be used as the substrate 301. Alternatively, a single crystal semiconductor substrate or a polycrystalline semiconductor substrate made of silicon, silicon carbide, or the like, a compound semiconductor substrate made of silicon germanium or the like, an SOI substrate, or the like can be used as the substrate 301. Still alternatively, any of these substrates provided with a semiconductor element may be used as the substrate 301.

A flexible substrate such as a plastic substrate may be used as the substrate 301, and the transistor 300 may be provided directly on the flexible substrate. Alternatively, a separation layer may be provided between the substrate 301 and the transistor 300. The separation layer can be used when part or the whole of the transistor formed over the separation layer is formed and separated from the substrate 301 and transferred to another substrate. Thus, the transistor 300 can be transferred to a substrate having low heat resistance or a flexible substrate.

<<Gate Electrode 302>>

The gate electrode 302 can be formed using a metal selected from aluminum, chromium, copper, tantalum, titanium, molybdenum, and tungsten; an alloy containing any of these metals as a component; an alloy containing any of these metals in combination; or the like. Further, one or both of manganese and zirconium may be used. The gate electrode 302 may have a single-layer structure or a stacked structure of two or more layers. For example, the gate electrode 302 can have a single-layer structure of an aluminum film containing silicon, a two-layer structure in which a titanium film is stacked over an aluminum film, a two-layer structure in which a titanium film is stacked over a titanium nitride film, a two-layer structure in which a tungsten film is stacked over a titanium nitride film, a two-layer structure in which a tungsten film is stacked over a tantalum nitride film or a tungsten nitride film, a three-layer structure in which a titanium film, an aluminum film, and a titanium film are stacked in this order, or the like. Alternatively, an alloy film or a nitride film that contains aluminum and one or more metals selected from titanium, tantalum, tungsten, molybdenum, chromium, neodymium, and scandium may be used.

The gate electrode 302 can also be formed using a light-transmitting conductive material such as indium tin oxide, indium oxide containing tungsten oxide, indium zinc oxide containing tungsten oxide, indium oxide containing titanium oxide, indium tin oxide containing titanium oxide, indium zinc oxide, or indium tin oxide to which silicon oxide is added. The gate electrode 302 can have a stacked structure using the above light-transmitting conductive material and the above metal.

Further, an In—Ga—Zn-based oxynitride semiconductor film, an In—Sn-based oxynitride semiconductor film, an In—Ga-based oxynitride semiconductor film, an In—Zn-based oxynitride semiconductor film, a Sn-based oxynitride semiconductor film, an In-based oxynitride semiconductor film, a film of metal nitride (such as InN or ZnN), or the like may be provided between the gate electrode 302 and the insulating layer 303. These films each have a work function of 5 eV or higher, preferably 5.5 eV or higher, which is higher than the electron affinity of an oxide semiconductor; thus, the threshold voltage of a transistor including the oxide semiconductor can be shifted in the positive direction. Accordingly, a switching element having what is called normally-off characteristics is obtained. For example, in the case of using an In—Ga—Zn-based oxynitride semiconductor film, an In—Ga—Zn-based oxynitride semiconductor film having a higher nitrogen concentration than at least the oxide semiconductor layer 304, specifically, an In—Ga—Zn-based oxynitride semiconductor film having a nitrogen concentration of 7 atomic % or higher is used.

<<Insulating Film 303>>

The insulating layer 303 functions as a gate insulating film. The insulating layer 303 in contact with the bottom surface of the oxide semiconductor layer 304 is preferably an amorphous film.

The insulating layer 303 has a single-layer structure or a stacked structure using silicon oxide, silicon oxynitride, silicon nitride oxide, silicon nitride, aluminum oxide, hafnium oxide, gallium oxide, or Ga—Zn-based metal oxide, for example.

The insulating layer 303 may be formed using a high-k material such as hafnium silicate ($HfSiO_x$), hafnium silicate to which nitrogen is added ($HfSi_xO_yN_z$), hafnium aluminate to which nitrogen is added ($HfAl_xO_yN_z$), hafnium oxide, or yttrium oxide, in which case gate leakage current of the transistor can be reduced.

<<Pair of Electrodes 305*a* and 305*b*>>

The pair of electrodes 305*a* and 305*b* functions as a source electrode and a drain electrode of the transistor.

The pair of electrodes 305*a* and 305*b* can be formed to have a single-layer structure or a stacked structure using, as a conductive material, any of metals such as aluminum, titanium, chromium, nickel, copper, yttrium, zirconium, molybdenum, silver, tantalum, and tungsten or an alloy containing any of these metals as its main component. For example, the pair of electrodes 305*a* and 305*b* can have a single-layer structure of an aluminum film containing silicon; a two-layer structure in which a titanium film is stacked over an aluminum film; a two-layer structure in which a titanium film is stacked over a tungsten film; a two-layer structure in which a copper film is formed over a copper-magnesium-aluminum alloy film; a three-layer structure in which a titanium film or a titanium nitride film, an aluminum film or a copper film, and a titanium film or a titanium nitride film are stacked in this order; or a three-layer structure in which a molybdenum film or a molybdenum nitride film, an aluminum film or a copper film, and a molybdenum film or a molybdenum nitride film are stacked in this order. Note that a transparent conductive material containing indium oxide, tin oxide, or zinc oxide may be used.

<<Insulating Layers 306 and 307>>

The insulating layer 306 is preferably an oxide insulating film containing oxygen at a higher proportion than oxygen in the stoichiometric composition. Part of oxygen is released by heating from the oxide insulating film containing oxygen at a higher proportion than oxygen in the stoichiometric composition. The oxide insulating film containing oxygen at a higher proportion than oxygen in the stoichiometric composition is an oxide insulating film in which the amount of released oxygen converted into oxygen atoms is $1.0\times10^{18}$ atoms/cm$^3$ or more, preferably $3.0\times10^{20}$ atoms/cm$^3$ or more in thermal desorption spectroscopy (TDS) analysis.

As the insulating layer 306, a silicon oxide film, a silicon oxynitride film, or the like can be used.

Note that the insulating layer 306 also functions as a film that relieves damage to the oxide semiconductor layer 304 at the time of forming the insulating layer 307 later.

Moreover, an oxide film transmitting oxygen may be provided between the insulating layer 306 and the oxide semiconductor layer 304.

As the oxide film transmitting oxygen, a silicon oxide film, a silicon oxynitride film, or the like can be used. Note that in this specification, a silicon oxynitride film refers to a film that includes more oxygen than nitrogen, and a silicon nitride oxide film refers to a film that includes more nitrogen than oxygen.

The insulating layer 307 can be an insulating film having a blocking effect against oxygen, hydrogen, water, and the like. Providing the insulating layer 307 over the insulating layer 306 can prevent outward diffusion of oxygen from the oxide semiconductor layer 304 and entry of hydrogen, water, or the like into the oxide semiconductor layer 304 from the outside. Examples of the insulating film having a blocking effect against oxygen, hydrogen, water, and the like are a silicon nitride film, a silicon nitride oxide film, an aluminum oxide film, an aluminum oxynitride film, a gallium oxide film, a gallium oxynitride film, an yttrium oxide film, an yttrium oxynitride film, a hafnium oxide film, and a hafnium oxynitride film.

<Example of Method of Fabricating Transistor>

Next, an example of a method of fabricating the transistor 300 in FIGS. 16A to 16B will be described.

Figure 17A:
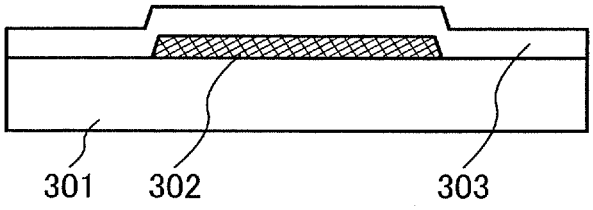
FIGS. 17A to 17D illustrate an example of a method of fabricating a transistor.

First, as illustrated in FIG. 17A, the gate electrode 302 is formed over the substrate 301, and the insulating layer 303 is formed over the gate electrode 302.

Here, a glass substrate is used as the substrate 301.

<<Formation of Gate Electrode>>

A method of forming the gate electrode 302 is described below. First, a conductive film is formed by sputtering, CVD, evaporation, or the like and then a resist mask is formed over the conductive film using a first photomask by a photolithography process. Next, part of the conductive film is etched using the resist mask to form the gate electrode 302. After that, the resist mask is removed.

Note that the gate electrode 302 may be formed by electrolytic plating, printing, inkjet, or the like instead of the above formation method.

<<Formation of Gate Insulating Layer>>

The insulating layer 303 is formed by sputtering, CVD, evaporation, or the like.

When a silicon oxide film, a silicon oxynitride film, or a silicon nitride oxide film is formed as the insulating layer 303, a deposition gas containing silicon and an oxidizing gas are preferably used as a source gas. Typical examples of the deposition gas containing silicon include silane, disilane, trisilane, and silane fluoride. Examples of the oxidizing gas include oxygen, ozone, dinitrogen monoxide, and nitrogen dioxide.

When a silicon nitride film is formed as the insulating layer 303, it is preferable to use a two-step formation method. First, a first silicon nitride film with few defects is formed by plasma CVD using a mixed gas of silane, nitrogen, and ammonia as a source gas. Then, a second silicon nitride film that has low hydrogen concentration and can block hydrogen is formed by switching the source gas to a mixed gas of silane and nitrogen. With such a formation method, a silicon nitride film having few defects and a blocking property against hydrogen can be formed as the gate insulating layer 303.

When a gallium oxide film is formed as the insulating layer 303, metal organic chemical vapor deposition (MOCVD) can be employed.

<<Formation of Oxide Semiconductor Layer>>

Figure 17B:
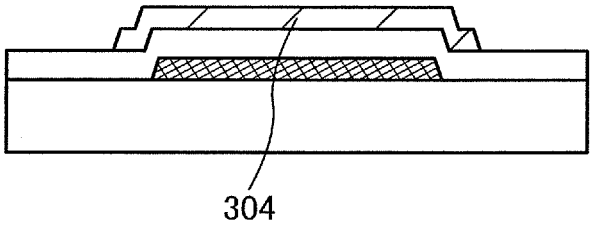

Next, as illustrated in FIG. 17B, the oxide semiconductor layer 304 is formed over the insulating layer 303.

A method of forming the oxide semiconductor layer 304 is described below. First, an oxide semiconductor film is formed. Then, a resist mask is formed over the oxide semiconductor film using a second photomask by a photolithography process. Next, part of the oxide semiconductor film is etched using the resist mask to form the oxide semiconductor layer 304. After that, the resist mask is removed.

After that, heat treatment may be performed, in which case it is preferably conducted under an atmosphere containing oxygen.

<<Formation of Pair of Electrodes>>

Figure 17C:
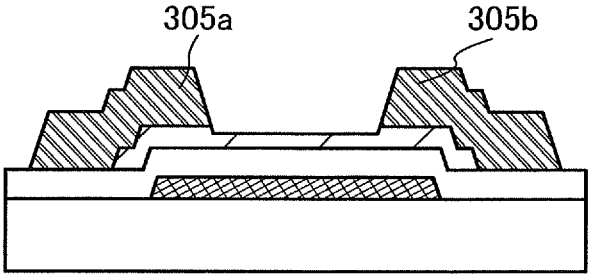

Next, as illustrated in FIG. 17C, the pair of electrodes 305*a* and 305*b* is formed.

A method of forming the pair of electrodes 305*a* and 305*b* is described below. First, a conductive film is formed by sputtering, CVD, evaporation, or the like. Next, a resist mask is formed over the conductive film using a third photomask by a photolithography process. Then, part of the conductive film is etched using the resist mask to form the pair of electrodes 305*a* and 305*b*. After that, the resist mask is removed.

Note that as illustrated in FIG. 17C, the upper part of the oxide semiconductor layer 304 is partly etched and thinned by the etching of the conductive film in some cases. For this reason, it is preferable to set the thickness of the oxide semiconductor film large in advance at the time of forming the oxide semiconductor layer 304.

<<Formation of Insulating Layers>>

Figure 17D:
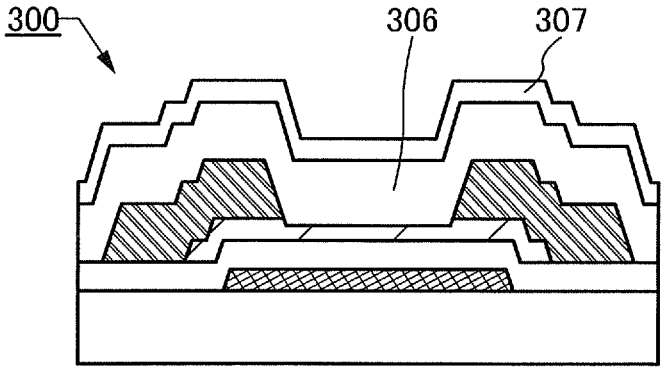

Next, as illustrated in FIG. 17D, the insulating layer 306 is formed over the oxide semiconductor layer 304 and the pair of electrodes 305*a* and 305*b*, and the insulating layer 307 is successively formed over the insulating layer 306.

When a silicon oxide film or a silicon oxynitride film is formed as the insulating layer 306, a deposition gas containing silicon and an oxidizing gas are preferably used as a source gas. Typical examples of the deposition gas containing silicon include silane, disilane, trisilane, and silane fluoride. Examples of the oxidizing gas include oxygen, ozone, dinitrogen monoxide, and nitrogen dioxide.

For example, a silicon oxide film or a silicon oxynitride film is formed under the following conditions: the substrate placed in an evacuated treatment chamber of a plasma CVD apparatus is held at a temperature ranging from 180° C. to 260° C., preferably from 200° C. to 240° C.; the pressure of the treatment chamber into which the source gas is introduced is set in the range from 100 Pa to 250 Pa, preferably from 100 Pa to 200 Pa; and an electrode provided in the treatment chamber is supplied with a high-frequency power ranging from 0.17 W/cm$^2$ to 0.5 W/cm$^2$, preferably from 0.25 W/cm$^2$ to 0.35 W/cm$^2$.

As the film formation conditions, the high-frequency power with the above power density is supplied to the treatment chamber having the above pressure, whereby the degradation efficiency of the source gas in plasma is increased, oxygen radicals are increased, and oxidation of the source gas is promoted; therefore, oxygen is contained in the oxide insulating film at a higher proportion than oxygen in the stoichiometric composition. However, when the substrate temperature is within the above temperature range, the bond between silicon and oxygen is weak, and accordingly, part of oxygen is released by heating. Thus, it is possible to form an oxide insulating film which contains oxygen at a higher proportion than the stoichiometric composition and from which part of oxygen is released by heating.

In the case where an oxide insulating film is provided between the oxide semiconductor layer 304 and the insulating layer 306, the oxide insulating film serves as a protection film of the oxide semiconductor layer 304 in the step of forming the insulating layer 306. Thus, the insulating layer 306 can be formed using the high-frequency power with high power density while damage to the oxide semiconductor layer 304 is reduced.

For example, a silicon oxide film or a silicon oxynitride film can be formed as the oxide insulating film under the following conditions: the substrate placed in an evacuated treatment chamber of the plasma CVD apparatus is held at a temperature ranging from 180° C. to 400° C., preferably from 200° C. to 370° C.; the pressure of the chamber into which the source gas is introduced is set in the range from 20 Pa to 250 Pa, preferably from 100 Pa to 250 Pa; and high-frequency power is supplied to the electrode provided in the treatment chamber. Setting the pressure in the treatment chamber in the range from 100 Pa to 250 Pa can reduce damage to the oxide semiconductor layer 304 at the time of forming the oxide insulating film.

A deposition gas containing silicon and an oxidizing gas are preferably used as a source gas of the oxide insulating film. Typical examples of the deposition gas containing silicon are silane, disilane, trisilane, and silane fluoride. Examples of the oxidizing gas are oxygen, ozone, dinitrogen monoxide, and nitrogen dioxide.

The insulating layer 307 can be formed by sputtering, CVD, or the like.

When a silicon nitride film or a silicon nitride oxide film is formed as the insulating layer 307, a deposition gas containing silicon, an oxidizing gas, and a gas containing nitrogen are preferably used as a source gas. Typical examples of the deposition gas containing silicon are silane, disilane, trisilane, and silane fluoride. Examples of the oxidizing gas are oxygen, ozone, dinitrogen monoxide, and nitrogen dioxide. Examples of the gas containing nitrogen are nitrogen and ammonia.

Through the above steps, the transistor 300 can be formed.

<Variations of Transistor 300>

Examples of the structure of a transistor that is partly different from the transistor 300 will be described below.

<<Variation 1>>

Figure 18A:
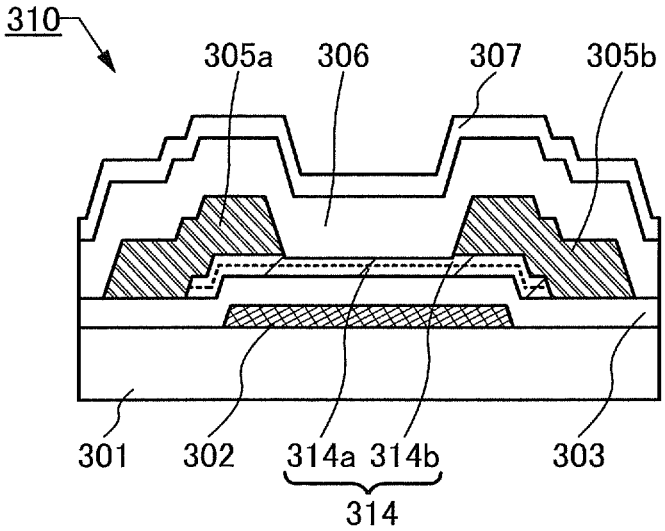
FIGS. 18A and 18B each illustrate an example of the structure of a transistor.

FIG. 18A is a cross-sectional schematic diagram of a transistor 310 described below. The transistor 310 differs from the transistor 300 in the structure of the oxide semiconductor layer. Consequently, the description of the transistor 300 can be referred to for the components other than the oxide semiconductor layer.

An oxide semiconductor layer 314 included in the transistor 310 is a stack of an oxide semiconductor layer 314*a* and an oxide semiconductor layer 314*b*.

Note that a boundary between the oxide semiconductor layer 314*a* and the oxide semiconductor layer 314*b* is shown by broken lines in FIG. 18A and the like because the boundary is not clear in some cases.

An oxide semiconductor film of one embodiment of the present invention can be used as at least one of the oxide semiconductor layers 314*a* and 314*b*.

Typical examples of a material of the oxide semiconductor layer 314*a* are In—Ga oxide, In—Zn oxide, and In-M-Zn oxide (M represents Al, Ti, Ga, Y, Zr, La, Ce, Nd, or Hf). When the oxide semiconductor layer 314*a* is In-M-Zn oxide, the atomic ratio of In to M is preferably as follows: the percentage of In is lower than 50 atomic % and the percentage of M is 50 atomic % or higher, and preferably the percentage of In is lower than 25 atomic % and the percentage of M is 75 atomic % or higher. In addition, the oxide semiconductor layer 314*a* is formed using a material having an energy gap of 2 eV or higher, preferably 2.5 eV or higher, more preferably 3 eV or higher, for example.

For example, the oxide semiconductor layer 314*b* contains In or Ga, and typically contains In—Ga oxide, In—Zn oxide, or In-M-Zn oxide (M represents Al, Ti, Ga, Y, Zr, La, Ce, Nd, or Hf). The energy at the conduction band bottom of the oxide semiconductor layer 314*b* is closer to a vacuum level than that of the oxide semiconductor layer 314*a*, and typically, the difference in the energy at the conduction band bottom between the oxide semiconductor layer 314*b* and the oxide semiconductor layer 314*a* is preferably 0.05 eV or more, 0.07 eV or more, 0.1 eV or more, or 0.15 eV or more and 2 eV or less, 1 eV or less, 0.5 eV or less, or 0.4 eV or less.

For example, when the oxide semiconductor layer 314*b* is In-M-Zn oxide, the atomic ratio of In to M is preferably as follows: the percentage of In is 25 atomic % or higher and the percentage of M is lower than 75 atomic %, and preferably the percentage of In is 34 atomic % or higher and the percentage of M is lower than 66 atomic %.

For example, for the oxide semiconductor layer 314*a*, In—Ga—Zn oxide with an atomic ratio of In:Ga:Zn=1:1:1 or 3:1:2 can be used. For the oxide semiconductor layer 314*b*, In—Ga—Zn oxide with an atomic ratio of In:Ga:Zn=1:3:2, 1:6:4, or 1:9:6 can be used. Note that the atomic ratio of each of the oxide semiconductor layers 314*a* and 314*b* may vary within a margin of ±20% of the corresponding atomic ratio.

The oxide with a high content of Ga serving as a stabilizer is used for the oxide semiconductor layer 314*b* placed over the oxide semiconductor layer 314*a*, thereby preventing release of oxygen from the oxide semiconductor layers 314*a* and 314*b*.

Note that without limitation to the materials given above, a material with an appropriate composition depending on intended semiconductor characteristics and electrical characteristics (e.g., field-effect mobility and threshold voltage) of a transistor can be used. In order to obtain intended semiconductor characteristics of the transistor, it is preferable to set appropriate carrier density, impurity concentration, defect density, atomic ratio of a metal element to oxygen, interatomic distance, density, and the like of the oxide semiconductor layers 314*a* and 314*b*.

Although the oxide semiconductor layer 314 is a stack of two oxide semiconductor layers in the above structure, it may be a stack of three or more oxide semiconductor layers.

<<Variation 2>>

Figure 18B:
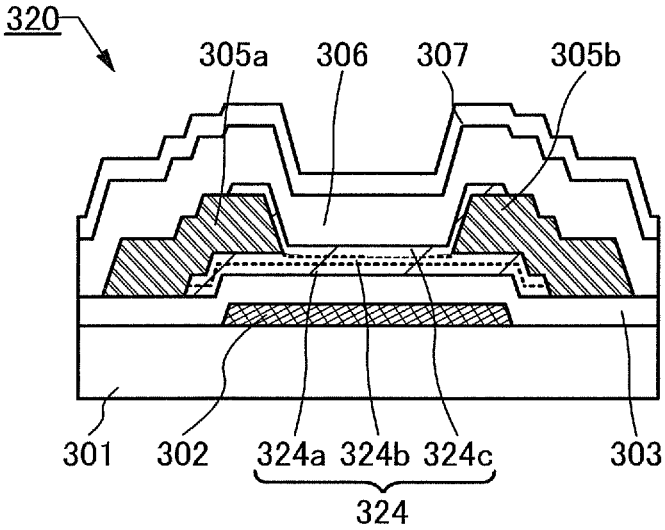

FIG. 18B is a cross-sectional schematic diagram of a transistor 320 described below. The transistor 320 differs from the transistors 300 and 310 in the structure of the oxide semiconductor layer. Consequently, the description of the transistor 300 can be referred to for the components other than the oxide semiconductor layer.

In an oxide semiconductor layer 324 included in the transistor 320, an oxide semiconductor layer 324*a*, an oxide semiconductor layer 324*b*, and an oxide semiconductor layer 324*c* are stacked in this order.

The oxide semiconductor layer 324*a* and the oxide semiconductor layer 324*b* are stacked over the insulating layer 303. The oxide semiconductor layer 324*c* is provided in contact with a top surface of the oxide semiconductor layer 324*b* and top and side surfaces of the pair of electrodes 305*a* and 305*b*.

The oxide semiconductor layer 324*b* can have a structure similar to that of the oxide semiconductor layer 314*a* shown in Variation 1, for example. Moreover, the oxide semiconductor layers 324*a* and 324*c* can have a structure similar to that of the oxide semiconductor layer 314*b* in Variation 1, for example.

For example, when an oxide with a high content of Ga serving as a stabilizer is used for the oxide semiconductor layer 324*a* placed below the oxide semiconductor layer 324*b* and the oxide semiconductor layer 324*c* placed over the oxide semiconductor layer 324*b*, oxygen can be prevented from being released from the oxide semiconductor layers 324*a* to 324*c*.

For example, in the case where a channel is formed mainly in the oxide semiconductor layer 324*b*, the on-state current of the transistor 320 can be increased when an oxide with a high content of In is used for the oxide semiconductor layer 324*b* and the pair of electrodes 305*a* and 305*b* is provided in contact with the oxide semiconductor layer 324*b*.

<Another Structure Example of Transistor>

An example of the structure of a top-gate transistor to which the oxide semiconductor film of one embodiment of the present invention can be applied will be described below.

Note that components having structures or functions similar to the above are denoted by the same reference numerals used above, and the description thereof is omitted below.

Structure Example

Figure 19A:
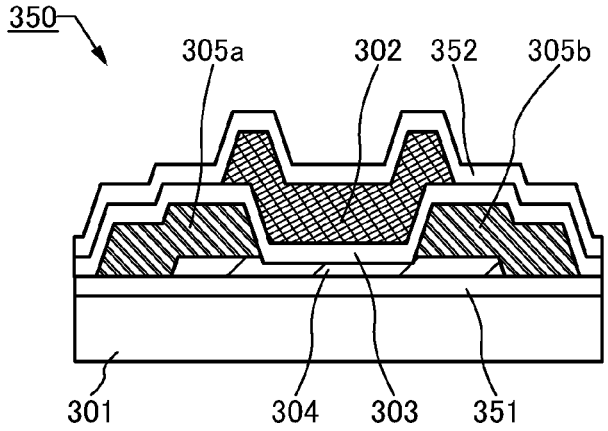
FIGS. 19A to 19C each illustrate an example of the structure of a transistor.

FIG. 19A is a cross-sectional schematic diagram of a top-gate transistor 350 described below.

The transistor 350 includes the oxide semiconductor layer 304 over the substrate 301 provided with an insulating layer 351, the pair of electrodes 305*a* and 305*b* in contact with the top surface of the oxide semiconductor layer 304, the insulating layer 303 over the oxide semiconductor layer 304 and the pair of electrodes 305*a* and 305*b*, and the gate electrode 302 placed over the insulating layer 303 to overlap with the oxide semiconductor layer 304. An insulating layer 352 is provided to cover the insulating layer 303 and the gate electrode 302.

The insulating layer 351 has a function of suppressing diffusion of impurities from the substrate 301 to the oxide semiconductor layer 304. For example, the insulating layer 351 can have a structure similar to that of the insulating layer 307. Note that the insulating layer 351 is not necessarily provided when not needed.

Like the insulating layer 307, the insulating layer 352 can be an insulating film having a blocking effect against oxygen, hydrogen, water, and the like. Note that the insulating layer 307 is not necessarily provided when not needed.

<Variations>

Examples of the structure of a transistor that is partly different from the transistor 350 will be described below.

Figure 19B:
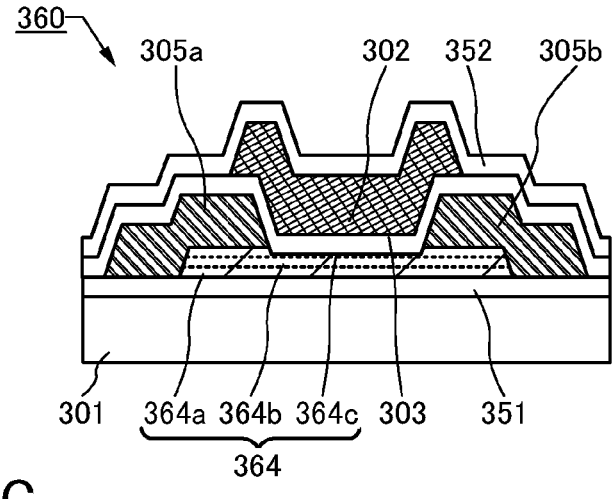

FIG. 19B is a cross-sectional schematic diagram of a transistor 360 described below. The transistor 360 differs from the transistor 350 in the structure of the oxide semiconductor layer.

In an oxide semiconductor layer 364 included in the transistor 360, an oxide semiconductor layer 364*a*, an oxide semiconductor layer 364*b*, and an oxide semiconductor layer 364*c* are stacked in this order.

The oxide semiconductor film of one embodiment of the present invention can be used as at least one of the oxide semiconductor layers 364*a* to 364*c*.

The oxide semiconductor layer 364*b* can have a structure similar to that of the oxide semiconductor layer 314*a* shown in Variation 1, for example. The oxide semiconductor layers 364*a* and 364*c* can have a structure similar to that of the oxide semiconductor layer 314*b* in Variation 1, for example.

For example, when an oxide with a high content of Ga serving as a stabilizer is used for the oxide semiconductor layer 364*a* placed below the oxide semiconductor layer 364*b* and the oxide semiconductor layer 364*c* placed over the oxide semiconductor layer 364*b*, oxygen can be prevented from being released from the oxide semiconductor layers 364*a* to 364*c*.

When the oxide semiconductor layer 364 is formed in such a manner that the oxide semiconductor layers 364*b* and 364*c* are processed by etching so that an oxide semiconductor film to be the oxide semiconductor layer 364*a* is exposed and then the oxide semiconductor film is processed by dry etching to form the oxide semiconductor layer 364*a*, reaction products of the oxide semiconductor film are reattached to side surfaces of the oxide semiconductor layers 364*b* and 364*c* to form sidewall protection layers (also called rabbit ears) in some cases. Note that the reaction products may be reattached due to a sputtering phenomenon or plasma in the dry etching.

Figure 19C:
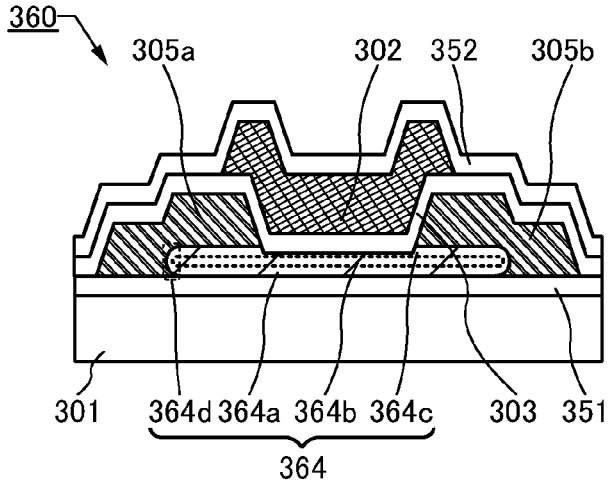

FIG. 19C is a cross-sectional schematic diagram of a transistor 370 in which a sidewall protection layer 364*d* is formed as a side surface of the oxide semiconductor layer 364 as described above.

The sidewall protection layer 364*d* mainly contains the same material as the oxide semiconductor layer 364*a*. Moreover, the sidewall protection layer 364*d* may contain a component (e.g., silicon) of a layer provided below the oxide semiconductor layer 364*a* (here, the insulating layer 351).

With a structure illustrated in FIG. 19C in which the side surface of the oxide semiconductor layer 364*b* is covered with the sidewall protection layer 364*d* so as not to be in contact with the pair of electrodes 305*a* and 305*b*, unintended off-state leakage current of a transistor is suppressed particularly when a channel is formed mainly in the oxide semiconductor layer 364*b*; thus, a transistor with excellent off-state characteristics is achieved. In addition, with the use of a material with a high content of Ga serving as a stabilizer for the sidewall protection layer 364*d*, release of oxygen from the side surface of the oxide semiconductor layer 364*b* can be effectively suppressed, and a transistor with stable electrical characteristics can be provided.

This embodiment can be combined with any of the other embodiments disclosed in this specification as appropriate.

Embodiment 9

Examples of a semiconductor and a semiconductor film that are preferably used for a channel formation region in the transistor exemplified in the above embodiment will be described below.

An oxide semiconductor has a wide energy gap of 3.0 eV or more. A transistor including an oxide semiconductor film obtained by processing of the oxide semiconductor in an appropriate condition and a sufficient reduction in carrier density of the oxide semiconductor can have much lower leakage current between a source and a drain in an off state (off-state current) than a conventional transistor including silicon.

When an oxide semiconductor film is used for the transistor, the thickness of the oxide semiconductor film ranges preferable from 2 nm to 40 nm.

An applicable oxide semiconductor preferably contains at least indium (In) or zinc (Zn). In particular, the oxide semiconductor preferably contains In and Zn. In addition, as a stabilizer for reducing variation in electrical characteristics of transistors using the oxide semiconductor, one or more elements selected from gallium (Ga), tin (Sn), hafnium (Hf), zirconium (Zr), titanium (Ti), scandium (Sc), yttrium (Y), and lanthanoid (such as cerium (Ce), neodymium (Nd), or gadolinium (Gd)) is preferably contained.

As the oxide semiconductor, any of the following can be used, for example: indium oxide, tin oxide, zinc oxide, In—Zn-based oxide, Sn—Zn-based oxide, Al—Zn-based oxide, Zn—Mg-based oxide, Sn—Mg-based oxide, In—Mg-based oxide, In—Ga-based oxide, In—Ga—Zn-based oxide (also referred to as IGZO), In—Al—Zn-based oxide, In—Sn—Zn-based oxide, Sn—Ga—Zn-based oxide, Al—Ga—Zn-based oxide, Sn—Al—Zn-based oxide, In—Hf—Zn-based oxide, In—Zr—Zn-based oxide, In—Ti—Zn-based oxide, In—Sc—Zn-based oxide, In—Y—Zn-based oxide, In—La—Zn-based oxide, In—Ce—Zn-based oxide, In—Pr—Zn-based oxide, In—Nd—Zn-based oxide, In—Sm—Zn-based oxide, In—Eu—Zn-based oxide, In—Gd—Zn-based oxide, In—Tb—Zn-based oxide, In—Dy—Zn-based oxide, In—Ho—Zn-based oxide, In—Er—Zn-based oxide, In—Tm—Zn-based oxide, In—Yb—Zn-based oxide, In—Lu—Zn-based oxide, In—Sn—Ga—Zn-based oxide, In—Hf—Ga—Zn-based oxide, In—Al—Ga—Zn-based oxide, In—Sn—Al—Zn-based oxide, In—Sn—Hf—Zn-based oxide, and In—Hf—Al—Zn-based oxide.

Here, an In—Ga—Zn-based oxide refers to an oxide containing In, Ga, and Zn as its main components and there is no particular limitation on the ratio of In, Ga, and Zn. The In—Ga—Zn-based oxide may contain a metal element other than In, Ga, and Zn.

Alternatively, a material represented by $InMO_3(ZnO)_m$ (m is larger than 0 and is not an integer) may be used as the oxide semiconductor. Note that M represents one or more metal elements selected from Ga, Fe, Mn, and Co, or any of the above-described elements as a stabilizer. Alternatively, as the oxide semiconductor, a material expressed by $In_2SnO_5(ZnO)_n$ (n is larger than 0 and is a natural number) may be used.

For example, it is possible to use an In—Ga—Zn-based oxide with an atomic ratio of In:Ga:Zn=1:1:1, In:Ga:Zn=1:3:2, In:Ga:Zn=3:1:2, or In:Ga:Zn=2:1:3, or an oxide whose atomic ratio is in the neighborhood of the above compositions.

If the oxide semiconductor film contains a large amount of hydrogen, the hydrogen and the oxide semiconductor are bonded to each other, so that part of the hydrogen serves as a donor and causes generation of an electron which is a carrier. As a result, the threshold voltage of the transistor shifts in the negative direction. Therefore, after formation of the oxide semiconductor film, dehydration treatment (dehydrogenation treatment) is preferably performed to remove hydrogen or moisture from the oxide semiconductor film so that the oxide semiconductor film is highly purified to contain impurities as little as possible.

Note that oxygen in the oxide semiconductor film is also reduced by the dehydration treatment (dehydrogenation treatment) in some cases. Accordingly, it is preferable that oxygen be added to the oxide semiconductor film to fill oxygen vacancies increased by the dehydration treatment (dehydrogenation treatment). In this specification and the like, supplying oxygen to an oxide semiconductor film may be expressed as oxygen adding treatment, and making the oxygen content of an oxide semiconductor film in excess of that in the stoichiometric composition may be expressed as treatment for making an oxygen-excess state.

In this manner, hydrogen or moisture is removed from the oxide semiconductor film by the dehydration treatment (dehydrogenation treatment) and oxygen vacancies therein are repaired by the oxygen adding treatment, so that the oxide semiconductor film can be an i-type (intrinsic) oxide semiconductor film or a substantially i-type (intrinsic) oxide semiconductor film which is extremely close to an i-type oxide semiconductor film. Note that "substantially intrinsic" means that the oxide semiconductor film includes extremely few (close to zero) carriers derived from a donor and has a carrier density of $1\times10^{17}/cm^3$ or lower, $1\times10^{16}/cm^3$ or lower, $1\times10^{15}/cm^3$ or lower, $1\times10^{14}/cm^3$ or lower, or $1\times10^{13}/cm^3$ or lower.

Thus, the transistor including an i-type or substantially i-type oxide semiconductor film can have excellent off-state current characteristics. For example, the drain current of the transistor including an oxide semiconductor film in an off state can be $1\times10^{-18}$ A or less, preferably $1\times10^{-21}$ A or less, more preferably $1\times10^{-24}$ A or less at room temperature (about 25° C.) or $1\times10^{-15}$ A or less, preferably $1\times10^{-18}$ A or less, more preferably $1\times10^{-21}$ A or less at 85° C. Note that the off state of an n-channel transistor refers to a state where the gate voltage is sufficiently lower than the threshold voltage. Specifically, the transistor is in an off state when the gate voltage is lower than the threshold voltage by 1 V or more, 2 V or more, or 3 V or more.

A structure of an oxide semiconductor film will be described below.

An oxide semiconductor film is classified roughly into a single-crystal oxide semiconductor film and a non-single-crystal oxide semiconductor film. The non-single-crystal oxide semiconductor film includes any of a c-axis aligned crystalline oxide semiconductor (CAAC-OS) film, a polycrystalline oxide semiconductor film, a microcrystalline oxide semiconductor film, an amorphous oxide semiconductor film, and the like.

First, a CAAC-OS film will be described.

The CAAC-OS film is one of oxide semiconductor films having a plurality of c-axis aligned crystal parts.

In a transmission electron microscope (TEM) image of the CAAC-OS film, a boundary between crystal parts, that is, a grain boundary is not clearly observed. Thus, in the CAAC-OS film, a reduction in electron mobility due to the grain boundary is less likely to occur.

According to the TEM image of the CAAC-OS film observed in a direction substantially parallel to a sample surface (cross-sectional TEM image), metal atoms are arranged in a layered manner in the crystal parts. Each layer of metal atoms has a morphology reflected by a surface over which the CAAC-OS film is formed (hereinafter, a surface over which the CAAC-OS film is formed is referred to as a formation surface) or a top surface of the CAAC-OS film, and is arranged in parallel to the formation surface or the top surface of the CAAC-OS film.

In this specification, the term "parallel" indicates that the angle formed between two straight lines ranges from −10° to 10°, and accordingly also includes the case where the angle ranges from −5° to 5°. In addition, the term "perpendicular" indicates that the angle formed between two straight lines ranges from 80° to 100°, and accordingly includes the case where the angle ranges from 85° to 95°.

In this specification, the trigonal and rhombohedral crystal systems are included in the hexagonal crystal system.

On the other hand, according to the TEM image of the CAAC-OS film observed in a direction substantially perpendicular to the sample surface (plan TEM image), metal atoms are arranged in a triangular or hexagonal configuration in the crystal parts. However, there is no regularity of arrangement of metal atoms between different crystal parts.

From the results of the cross-sectional TEM image and the plan TEM image, alignment is found in the crystal parts in the CAAC-OS film.

Most of the crystal parts included in the CAAC-OS film each fit inside a cube whose one side is less than 100 nm. Thus, there is a case where a crystal part included in the CAAC-OS film fits inside a cube whose one side is less than 10 nm, less than 5 nm, or less than 3 nm. Note that when a plurality of crystal parts included in the CAAC-OS film are connected to each other, one large crystal region is formed in some cases. For example, a crystal region with an area of 2500 $nm^2$ or more, 5 $\mu m^2$ or more, or 1000 $\mu m^2$ or more is observed in some cases in the plan TEM image.

A CAAC-OS film is subjected to structural analysis with an X-ray diffraction (XRD) apparatus. For example, when a CAAC-OS film including an $InGaZnO_4$ crystal is analyzed by an out-of-plane method, a peak appears frequently when the diffraction angle (2θ) is around 31°. This peak is derived from the (009) plane of the $InGaZnO_4$ crystal, which indicates that crystals in the CAAC-OS film have c-axis alignment, and that the c-axes are aligned in a direction substantially perpendicular to the formation surface or the top surface of the CAAC-OS film.

On the other hand, when the CAAC-OS film is analyzed by an in-plane method in which an X-ray enters a sample in a direction substantially perpendicular to the c-axis, a peak appears frequently when 2θ is around 56°. This peak is derived from the (110) plane of the $InGaZnO_4$ crystal. Here, analysis (ϕ scan) is performed under conditions where the sample is rotated around a normal vector of a sample surface as an axis (ϕ axis) with 2θ fixed at around 56°. In the case where the sample is a single-crystal oxide semiconductor film of $InGaZnO_4$, six peaks appear. The six peaks are derived from crystal planes equivalent to the (110) plane. On the other hand, in the case of a CAAC-OS film, a peak is not clearly observed even when 0 scan is performed with 2θ fixed at around 56°.

According to the above results, in the CAAC-OS film having c-axis alignment, while the directions of a-axes and b-axes are different between crystal parts, the c-axes are aligned in a direction parallel to a normal vector of a formation surface or a normal vector of a top surface. Thus, each metal atom layer arranged in a layered manner observed in the cross-sectional TEM image corresponds to a plane parallel to the a-b plane of the crystal.

Note that the crystal part is formed concurrently with deposition of the CAAC-OS film or is formed through crystallization treatment such as heat treatment. As described above, the c-axis of the crystal is aligned in a direction parallel to a normal vector of a formation surface or a normal vector of a top surface. Thus, for example, in the case where the shape of the CAAC-OS film is changed by etching or the like, the c-axis might not be necessarily parallel to a normal vector of a formation surface or a normal vector of a top surface of the CAAC-OS film.

Distribution of c-axis aligned crystal parts in the CAAC-OS film is not necessarily uniform. For example, in the case where crystal growth leading to the crystal parts of the CAAC-OS film occurs from the vicinity of the top surface of the film, the proportion of the c-axis aligned crystal parts in the vicinity of the top surface is higher than that in the vicinity of the formation surface in some cases. Further, when an impurity is added to the CAAC-OS film, a region to which the impurity is added may be altered and the proportion of the c-axis aligned crystal parts in the CAAC-OS film might vary depending on regions.

Note that when the CAAC-OS film with an $InGaZnO_4$ crystal is analyzed by an out-of-plane method, a peak of 2θ may also be observed at around 36°, in addition to the peak of 2θ at around 31°. The peak of 2θ at around 36° indicates that a crystal having no c-axis alignment is included in part of the CAAC-OS film. It is preferable that in the CAAC-OS film, a peak of 2θ appear at around 31° and a peak of 2θ do not appear at around 36°.

The CAAC-OS film is an oxide semiconductor film having low impurity concentration. The impurity is an element other than the main components of the oxide semiconductor film, such as hydrogen, carbon, silicon, or a transition metal element. In particular, an element that has higher bonding strength to oxygen than a metal element included in the oxide semiconductor film, such as silicon, disturbs the atomic arrangement of the oxide semiconductor film by depriving the oxide semiconductor film of oxygen and causes a decrease in crystallinity. Further, a heavy metal such as iron or nickel, argon, carbon dioxide, or the like has a large atomic radius (molecular radius), and thus disturbs the atomic arrangement of the oxide semiconductor film and causes a decrease in crystallinity when it is contained in the oxide semiconductor film. Note that the impurity contained in the oxide semiconductor film might serve as a carrier trap or a carrier generation source.

The CAAC-OS film is an oxide semiconductor film having a low density of defect states. In some cases, oxygen vacancies in the oxide semiconductor film serve as carrier traps or serve as carrier generation sources when hydrogen is captured therein.

The state in which impurity concentration is low and density of defect states is low (the number of oxygen vacancies is small) is referred to as a "highly purified intrinsic" or "substantially highly purified intrinsic" state. A highly purified intrinsic or substantially highly purified intrinsic oxide semiconductor film has few carrier generation sources, and thus can have a low carrier density. Therefore, a transistor including the oxide semiconductor film rarely has negative threshold voltage (is rarely normally on). The highly purified intrinsic or substantially highly purified intrinsic oxide semiconductor film has a low density of defect states, and thus has few carrier traps. Accordingly, the transistor including the oxide semiconductor film has little variation in electrical characteristics and high reliability. Electric charge trapped by the carrier traps in the oxide semiconductor film takes a long time to be released and might behave like fixed electric charge. Thus, the transistor including the oxide semiconductor film having high impurity concentration and a high density of defect states has unstable electrical characteristics in some cases.

With the use of the CAAC-OS film in a transistor, variation in the electrical characteristics of the transistor due to irradiation with visible light or ultraviolet light is small.

Next, a microcrystalline oxide semiconductor film will be described.

In an image obtained with the TEM, crystal parts cannot be found clearly in the microcrystalline oxide semiconductor film in some cases. In most cases, a crystal part in the microcrystalline oxide semiconductor film ranges from 1 nm to 100 nm, or from 1 nm to 10 nm. A microcrystal with a size ranging from 1 nm to 10 nm or from 1 nm to 3 nm is specifically referred to as nanocrystal (nc). An oxide semiconductor film including nanocrystal is referred to as an nc-OS (nanocrystalline oxide semiconductor) film. In an image obtained with the TEM, a crystal grain cannot be found clearly in the nc-OS film in some cases.

In the nc-OS film, a microscopic region (e.g., a region with a size ranging from 1 nm to 10 nm, in particular, a region with a size ranging from 1 nm to 3 nm) has a periodic atomic order. Further, there is no regularity of crystal orientation between different crystal parts in the nc-OS film; thus, the orientation of the whole film is not observed. Accordingly, in some cases, the nc-OS film cannot be distinguished from an amorphous oxide semiconductor film depending on an analysis method. For example, when the nc-OS film is subjected to structural analysis by an out-of-plane method with an XRD apparatus using an X-ray having a diameter larger than that of a crystal part, a peak indicating a crystal plane does not appear. Further, a halo pattern is shown in a selected-area electron diffraction pattern of the nc-OS film obtained by using an electron beam having a probe diameter (e.g., 50 nm or larger) larger than the diameter of a crystal part. Meanwhile, spots are shown in a nanobeam electron diffraction pattern of the nc-OS film obtained by using an electron beam having a probe diameter (e.g., ranging from 1 nm to 30 nm) close to or smaller than the diameter of a crystal part. Further, in a nanobeam electron diffraction pattern of the nc-OS film, regions with high luminance in a circular (ring) pattern are shown in some cases. Moreover, in a nanobeam electron diffraction pattern of the nc-OS film, a plurality of spots are shown in a ring-like region in some cases.

Since the nc-OS film is an oxide semiconductor film having more regularity than the amorphous oxide semiconductor film, the nc-OS film has a lower density of defect levels than the amorphous oxide semiconductor film. However, there is no regularity of crystal orientation between different crystal parts in the nc-OS film; hence, the nc-OS film has a higher density of defect states than the CAAC-OS film.

Note that an oxide semiconductor film may be a stacked film including two or more films of an amorphous oxide semiconductor film, a microcrystalline oxide semiconductor film, and a CAAC-OS film, for example.

For example, a CAAC-OS film can be deposited by sputtering using a polycrystalline oxide semiconductor sputtering target. When ions collide with the sputtering target, a crystal region included in the sputtering target may be separated from the target along an a-b plane; in other words, a sputtered particle having a plane parallel to an a-b plane (flat-plate-like sputtered particle or pellet-like sputtered particle) may flake off from the sputtering target. In this case, the flat-plate-like sputtered particle or the pellet-like sputtered particle reaches a surface where the CAAC-OS film is to be deposited while maintaining its crystal state, whereby the CAAC-OS film can be deposited.

The flat-plate-like sputtered particle has, for example, an equivalent circular diameter of a plane parallel to the a-b plane of 3 nm to 10 nm, and a thickness (length in the direction perpendicular to the a-b plane) of 0.7 nm or more and less than 1 nm. Note that in the flat-plate-like sputtered particle, the plane parallel to the a-b plane may be a regular triangle or a regular hexagon. Here, the term "equivalent circular diameter" refers to a diameter of a perfect circle having the same area as the plane.

For the deposition of the CAAC-OS film, the following conditions are preferably used.

By increasing the substrate temperature during the deposition, migration of the flat-plate-like sputtered particle that has reached the substrate occurs, so that a flat plane of the sputtered particle is attached to the substrate. At this time, the sputtered particle is charged positively, whereby sputtered particles are attached to the substrate while repelling each other; thus, the sputtered particles do not overlap with each other randomly, and a CAAC-OS film with a uniform thickness can be deposited. Specifically, the substrate temperature during the deposition ranges preferably from 100° C. to 740° C., more preferably from 200° C. to 500° C.

Decay of the crystal state due to impurities can be prevented by reduction in the amount of impurities entering the CAAC-OS film during the deposition, for example, by reduction in the concentration of impurities (e.g., hydrogen, water, carbon dioxide, and nitrogen) in the deposition chamber or in a deposition gas. Specifically, a deposition gas with a dew point of −80° C. or lower, preferably −100° C. or lower is used.

It is preferable that the proportion of oxygen in the deposition gas be increased and the power be optimized in order to reduce plasma damage during the deposition. The proportion of oxygen in the deposition gas is 30 vol % or higher, preferably 100 vol %.

After the CAAC-OS film is deposited, heat treatment may be performed. The temperature of the heat treatment ranges from 100° C. to 740° C., preferably from 200° C. to 500° C. Further, the heat treatment is performed for 1 minute to 24 hours, preferably 6 minutes to 4 hours. The heat treatment can be performed in an inert atmosphere or an oxidation atmosphere. It is preferable to perform heat treatment in an inert atmosphere and then perform heat treatment in an oxidation atmosphere. The heat treatment in an inert atmosphere can reduce the concentration of impurities in the CAAC-OS film in a short time. At the same time, the heat treatment in an inert atmosphere may generate oxygen vacancies in the CAAC-OS film. In this case, the heat treatment in an oxidation atmosphere can reduce the oxygen vacancies. The heat treatment can further increase the crystallinity of the CAAC-OS film. Note that the heat treatment may be performed under a reduced pressure of 1000 Pa or less, 100 Pa or less, 10 Pa or less, or 1 Pa or less. The heat treatment under a reduced pressure can reduce the concentration of impurities in the CAAC-OS film in a shorter time.

As an example of the sputtering target, an In—Ga—Zn—O compound target is described below.

The polycrystalline In—Ga—Zn—O compound target is made by mixing $InO_X$ powder, $GaO_Y$ powder, and $ZnO_Z$ powder in a predetermined molar ratio, applying pressure, and performing heat treatment at a temperature of 1000° C. to 1500° C. Note that X, Y, and Z are each a given positive number. Here, the predetermined molar ratio of $InO_X$ powder to $GaO_Y$ powder and $ZnO_Z$ powder is, for example, 1:1:1, 1:1:2, 1:3:2, 1:9:6, 2:1:3, 2:2:1, 3:1:1, 3:1:2, 3:1:4, 4:2:3, 8:4:3, or a ratio close to these ratios. Note that the kinds of powder and the molar ratio for mixing powder can be determined as appropriate depending on the desired sputtering target.

Alternatively, the CAAC-OS film may be formed in the following manner.

First, a first oxide semiconductor film is formed to a thickness of greater than or equal to 1 nm and less than 10 nm. The first oxide semiconductor film is formed by sputtering. Specifically, the substrate temperature during the deposition ranges from 100° C. to 500° C., preferably from 150° C. to 450° C., and the proportion of oxygen in the deposition gas is 30 vol % or higher, preferably 100 vol %.

Next, the first oxide semiconductor film is subjected to heat treatment to be a first CAAC-OS film with high crystallinity. The heat treatment is performed at a temperature ranging from 350° C. to 740° C., preferably from 450° C. to 650° C. Further, the heat treatment is performed for 1 minute to 24 hours, preferably 6 minutes to 4 hours. The heat treatment can be performed in an inert atmosphere or an oxidation atmosphere. It is preferable to perform heat treatment in an inert atmosphere and then perform heat treatment in an oxidation atmosphere. The heat treatment in an inert atmosphere can reduce the concentration of impurities in the first oxide semiconductor film in a short time. At the same time, the heat treatment in an inert atmosphere may generate oxygen vacancies in the first oxide semiconductor film. In this case, the heat treatment in an oxidation atmosphere can reduce the oxygen vacancies. Note that the heat treatment may be performed under a reduced pressure of 1000 Pa or less, 100 Pa or less, 10 Pa or less, or 1 Pa or less. The heat treatment under a reduced pressure can reduce the concentration of impurities in the first oxide semiconductor film in a shorter time.

The first oxide semiconductor film with a thickness of greater than or equal to 1 nm and less than 10 nm can be easily crystallized by heat treatment compared to the case where the first oxide semiconductor film has a thickness of 10 nm or greater.

Next, a second oxide semiconductor film that has the same composition as the first oxide semiconductor film is formed to a thickness of 10 nm to 50 nm. The second oxide semiconductor film is formed by sputtering. Specifically, the substrate temperature during the deposition ranges from 100° C. to 500° C., preferably from 150° C. to 450° C., and the proportion of oxygen in the deposition gas is 30 vol % or higher, preferably 100 vol %.

Then, heat treatment is performed so that solid phase growth of the second oxide semiconductor film from the first CAAC-OS film occurs, whereby the second oxide semiconductor film is turned into a second CAAC-OS film having high crystallinity. The heat treatment is performed at a temperature ranging from 350° C. to 740° C., preferably from 450° C. to 650° C. Further, the heat treatment is performed for 1 minute to 24 hours, preferably 6 minutes to 4 hours. The heat treatment can be performed in an inert atmosphere or an oxidation atmosphere. It is preferable to perform heat treatment in an inert atmosphere and then perform heat treatment in an oxidation atmosphere. The heat treatment in an inert atmosphere can reduce the concentration of impurities in the second oxide semiconductor film in a short time. At the same time, the heat treatment in an inert atmosphere may generate oxygen vacancies in the second oxide semiconductor film. In this case, the heat treatment in an oxidation atmosphere can reduce the oxygen vacancies. Note that the heat treatment may be performed under a reduced pressure of 1000 Pa or less, 100 Pa or less, 10 Pa or less, or 1 Pa or less. The heat treatment under a reduced pressure can reduce the concentration of impurities in the second oxide semiconductor film in a shorter time.

As described above, the CAAC-OS film with a total thickness of 10 nm or greater can be formed.

Although the oxide semiconductor film described above can be formed by a sputtering method or a plasma chemical vapor deposition (CVD) method, such films may be formed by another method, e.g., a thermal CVD method. A metal organic chemical vapor deposition (MOCVD) method or an atomic layer deposition (ALD) method may be employed as an example of a thermal CVD method.

A thermal CVD method has an advantage that no defect due to plasma damage is generated since it does not utilize plasma for forming a film.

Deposition by a thermal CVD method may be performed in such a manner that the pressure in a chamber is set to an atmospheric pressure or a reduced pressure, and a source gas and an oxidizer are supplied to the chamber at a time and react with each other in the vicinity of the substrate or over the substrate.

Deposition by an ALD method may be performed in such a manner that the pressure in a chamber is set to an atmospheric pressure or a reduced pressure, source gases for reaction are sequentially introduced into the chamber, and then the sequence of the gas introduction is repeated. For example, two or more kinds of source gases are sequentially supplied to the chamber by switching respective switching valves (also referred to as high-speed valves). For example, a first source gas is introduced, an inert gas (e.g., argon or nitrogen) or the like is introduced at the same time as or after the introduction of the first gas so that the source gases are not mixed, and then a second source gas is introduced. Note that in the case where the first source gas and the inert gas are introduced at a time, the inert gas serves as a carrier gas, and the inert gas may also be introduced at the same time as the introduction of the second source gas. Alternatively, the first source gas may be exhausted by vacuum evacuation instead of the introduction of the inert gas, and then the second source gas may be introduced. The first source gas is adsorbed on the surface of the substrate to form a first single-atomic layer; then the second source gas is introduced to react with the first single-atomic layer; as a result, a second single-atomic layer is stacked over the first single-atomic layer, so that a thin film is formed. The sequence of the gas introduction is repeated plural times until a desired thickness is obtained, whereby a thin film with excellent step coverage can be formed. The thickness of the thin film can be adjusted by the number of repetitions times of the sequence of the gas introduction; therefore, an ALD method makes it possible to accurately adjust a thickness and thus is suitable for manufacturing a minute FET.

For example, in the case where an $InGaZnO_X$ (X>0) film is formed, trimethylindium, trimethylgallium, and diethylzinc are used. Note that the chemical formula of trimethylindium is $(CH_3)_3In$. The chemical formula of trimethylgallium is $(CH_3)_3Ga$. The chemical formula of diethylzinc is $(CH_3)_2Zn$. Without limitation to the above combination, triethylgallium (chemical formula: $(C_2H_5)_3Ga$) can be used instead of trimethylgallium and dimethylzinc (chemical formula: $(C_2H_5)_2Zn$) can be used instead of diethylzinc.

For example, in the case where an oxide semiconductor film, e.g., an $InGaZnO_X$ (X>0) film is formed using a deposition apparatus employing ALD, an $In(CH_3)_3$ gas and an $O_3$ gas are sequentially introduced plural times to form an $InO_2$ layer, a $Ga(CH_3)_3$ gas and an $O_3$ gas are introduced at a time to form a GaO layer, and then a $Zn(CH_3)_2$ gas and an $O_3$ gas are introduced at a time to form a ZnO layer. Note that the order of these layers is not limited to this example. A mixed compound layer such as an $InGaO_2$ layer, an $InZnO_2$ layer, a GaInO layer, a ZnInO layer or a GaZnO layer may be formed by mixing of these gases. Note that although an $H_2O$ gas which is obtained by bubbling with an inert gas such as Ar may be used instead of an $O_3$ gas, it is preferable to use an $O_3$ gas, which does not contain H. Further, instead of an $In(CH_3)_3$ gas, an $In(C_2H_5)_3$ gas may be used. Instead of a $Ga(CH_3)_3$ gas, a $Ga(C_2H_5)_3$ gas may be used. Instead of an $In(CH_3)_3$ gas, an $In(C_2H_5)_3$ may be used. Furthermore, a $Zn(CH_3)_2$ gas may be used.

Further, the oxide semiconductor film may have a structure in which a plurality of oxide semiconductor films are stacked.

For example, a structure may be employed in which, between an oxide semiconductor film (referred to as a first layer for convenience) and a gate insulating film, a second layer that is formed of constituent elements of the first layer and has an electron affinity lower than that of the first layer by 0.2 eV or more is provided. In this case, when an electric field is applied from the gate electrode, a channel is formed in the first layer but not formed in the second layer. Since the elements contained in the first layer are the same as those in the second layer, interface scattering at the interface between the first layer and the second layer hardly occurs. Thus, providing the second layer between the first layer and the gate insulating film can increase the field-effect mobility of the transistor.

When a silicon oxide film, a silicon oxynitride film, a silicon nitride oxide film, or a silicon nitride film is used as the gate insulating film, silicon included in the gate insulating film may be mixed into the oxide semiconductor film. If silicon is included in the oxide semiconductor film, crystallinity and carrier mobility of the oxide semiconductor film are decreased, for example. Thus, the second layer is preferably provided between the first layer and the gate insulating film to reduce the silicon concentration in the first layer where a channel is formed. For the same reason, it is preferable that a third layer which is formed of the constituent elements of the first layer and has an electron affinity lower than that of the first layer by 0.2 eV or more be provided and the first layer be sandwiched between the second layer and the third layer.

Such a structure makes it possible to reduce and even prevent diffusion of impurities such as silicon to a region where a channel is formed, so that a highly reliable transistor is obtained.

In order to form a CAAC-OS film as an oxide semiconductor film, the concentration of silicon in the oxide semiconductor film is set to $2.5\times10^{21}/cm^3$ or less. Preferably, the concentration of silicon in the oxide semiconductor film is less than $1.4\times10^{21}/cm^3$, preferably less than $4\times10^{19}/cm^3$, more preferably less than $2.0\times10^{18}/cm^3$. This is because the field-effect mobility of the transistor might be reduced when the concentration of silicon in the oxide semiconductor film is $1.4\times10^{21}/cm^3$ or more, and because the oxide semiconductor film might be made amorphous at the interface with a film in contact with the oxide semiconductor film when the concentration of silicon in the oxide semiconductor film is $4.0\times10^{19}/cm^3$ or more. Further, when the concentration of silicon in the oxide semiconductor film is less than $2.0\times10^{18}/cm^3$, improvement in reliability of the transistor and a reduction in the density of state (DOS) in the oxide semiconductor film can be expected. Note that the concentration of silicon in the oxide semiconductor film can be measured by secondary ion mass spectroscopy (SIMS).

This embodiment can be implemented in combination with any of the other embodiments described in this specification as appropriate.

Embodiment 10

In Embodiment 10, specific examples of electronic devices including the liquid crystal display device described in the above embodiment will be described with reference to FIGS. 20A to 20C.

Examples of electronic devices to which the present invention can be applied include a television device (also referred to as a television or a television receiver), a monitor of a computer and the like, cameras such as a digital camera and a digital video camera, a digital photo frame, a mobile phone, a portable game machine, a portable information terminal, a music reproducing device, a game machine (e.g., a pachinko machine and a slot machine), and a game console. Specific examples of these electronic devices are shown in FIGS. 20A to 20C.

Figure 20A:
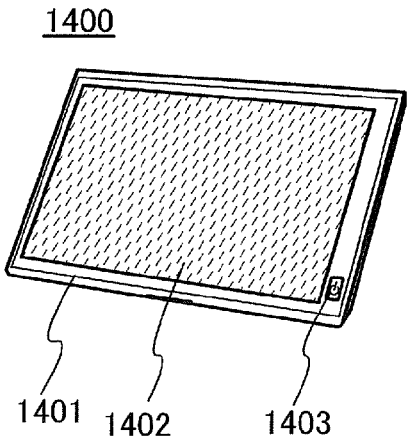
FIGS. 20A to 20C each illustrate an electronic device.

FIG. 20A illustrates a portable information terminal 1400 including a display portion. The portable information terminal 1400 includes a display portion 1402 and an operation button 1403 that are incorporated in a housing 1401. The liquid crystal display device of one embodiment of the present invention can be used for the display portion 1402.

Figure 20B:
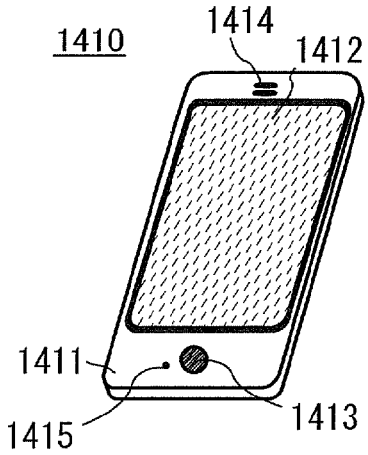

FIG. 20B illustrates a mobile phone 1410. The mobile phone 1410 includes a display portion 1412, an operation button 1413, a speaker 1414, and a microphone 1415 that are incorporated in a housing 1411. The liquid crystal display device of one embodiment of the present invention can be used for the display portion 1412.

Figure 20C:
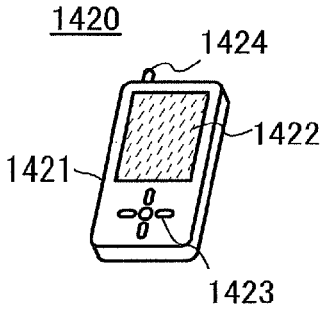

FIG. 20C illustrates a music reproducing device 1420. The music reproducing device 1420 includes a display portion 1422, an operation button 1423, and an antenna 1424 that are incorporated in a housing 1421. The antenna 1424 transmits and receives data via a wireless signal. The liquid crystal display device of one embodiment of the present invention can be used for the display portion 1422.

The display portions 1402, 1412, and 1422 each have a touch input function. When a user touches a display button (not illustrated) that is displayed on the display portion 1402, 1412, or 1422 with a finger or the like, the user can carry out operation on the screen and input of information.

The display portions 1402, 1412, and 1422 each using the liquid crystal display device shown in the above embodiment can have higher display quality.

This embodiment can be implemented in appropriate combination with any of the structures described in the other embodiments.

Embodiment 11

In Embodiment 11, the significance of the reduction in the frame frequency (also referred to as refresh rate) described in the above embodiments will be explained.

Eye fatigue is classified into two categories: nervous asthenopia and muscular asthenopia. Nervous asthenopia is fatigue caused when a user keeps seeing continuous or blinking display of a liquid crystal display device for a long time so that the brightness stimulates the retina and nerve of the eye and the brain. Muscular asthenopia is fatigue caused by overuse of the ciliary muscle, which is used to adjust the focus.

Figure 21A:
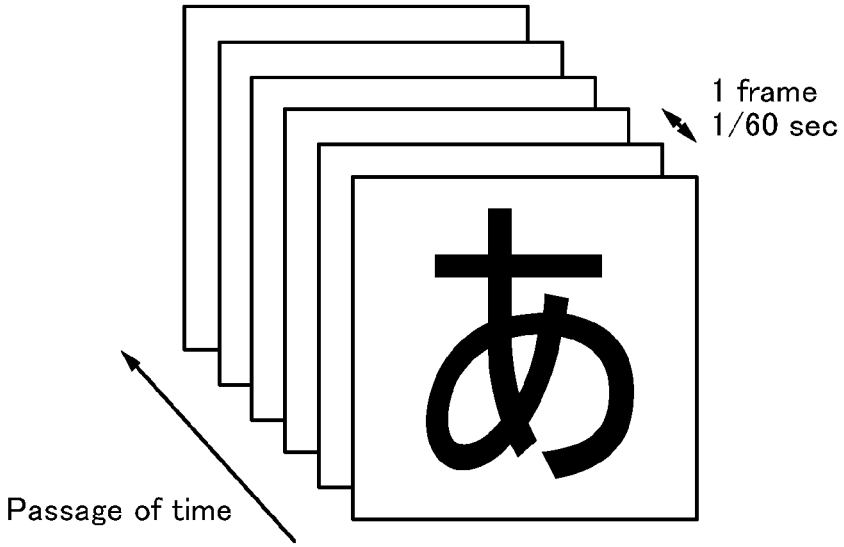
FIGS. 21A and 21B are diagrams for explaining display in an embodiment.

FIG. 21A is a schematic diagram showing display on a conventional liquid crystal display device. As shown in FIG. 21A, images are rewritten 60 times per second for display on the conventional liquid crystal display device. When a user keeps watching such display for a long time, the retina and nerve of the eye and the brain may be stimulated and eye fatigue might be caused as a result.

In one embodiment of the present invention, a transistor using an oxide semiconductor, for example, a transistor using CAAC-OS is used in a pixel portion of a liquid crystal display device. Since the off-state current of the transistor is extremely low, the luminance of the liquid crystal display device can be maintained even with lower frame frequency.

Figure 21B:
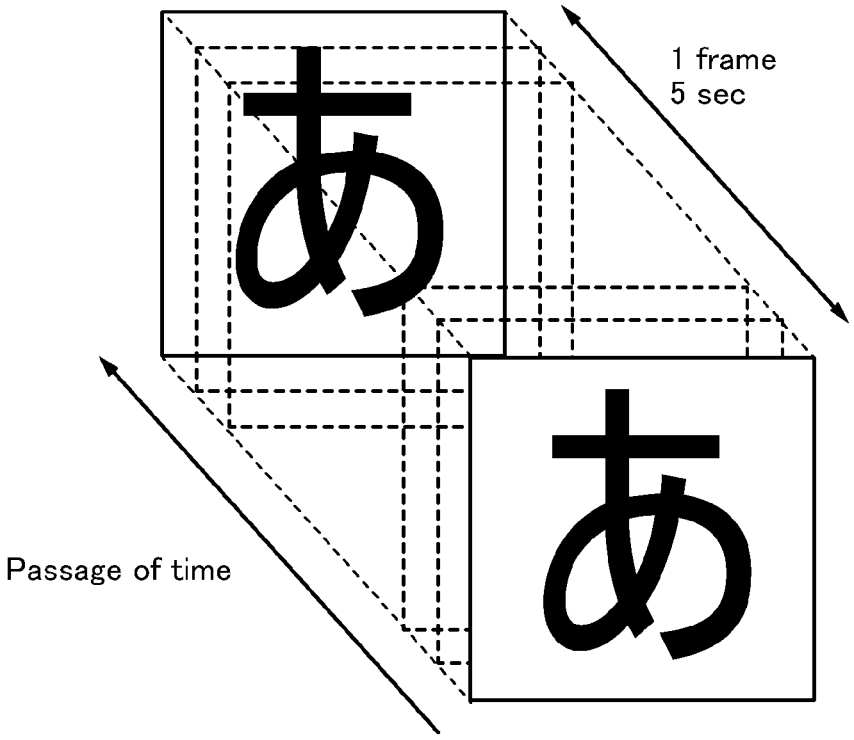

In other words, for example, images can be rewritten once every five seconds as shown in FIG. 21B, so that a user can see the same image as long as possible, and screen flickers perceived by the user are reduced. Thus, stimuli to the retina and nerve of the eye and the brain of the user are reduced, and nervous asthenopia is reduced accordingly.

Figure 22A:
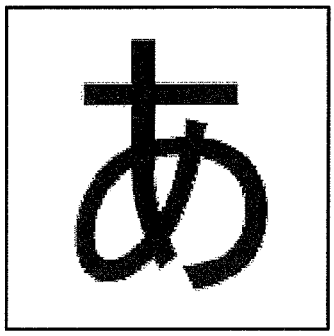
FIGS. 22A and 22B are diagrams for explaining display in an embodiment.

When the size of one pixel is large (e.g., when the resolution is less than 150 ppi), a character displayed on the liquid crystal display device is blurred as shown in FIG. 22A. When the user keeps watching bluffed characters displayed on the liquid crystal display device for a long time, difficulty in focusing persists even though the ciliary muscle keeps moving to focus on the characters; thus, strain might be put on the eyes.

Figure 22B:
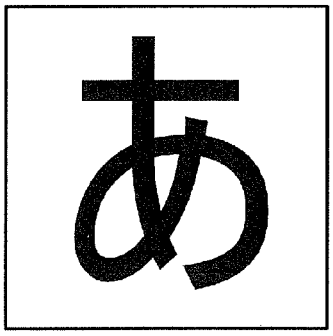

In contrast, the liquid crystal display device of one embodiment of the present invention has a small-size pixel and thus can display high-resolution images, so that a precise and smooth image can be displayed as shown in FIG. 22B. Consequently, the ciliary muscle can easily adjust focus on display, so that muscular asthenopia of the user is reduced.

There have been considered methods of measuring eye fatigue quantitatively. A known example of an evaluation index of nervous asthenopia is critical flicker (fusion) frequency (CFF). Examples of an evaluation index of muscular asthenopia are accommodation time and near point distance.

Other examples of a method of measuring eye fatigue are electroencephalography, thermography, measurement of the number of blinks, measurement of tear volume, evaluation of pupillary response speed, and a questionnaire to identify a subjective symptom.

According to one embodiment of the present invention, an eye-friendly liquid crystal display device can be provided.

Example 1

Example 1 shows the results of evaluating three kinds of acrylic resins.

First, three kinds of samples ware fabricated and subjected to thermal desorption spectrometry (TDS) before and after a pressure cooker test (PCT).

Moreover, the same three kinds of samples ware fabricated and subjected to qualitative analysis of impurities with a time-of-flight secondary ion mass spectrometer (ToF-SIMS) before and after PCT.

Further, the transmittance of the same three kinds of samples was measured.

<Methods of Fabricating Samples>

Figure 23:
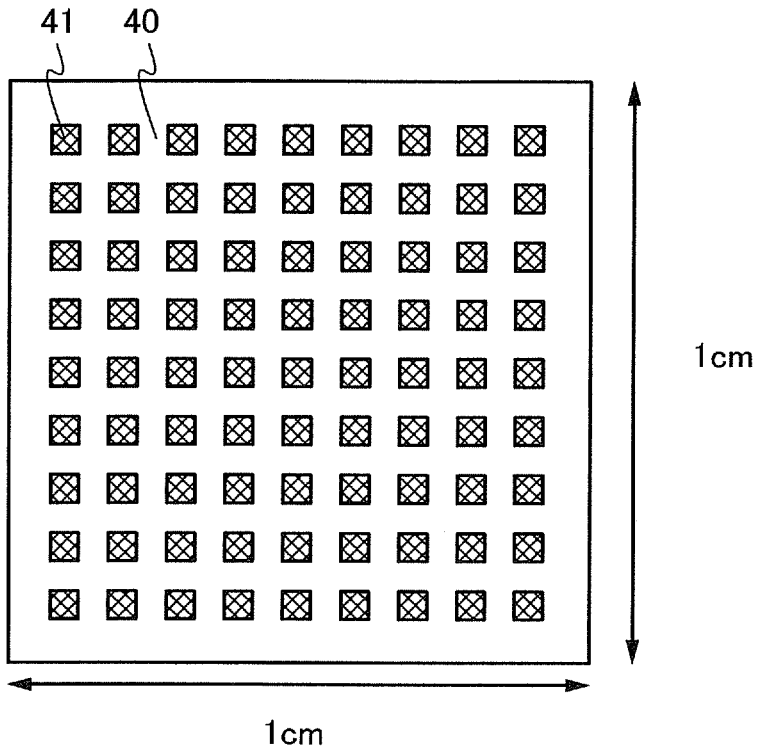
FIG. 23 illustrates a sample for TDS in Example 1.

FIG. 23 is a plan view of the samples subjected to TDS. Acrylic films 41 were arranged in 9 rows and 9 columns over a glass substrate 40. The acrylic film 41 was 400 μm square and had an area of 0.19 $cm^2$. For the samples subjected to qualitative analysis of impurities with the ToF-SIMS, the acrylic film was formed over the entire substrate. Methods of fabricating three kinds of samples in Example 1 are as follows.

<<Sample 1>>

A first acrylic resin was applied to the glass substrate to form a 1.5-μm-thick acrylic film, and baking was performed at 250° C. for 1 hour in a nitrogen atmosphere.

<<Sample 2>>

A second acrylic resin was applied to the glass substrate to form a 1.5-μm-thick acrylic film, and baking was performed at 220° C. for 1 hour in an air atmosphere.

<<Sample 3>>

A third acrylic resin was applied to the glass substrate to form a 1.5-μm-thick acrylic film, and baking was performed at 220° C. for 1 hour in an air atmosphere.

In PCT, the sample was held for 8 hours under the following conditions: a water vapor atmosphere, a temperature of 130° C., a humidity of 85%, and a pressure of 2 atm.

<TDS Results>

Figure 24:
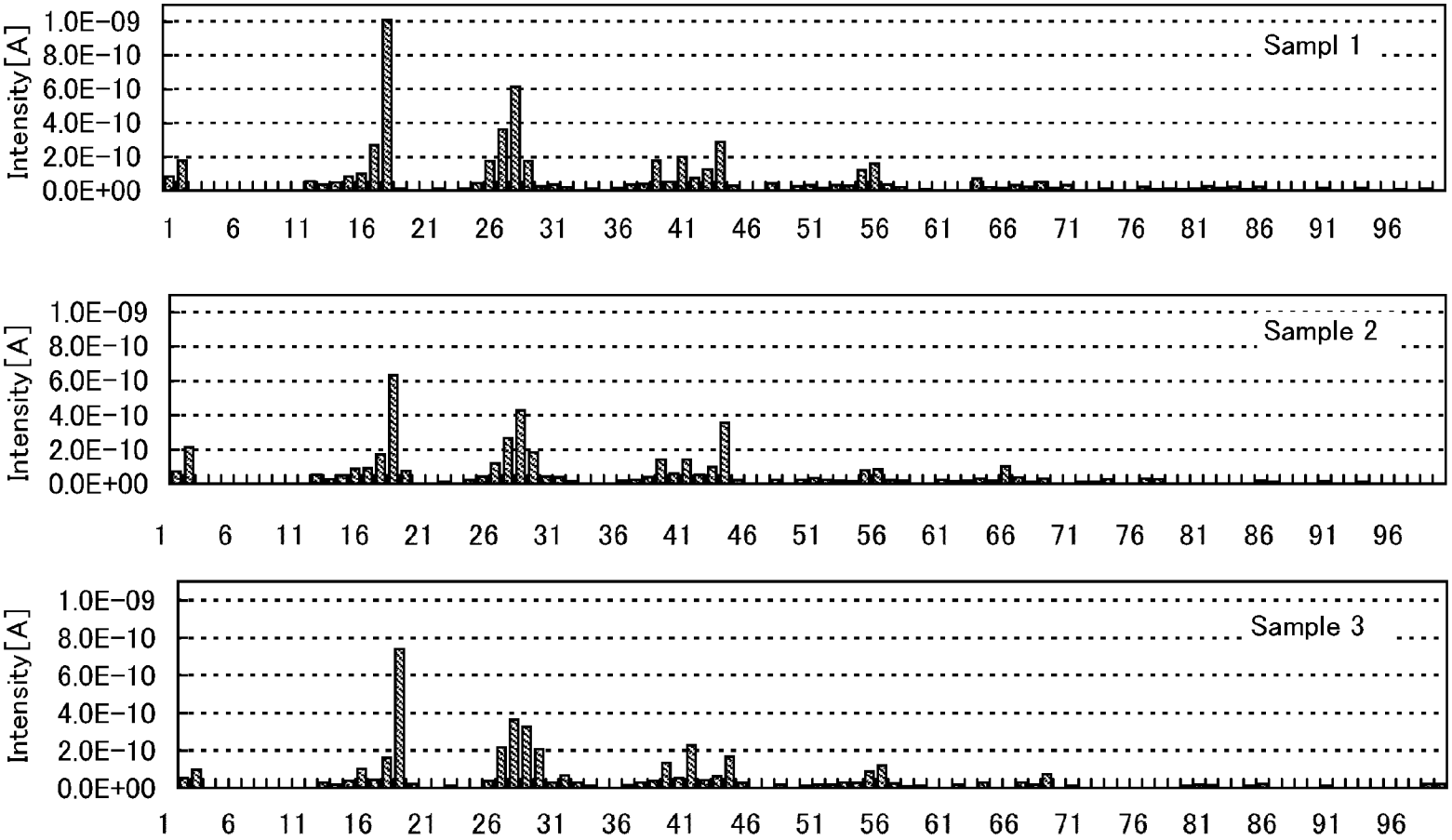
FIG. 24 shows TDS measurement results in Example 1.

In TDS, each sample is heated in a vacuum vessel and a gas component generated from the sample while the temperature of the sample is increased is detected by a quadrupole mass spectrometer. The heating rate is 20° C./min, and the temperature is increased to 230° C. Detected gas components are distinguished from each other by m/z (mass/charge). FIG. 24 shows m/z spectra of Samples 1 to 3 at a substrate temperature of 250° C. In FIG. 24, the horizontal axis represents m/z and the vertical axis represents ion intensity.

Figure 25:
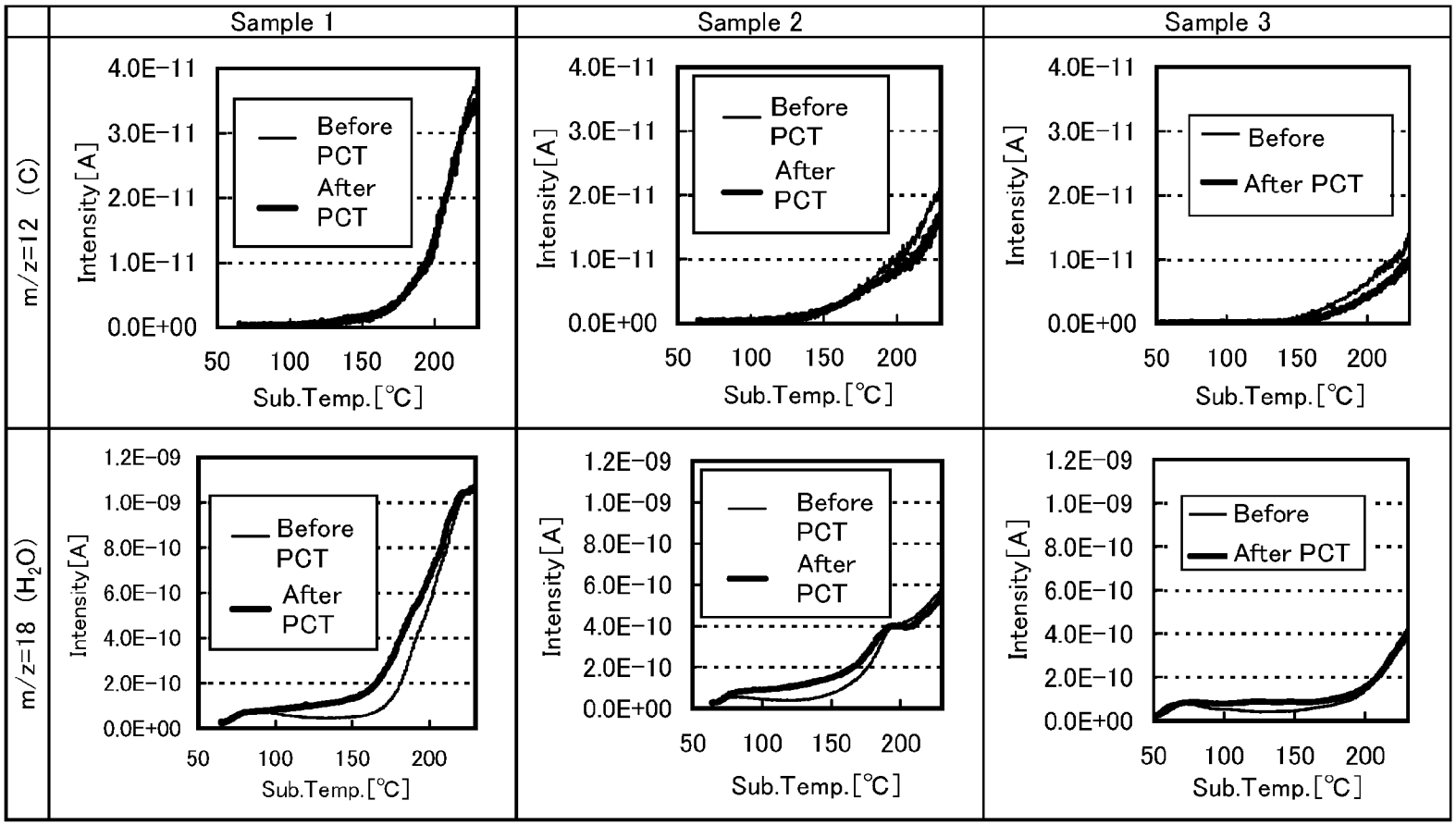
FIG. 25 shows TDS measurement results in Example 1.
Figure 26:
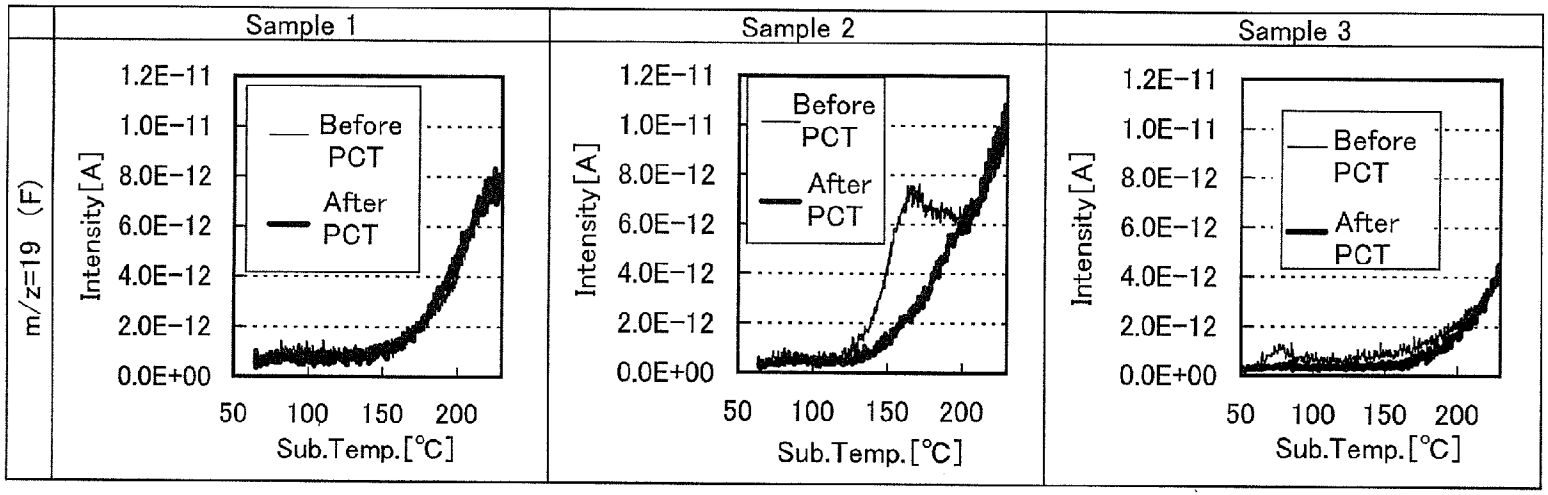
FIG. 26 shows TDS measurement results in Example 1.

In Example 1, a gas component detected at m/z=12 was identified as carbon (C), a gas component detected at m/z=18 was identified as water ($H_2O$), and a gas component detected at m/z=19 was identified as fluorine (F). FIG. 25 shows TDS spectra of m/z=12 (C) and m/z=18 ($H_2O$) of the samples. FIG. 26 shows TDS spectra of m/z=19 (F) of the samples. In FIGS. 25 and 26, the horizontal axis represents substrate temperature and the vertical axis represents ion intensity. Thin solid lines represent results before PCT, and thick solid lines represent results after PCT.

From the results in FIG. 25, the amount of water released from Sample 3 is smaller than that from Samples 1 and 2, and in particular, an increase in the amount of moisture released from Sample 3 due to PCT is hardly observed. These results suggest that the water absorbability of the third acrylic resin is lower than that of the first and second acrylic resins. Moreover, according to the results shown in FIGS. 25 and 26, the amounts of carbon and fluorine released from Sample 3 are also smaller than those from Samples 1 and 2.

<Results of Qualitative Analysis of Impurities with ToF-SIMS>

Table 1 shows the results of qualitative analysis of impurities with a ToF-SIMS. Note that these results are values indicating the peak intensities obtained by the ToF-SIMS and cannot be quantitatively compared to each other.

TABLE 1

| | | Na | K | F | Cl |
|---|---|---|---|---|---|
| Sample 1 | Before PCT | 15 | — | 1000 | 1500 |
| | After PCT | 340 | 260 | 1100 | 1700 |
| Sample 2 | Before PCT | 180 | 30 | 3100 | 2100 |
| | After PCT | 220 | 70 | 600 | 2100 |
| Sample 3 | Before PCT | 6 | — | 160 | 1600 |
| | After PCT | 72 | 36 | 160 | 1400 |

—: Not detected

It is found from the results in Table 1 that the detected peak intensities of Na, K, F, and Cl obtained by the ToF-SIMS are lower in Sample 3 than in Samples 1 and 2. This suggests that the impurity concentration of Sample 3 is lower than that of Samples 1 and 2.

<Measurement Results of Transmittance>

Figure 27:
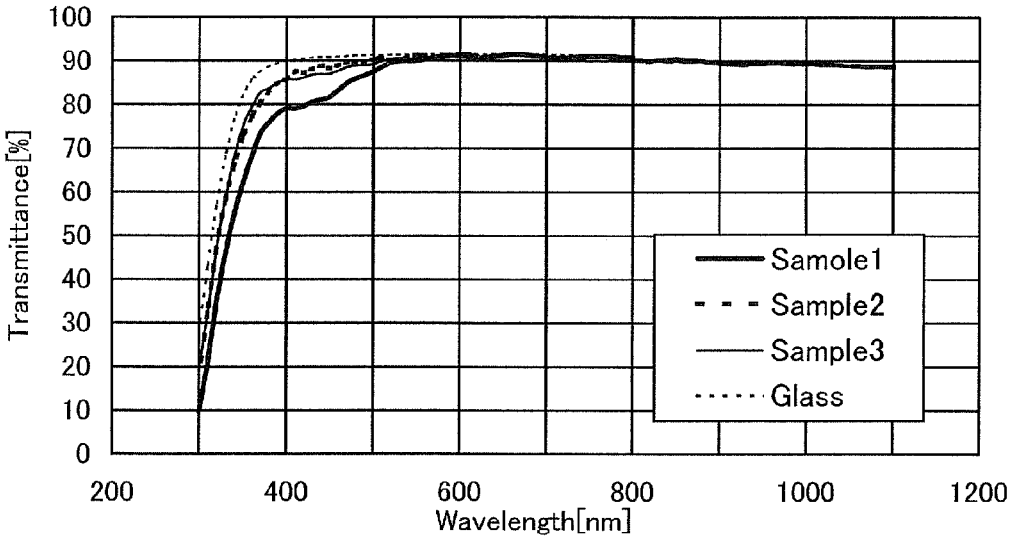
FIG. 27 shows results of measuring transmittance in Example 1.

FIG. 27 shows the results of measuring the transmittance of Samples 1 to 3 and a glass substrate, for comparison, used as a substrate where the acrylic film is formed. The measurement was performed with a spectrophotometer.

It is found from FIG. 27 that the transmittance of Samples 2 and 3 is higher than that of Sample 1.

Example 2

Example 2 shows the results of evaluating a circuit board (also referred to as a backplane) including a transistor. Specifically, in Example 2, the circuit board was fabricated, Id-Vg characteristics of the transistor were evaluated, and then a BT stress test and a BT stress test with light irradiation (hereinafter referred to as BT photostress test) were performed. Note that each of the BT stress test and the BT photostress test was conducted before and after PCT.

<Structure of Circuit Board>

Figure 28A:
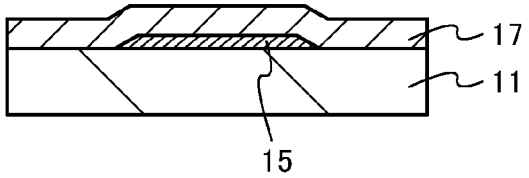
FIGS. 28A to 28E illustrate the structure of a circuit board in Example 2.
Figure 28B:
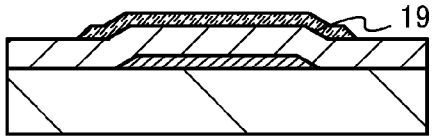
Figure 28C:
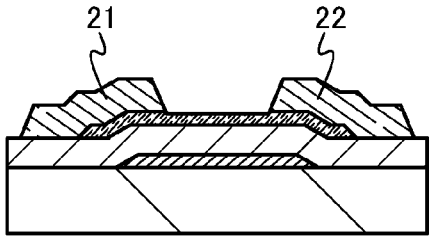
Figure 28D:
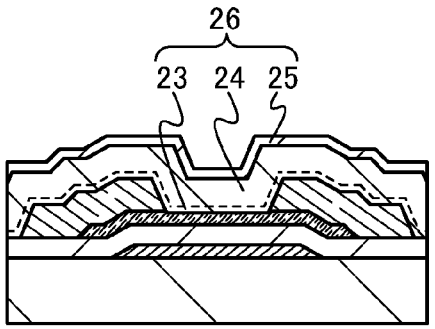
Figure 28E:
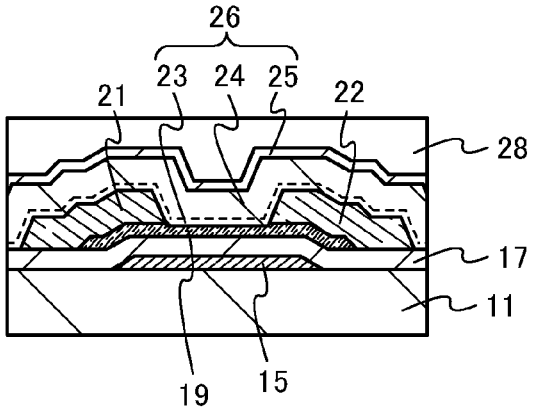

A circuit board illustrated in FIG. 28E includes a gate electrode 15 over a substrate 11, a gate insulating film 17 covering the gate electrode 15, an oxide semiconductor film 19 over the gate insulating film 17, a pair of electrodes 21 and 22 on and in contact with the oxide semiconductor film 19, a protection film 26 covering the oxide semiconductor film 19 and the pair of electrodes 21 and 22, and a planarization film 28 over the protection film 26.

In Example 2, Circuit boards 1 to 3 were fabricated using the respective three kinds of acrylic resins. Note that the first to third acrylic resins used in Example 2 are the same as those in Example 1.

<Method of Fabricating Circuit Board 1>

Steps of fabricating Circuit board 1 including a transistor will be described with reference to FIGS. 28A to 28E.

<<Formation of Gate Electrode>>

First, a glass substrate was used as the substrate 11, and the gate electrode 15 was formed over the substrate 11 as illustrated in FIG. 28A.

The gate electrode 15 was formed as follows: a 100-nm-thick tungsten film was formed by sputtering, a mask was formed over the tungsten film by a photolithography process, and the tungsten film was partly etched using the mask.

<<Formation of Gate Insulating Film>>

Next, the gate insulating film 17 was formed over the gate electrode 15.

The gate insulating film 17 was formed by stacking a 50-nm-thick first silicon nitride film, a 300-nm-thick second silicon nitride film, a 50-nm-thick third silicon nitride film, and a 50-nm-thick silicon oxynitride film.

The first silicon nitride film was formed under the following conditions: silane with a flow rate of 200 sccm, nitrogen with a flow rate of 2000 sccm, and ammonia with a flow rate of 100 sccm were supplied to a treatment chamber of a plasma CVD apparatus as the source gas; the pressure in the treatment chamber was controlled to 100 Pa; and a power of 2000 W was supplied with the use of a 27.12 MHz high-frequency power source.

Next, the second silicon nitride film was formed under the same conditions as the first silicon nitride film except that the flow rate of ammonia in the source gas was 2000 sccm.

Then, the third silicon nitride film was formed under the following conditions: silane with a flow rate of 200 sccm and nitrogen with a flow rate of 5000 sccm were supplied to the treatment chamber of the plasma CVD apparatus as the source gas; the pressure in the treatment chamber was controlled to 100 Pa; and a power of 2000 W was supplied with the use of a 27.12 MHz high-frequency power source.

Subsequently, the silicon oxynitride film was formed under the following conditions: silane with a flow rate of 20 sccm and dinitrogen monoxide with a flow rate of 3000 sccm were supplied to the treatment chamber of the plasma CVD apparatus as the source gas; the pressure in the treatment chamber was controlled to 40 Pa; and a power of 100 W was supplied with the use of a 27.12 MHz high-frequency power source.

Note that the substrate temperature was 350° C. in the steps of forming the layers composing the gate insulating film 17.

<<Formation of Oxide Semiconductor Film>>

Next, the oxide semiconductor film 19 was formed to overlap with the gate electrode 15 with the gate insulating film 17 placed therebetween.

Here, a 35-nm-thick oxide semiconductor film was formed over the gate insulating film 17 by sputtering. Then, a mask was formed over the oxide semiconductor film by a photolithography process, and the oxide semiconductor film was partly etched using the mask to form the oxide semiconductor film 19. After that, heat treatment was performed.

The oxide semiconductor film was formed in such a manner that a sputtering target of In:Ga:Zn=1:1:1 (atomic ratio) was used, argon with a flow rate of 50 sccm and oxygen with a flow rate of 50 sccm were supplied as a sputtering gas into a reaction chamber of a sputtering apparatus, the pressure in the reaction chamber was adjusted to 0.6 Pa, and a direct-current power of 5 kW was supplied. Note that the oxide semiconductor film was formed at a substrate temperature of 170° C.

As the heat treatment, heat treatment at 450° C. for 1 hour in a nitrogen atmosphere was performed, and then heat treatment at 450° C. for 1 hour in an atmosphere of nitrogen and oxygen was performed.

FIG. 28B can be referred to for the structure obtained through the steps up to here.

Next, the gate insulating film 17 is partly etched so that the gate electrode 15 was exposed (not illustrated).

<<Formation of Pair of Electrodes>>

As illustrated in FIG. 28C, the pair of electrodes 21 and 22 in contact with the oxide semiconductor film 19 was formed.

Here, a conductive film was formed over the gate insulating film 17 and the oxide semiconductor film 19. As the conductive film, a 400-nm-thick aluminum film was formed over a 50-nm-thick tungsten film, and a 100-nm-thick titanium film was formed over the aluminum film. Then, a mask was formed over the conductive film by a photolithography process, and part of the conductive film was etched with the use of the mask to form the pair of electrodes 21 and 22.

After that, a surface of the oxide semiconductor film 19 was subjected to cleaning treatment using a phosphoric acid solution in which 85% phosphoric acid was diluted by 100 times.

Next, the substrate was moved to a treatment chamber under reduced pressure and heated at 220° C., and then moved to a treatment chamber filled with dinitrogen monoxide. Then, the oxide semiconductor film 19 was exposed to oxygen plasma that was generated by supply of a high-frequency power of 150 W to an upper electrode provided in the treatment chamber with the use of a 27.12 MHz high-frequency power source.

<<Formation of Protection Film>>

Then, the protection film 26 was formed over the oxide semiconductor film 19 and the pair of electrodes 21 and 22 (see FIG. 28D). Here, for the protection film 26, an oxide insulating film 23, an oxide insulating film 24, and a nitride insulating film 25 were formed.

First, after the above plasma treatment, the oxide insulating film 23 and the oxide insulating film 24 were formed in succession without exposure to the air. A 50-nm-thick silicon oxynitride film was formed as the oxide insulating film 23, and a 400-nm-thick silicon oxynitride film was formed as the oxide insulating film 24.

The oxide insulating film 23 was formed by plasma CVD under the following conditions: silane with a flow rate of 30 sccm and dinitrogen monoxide with a flow rate of 4000 sccm were used as the source gas; the pressure in the treatment chamber was 200 Pa; the substrate temperature was 220° C.; and a high-frequency power of 150 W was supplied to parallel plate electrodes.

The oxide insulating film 24 was formed by plasma CVD under the following conditions: silane with a flow rate of 200 sccm and dinitrogen monoxide with a flow rate of 4000 sccm were used as the source gas; the pressure in the treatment chamber was 200 Pa; the substrate temperature was 220° C.; and a high-frequency power of 1500 W was supplied to the parallel plate electrodes. With the above conditions, it is possible to form a silicon oxynitride film which contains oxygen at a higher proportion than the stoichiometric composition and from which part of oxygen is released by heating.

Next, heat treatment was performed to release water, nitrogen, hydrogen, and the like from the oxide insulating films 23 and 24. Here, the heat treatment was performed at 350° C. for 1 hour in an atmosphere of nitrogen and oxygen.

Then, the substrate was transferred to a treatment chamber under reduced pressure and heated at 350° C., and after that, the nitride insulating film 25 was formed over the oxide insulating film 24. Here, a 100-nm-thick silicon nitride film was formed as the nitride insulating film 25.

The silicon nitride film 25 was formed by plasma CVD under the following conditions: silane with a flow rate of 50 sccm, nitrogen with a flow rate of 5000 sccm, and ammonia with a flow rate of 100 sccm were used as the source gas; the pressure in the treatment chamber was 100 Pa; the substrate temperature was 350° C.; and a high-frequency power of 1000 W was supplied to the parallel plate electrodes.

Next, although not illustrated, the protection film 26 was partly etched to form openings where the pair of electrodes 21 and 22 was partly exposed.

<<Formation of Planarization Film>>

Next, the planarization film 28 was formed over the nitride insulating film 25 (FIG. 28E). Here, the first acrylic resin was applied to the nitride insulating film 25, and then exposure and development were performed, thereby forming a 2.0-μm-thick planarization film 28 having openings where the pair of electrodes 21 and 22 is partly exposed. Subsequently, heat treatment was performed at 250° C. for 1 hour in an atmosphere containing nitrogen.

Then, a conductive film connected to part of the pair of electrodes 21 and 22 was formed (not illustrated). Here, a 100-nm-thick ITO film containing silicon oxide was formed by sputtering. After that, heat treatment was performed at 250° C. for 1 hour in a nitrogen atmosphere.

Through the above steps, Circuit board 1 including the transistor was fabricated.

<Method of Fabricating Circuit Board 2>

In the method of fabricating Circuit board 2, the steps prior to the step of forming the planarization film 28 are the same as those in the method of fabricating Circuit board 1. Then, the second acrylic resin was applied to the nitride insulating film 25, and then exposure and development were performed, thereby forming a 2.0-μm-thick planarization film 28 having openings where the pair of electrodes 21 and 22 is partly exposed. Then, heat treatment was performed at 220° C. for 1 hour in an air atmosphere. Next, as in Circuit board 1, an ITO film containing silicon oxide was formed, and heat treatment was performed at 220° C. for 1 hour in an air atmosphere.

<Method of Fabricating Circuit Board 3>

In the method of fabricating Circuit board 3, the steps prior to the step of forming the planarization film 28 are the same as those in the method of fabricating Circuit board 1. Then, the third acrylic resin was applied to the nitride insulating film 25, and then exposure and development were performed, thereby forming a 2.0-μm-thick planarization film 28 having openings where the pair of electrodes 21 and 22 is partly exposed. Then, heat treatment was performed at 220° C. for 1 hour in an air atmosphere. Next, as in Circuit board 1, an ITO film containing silicon oxide was formed, and heat treatment was performed at 220° C. for 1 hour in an air atmosphere.

<Evaluation of Id-Vg Characteristics>

Next, initial Id-Vg characteristics of the transistors included in Circuit boards 1 to 3 were measured. Here, a change in current flowing between the source and the drain (hereinafter referred to as drain current), that is, Id-Vg characteristics were measured when the substrate temperature was 25° C., a potential difference between the source and the drain (hereinafter referred to as drain voltage) was 1 V and 10 V, and a potential difference between the source and the gate (hereinafter referred to as gate voltage) varied from −20 V to +15 V.

Figure 29:
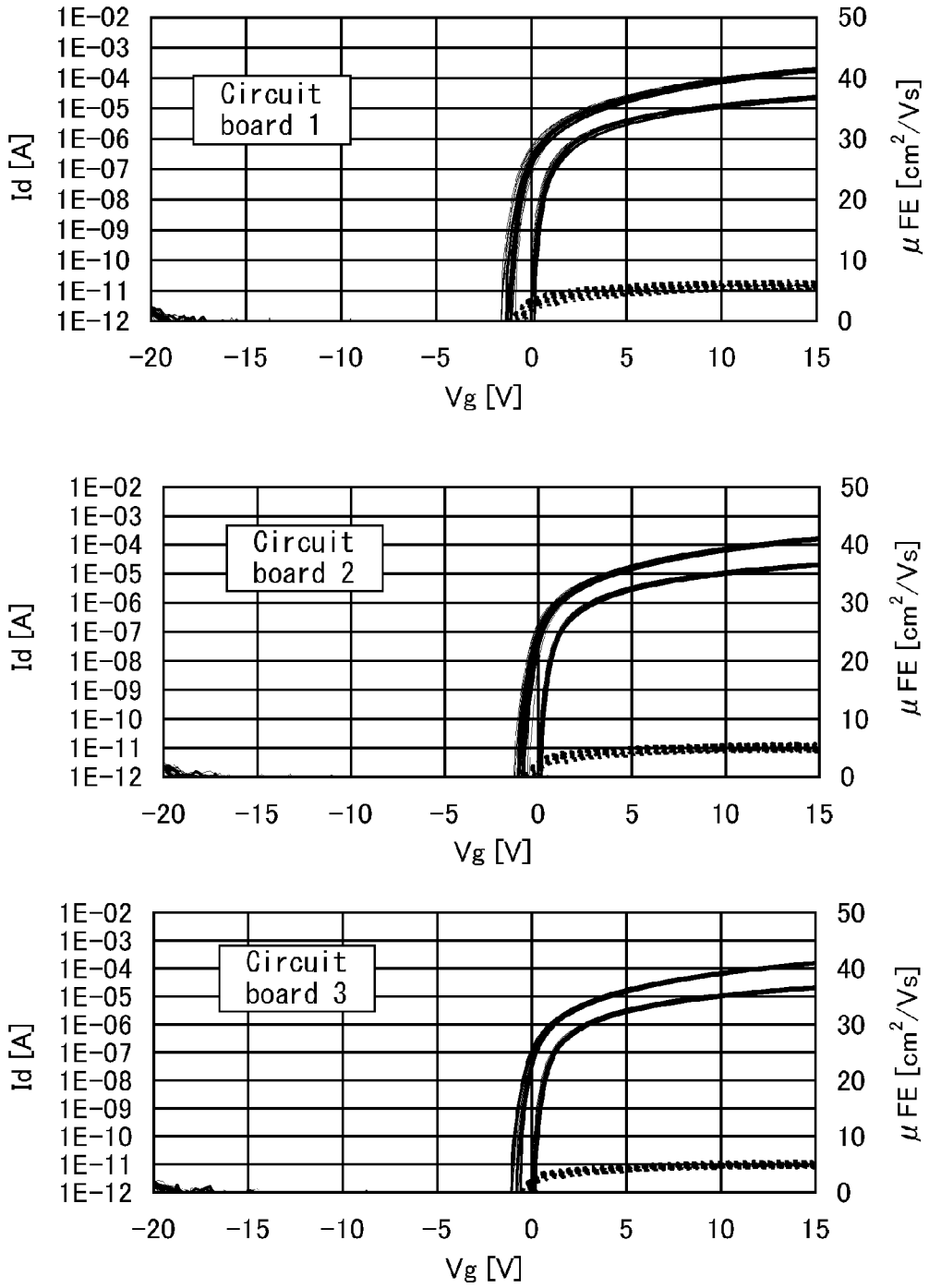
FIG. 29 shows results of evaluating Id-Vg characteristics in Example 2.
Figure 30:
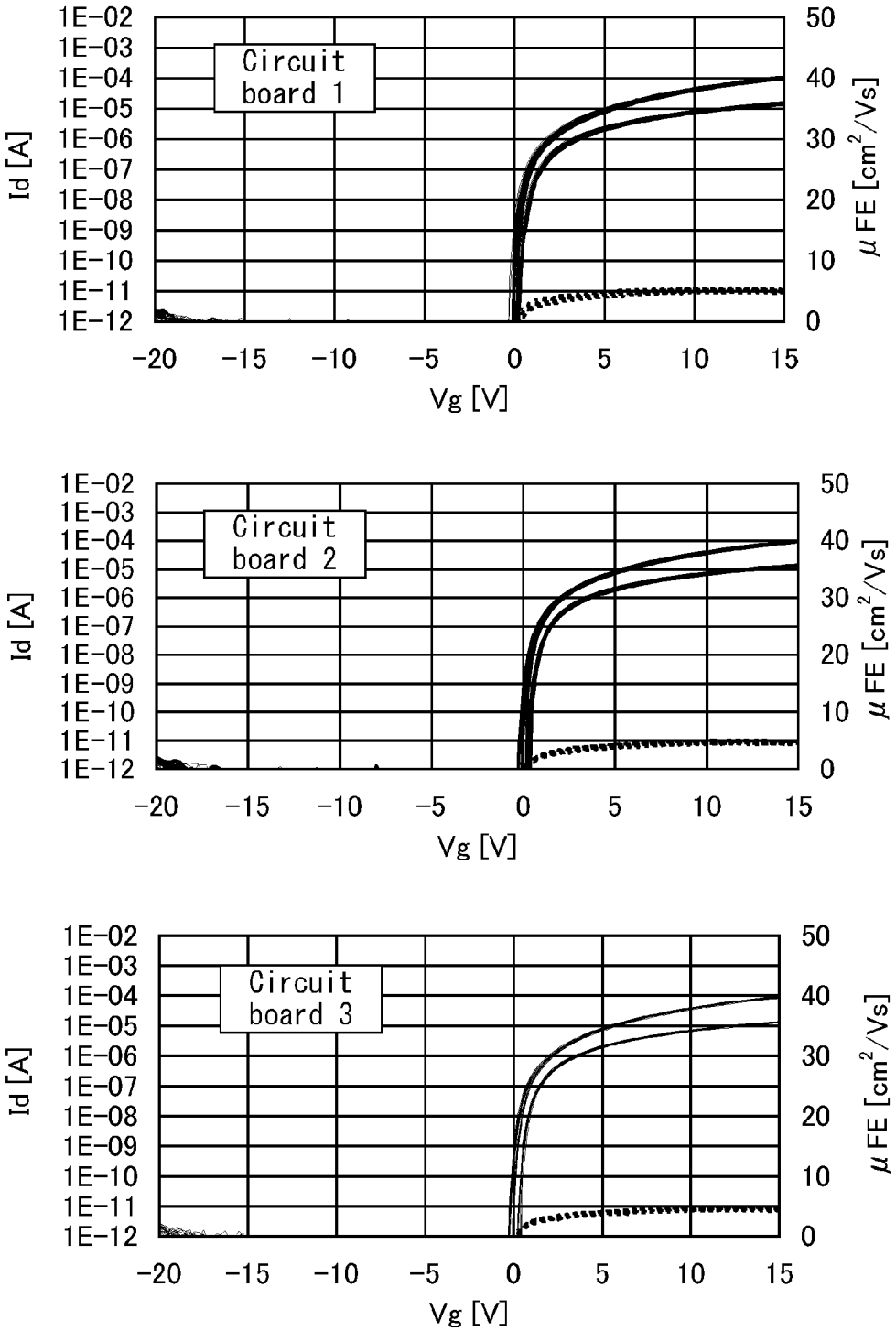
FIG. 30 shows results of evaluating Id-Vg characteristics in Example 2.
Figure 31:
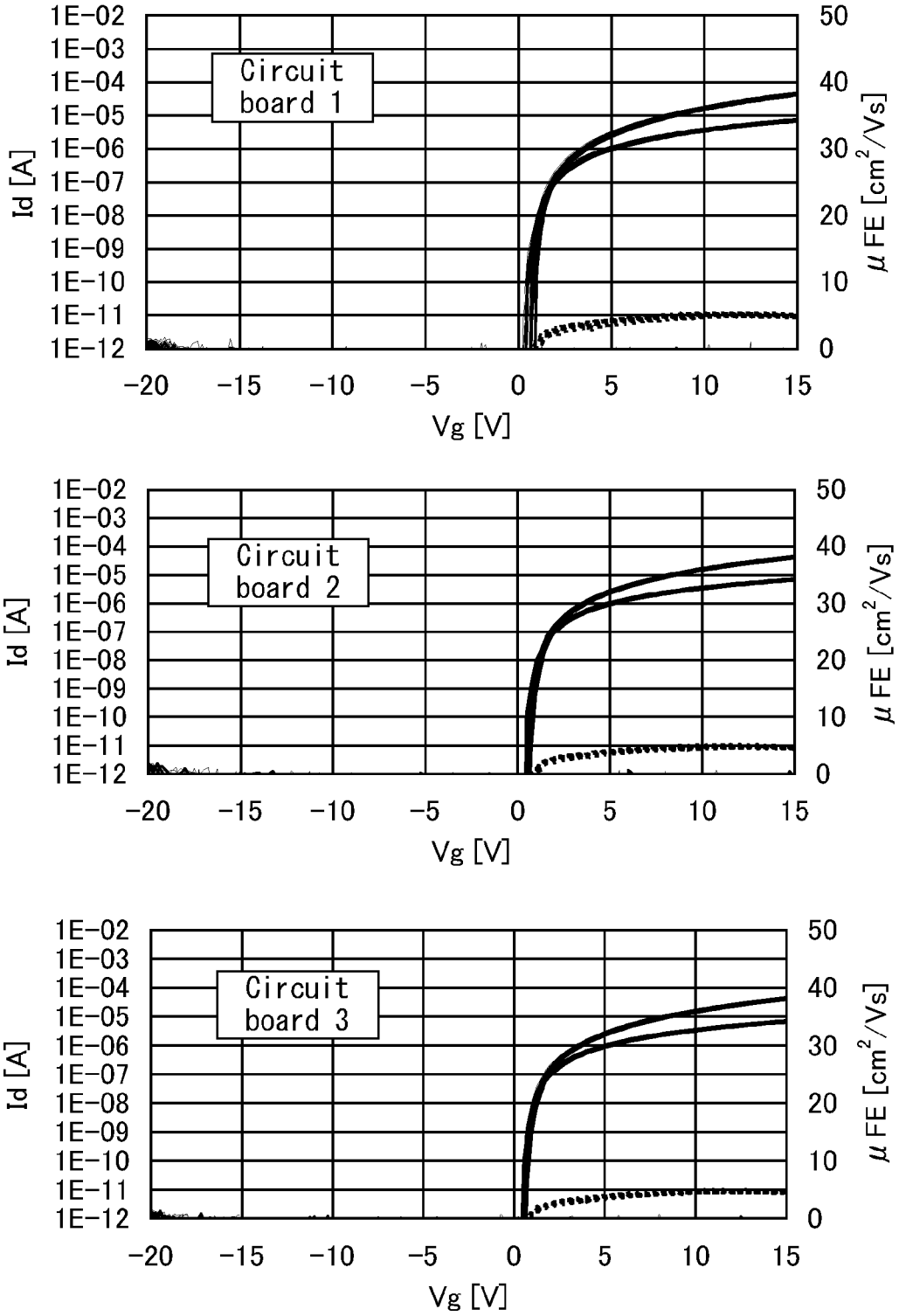
FIG. 31 shows results of evaluating Id-Vg characteristics in Example 2.

FIGS. 29 to 31 show the Id-Vg characteristics of the transistors included in the samples. In FIGS. 29 to 31, the horizontal axis indicates the gate voltage Vg and the vertical axis indicates the drain current Id. The solid lines indicate the Id-Vg characteristics at a drain voltage Vd of 1 V and 10 V, and the dashed line indicates the field-effect mobility at a gate voltage Vg of 10 V. Note that the field-effect mobility was measured when each transistor operated in the saturation region.

Note that the channel length (L) of the transistors in FIG. 29 is 2 μm, that of the transistors in FIG. 30 is 3 μm, and that of the transistors in FIG. 31 is 6 μm. The channel width (W) of all these transistors is 50 μm. In each of the samples, 20 transistors having the same structure were formed on the substrate.

<Results of BT Stress Test and BT Photostress Test>

Next, a BT stress test and a BT photostress test will be described. Note that the BT stress test was performed in an air atmosphere, and the BT photostress test was performed in a dry air atmosphere. The transistors subjected to these tests have a channel length (L) of 6 μm and a channel width (W) of 50 μm.

First, a measurement method with the BT stress test (GBT) in which a predetermined voltage is applied to the gate will be described. First, initial Id-Vg characteristics of the transistor were measured in the above manner.

Next, the substrate temperature was increased to 125° C., and then, the potentials of the drain and the source of the transistor were set to 0 V. Subsequently, a voltage was applied to the gate so that the intensity of electric field applied to the gate insulating film was 1.07 MV/cm, and this state was held for 3600 seconds.

Note that a voltage of −30 V was applied to the gate in a negative BT stress test (Dark −GBT), whereas a voltage of 30 V was applied to the gate in a positive BT stress test (Dark +GBT). In a negative BT photostress test (Photo −GBT), a voltage of −30 V was applied to the gate while the transistor was irradiated with white LED light of 3000 lx. In a positive BT photostress test (Photo +GBT), a voltage of 30 V was applied to the gate while the transistor was irradiated with white LED light of 3000 lx.

Next, the substrate temperature was lowered to 25° C. while the same voltages were continuously applied to the gate, the source, and the drain. After the substrate temperature reached 25° C., the application of voltages to the gate, the source, and the drain was stopped.

Next, a measurement method with a positive BT stress test (Dark +DBT) in which a predetermined voltage is applied to the drain will be described. First, initial Id-Vg characteristics of the transistor were measured in the above manner.

Next, the substrate temperature was increased to 25° C., 60° C., or 125° C., and then, the potentials of the gate and the source of the transistor were set to 0 V. Subsequently, a voltage of 30 V was applied to the drain so that the intensity of electric field applied to the gate insulating film was 1.07 MV/cm, and this state was held for 3600 seconds.

Next, the substrate temperature was lowered to 25° C. while the same voltages were continuously applied to the gate, the source, and the drain. After the substrate temperature reached 25° C., the application of voltages to the gate, the source, and the drain was stopped.

Each of the tests was performed before and after PCT. Note that in PCT, the circuit board was held for 15 hours under the following conditions: a water vapor atmosphere, a temperature of 130° C., a humidity of 85%, and a pressure of 2 atm.

Figure 32:
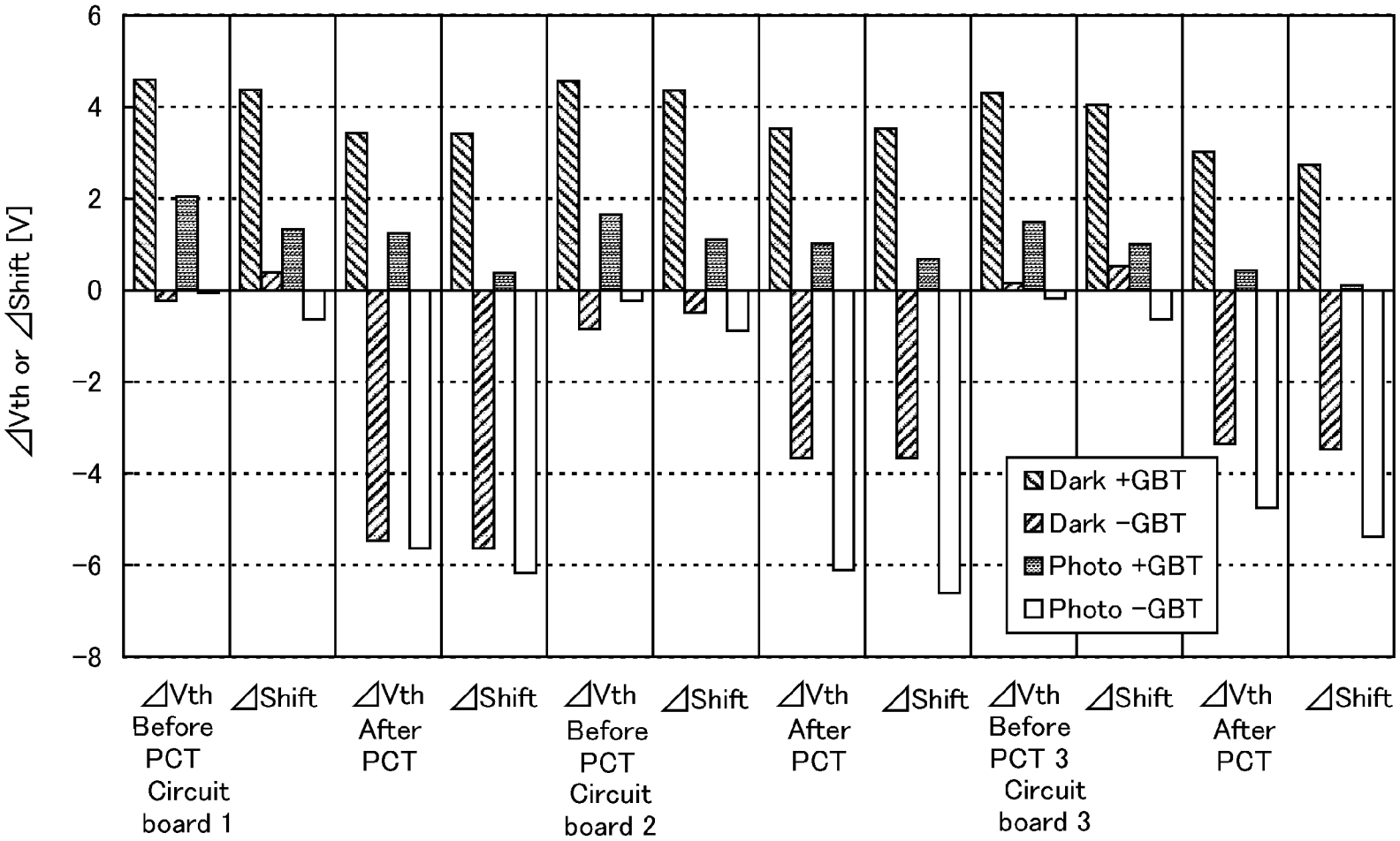
FIG. 32 shows results of a BT stress test and a BT photostress test in Example 2.

FIG. 32 shows a difference between the initial threshold voltage and the threshold voltage after GBT (i.e., a variation in the threshold voltage (ΔVth)) and a difference in shift value (i.e., a variation in the shift value (ΔShift)) of the transistors included in Circuit boards 1 to 3. Here, the shift value is defined as the gate voltage (Vg [V]) at the rising edge with respect to a drain current (Id [A]) of $1\times10^{-12}$ A.

Figure 33:
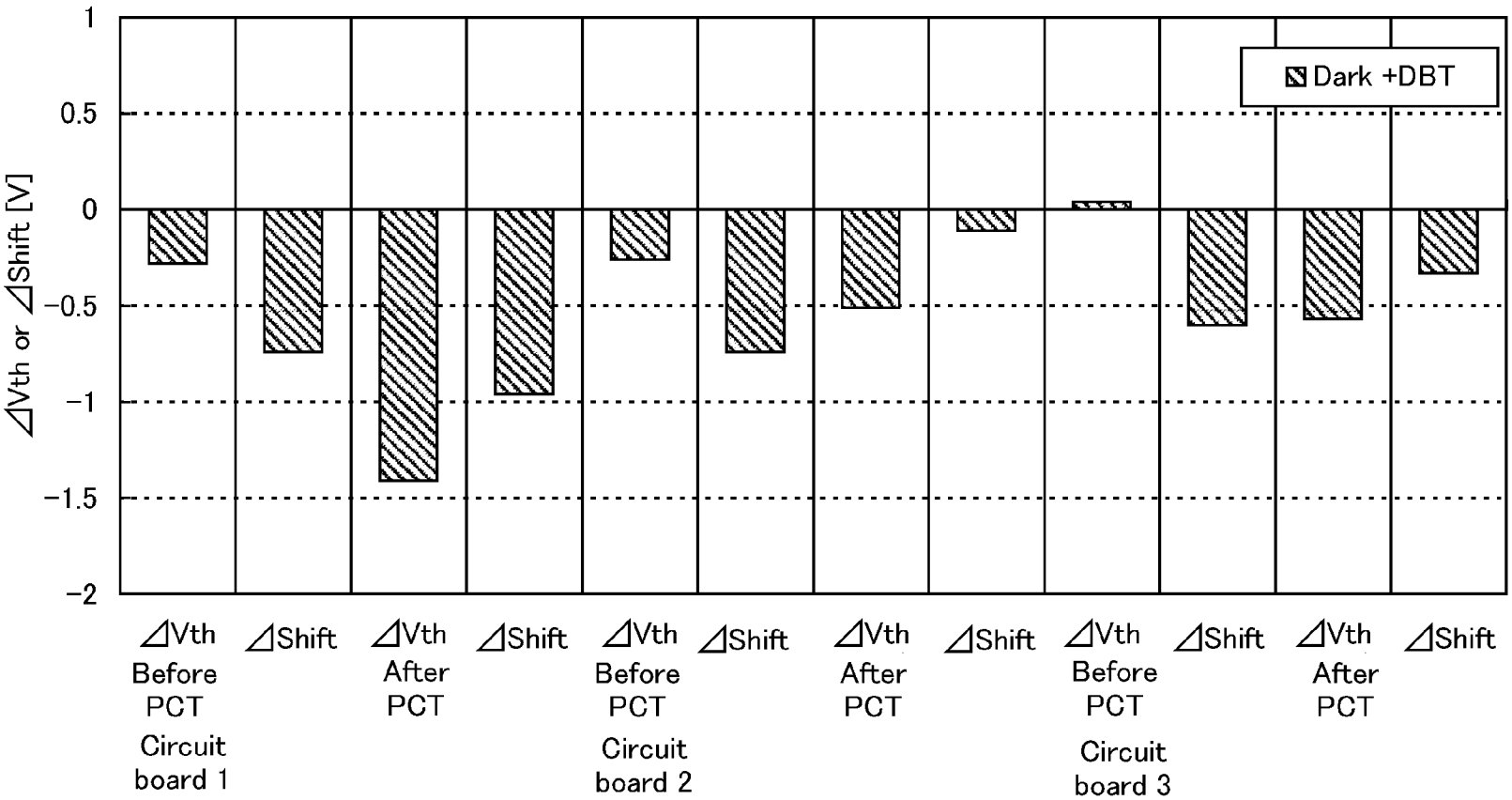
FIG. 33 shows results of a BT stress test in Example 2.

FIG. 33 shows a difference (ΔVth) between the initial threshold voltage and the threshold voltage after Dark +DBT in which the substrate temperature is increased to 125° C., and a difference in shift value (ΔShift) of the transistors included in Circuit boards 1 to 3.

Figure 34:
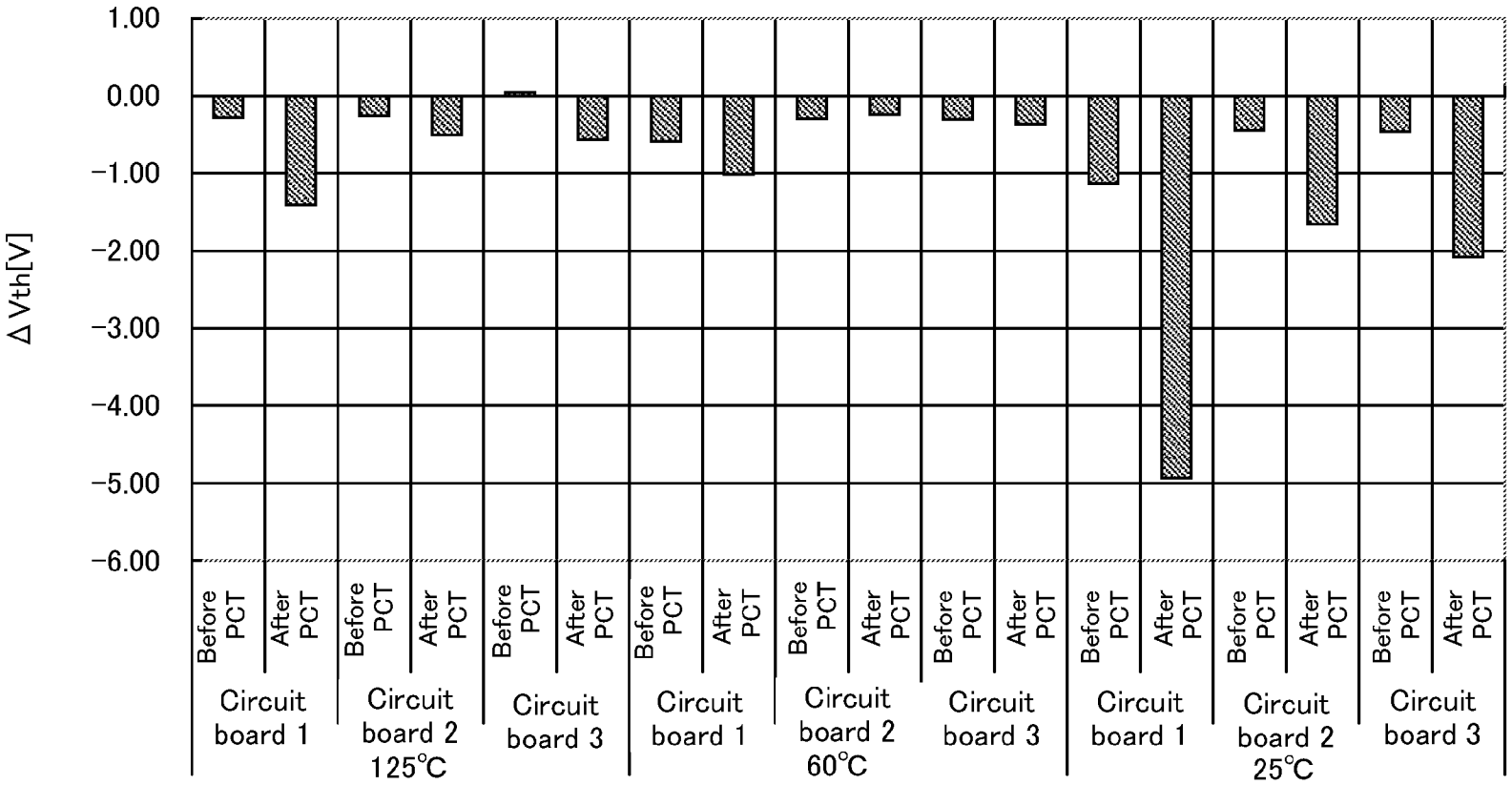
FIG. 34 shows results of a BT stress test in Example 2.

FIG. 34 shows a difference (ΔVth) between the initial threshold voltage and the threshold voltage after Dark +DBT in which the substrate temperature is increased to 25° C., 60° C., or 125° C. of the transistors included in Circuit boards 1 to 3.

Note that in this specification, threshold voltage is calculated with a drain voltage Vd of 10 V. Further, in this specification, threshold voltage (Vth) refers to an average value of Vth of 20 transistors included in each sample.

There is no significant difference in initial Id-Vg characteristics between the transistors in Circuit boards 1 to 3. However, according to the results of the BT stress test and the BT photostress test after PCT, a variation in the threshold voltage in Circuit boards 2 and 3 is smaller than that in Circuit board 1. When comparing Circuit boards 2 and 3, a variation in the threshold voltage in Circuit board 3 is smaller than that in Circuit board 2. These facts show that a variation in the threshold voltage in the BT stress test and the BT photostress test can be smaller with the planarization film using the third acrylic resin than with that using the first acrylic resin or the second acrylic resin.

It is found from FIG. 34 that a variation in the threshold voltage of the transistor in Dark +DBT is larger at lower substrate temperature. This is likely to be because a larger amount of moisture or the like is released from the acrylic film at higher substrate temperature.

EXPLANATION OF REFERENCE

11: substrate, 15: gate electrode, 17: gate insulating film, 19: oxide semiconductor film, 21: electrode, 22: electrode, 23: oxide insulating film, 24: oxide insulating film, 25: nitride insulating film, 26: protection film, 28: planarization film, 40: glass substrate, 41: acrylic film, 100: display device, 101: display panel, 102: pixel portion, 103: driver circuit, 104: driver circuit, 105: control circuit, 106: control circuit, 107: image processing circuit, 108: arithmetic processing unit, 109: input means, 110: memory device, 111: temperature sensing unit, 121: transistor, 122: display element, 123(*i*): parasitic capacitor, 123(*i*+1): parasitic capacitor, 123: capacitor, 124_1: pixel electrode, 125: pixel, 131: D/A converter, 132: D/A converter control circuit, 133: memory device, 140: light supply unit, 200: panel module, 201: substrate, 202: substrate, 203: sealant, 204: FPC, 205: external connection electrode, 206: wiring, 208: connection layer, 211: pixel portion, 212: IC, 213: gate driver circuit, 231: transistor, 232: transistor, 237: insulating layer, 238: insulating layer, 239: insulating layer, 242: black matrix, 243: color filter, 250: liquid crystal element, 251: electrode, 252: liquid crystal, 253: electrode, 254: spacer, 255: overcoat, 256: transistor, 300: transistor, 301: substrate, 302: gate electrode, 303: insulating layer, 304: oxide semiconductor layer, 305*a*: electrode, 305*b*: electrode, 306: insulating layer, 307: insulating layer, 310: transistor, 314: oxide semiconductor layer, 314*a*: oxide semiconductor layer, 314*b*: oxide semiconductor layer, 320: transistor, 324: oxide semiconductor layer, 324*a*: oxide semiconductor layer, 324*b*: oxide semiconductor layer, 324*c*: oxide semiconductor layer, 350: transistor, 351: insulating layer, 352: insulating layer, 360: transistor, 364: oxide semiconductor layer, 364*a*: oxide semiconductor layer, 364*b*: oxide semiconductor layer, 364*c*: oxide semiconductor layer, 364*d*: sidewall protection layer, 400: touch panel, 401: substrate, 402: substrate, 403: substrate, 404: FPC, 405: external connection electrode, 406: wiring, 411: display portion, 412: gate driver circuit, 413: pixel portion, 414: source driver circuit, 415: FPC, 416: external connection electrode, 417: wiring, 421: electrode, 422: electrode, 423: wiring, 424: insulating layer, 430: touch sensor, 431: liquid crystal, 432: wiring, 433: insulating layer, 434: bonding layer, 435: color filter layer, 436: sealant, 437: switching element layer, 438: wiring, 439: connection layer, 440: sensor layer, 441: polarizing plate, 603_G: G signal, 603_S: S signal, 615_C: secondary control signal, 615_V: secondary image signal, 618_C: primary control signal, 618_V: primary image signal, 619_C: image switching signal, 631*a*: region, 631*b*: region, 631*c*: region, 701: arithmetic unit, 702: memory device, 703: graphics processing unit, 704: display panel, 1400: portable information terminal, 1401: housing, 1402: display portion, 1403: operation button, 1410: mobile phone, 1411: housing, 1412: display portion, 1413: operation button, 1414: speaker, 1415: microphone, 1420: music reproducing device, 1421: housing, 1422: display portion, 1423: operation button, 1424: antenna This application is based on Japanese Patent Application serial No. 2012-260345 filed with Japan Patent Office on Nov. 28, 2012, the entire contents of which are hereby incorporated by reference.

The invention claimed is:

1. A display device comprising:

a pixel portion comprising a transistor, a display element, and a capacitor;

a driver circuit configured to drive the pixel portion in a first mode or in a second mode;

a temperature sensing unit configured to sense a temperature;

a first memory device storing a first correction table;

a control circuit comprising:

a D/A converter;

a second memory device storing a second correction table; and a D/A converter control circuit configured to read a second correction data corresponding to frame frequency from the second correction table and output the second correction data to the D/A converter; and an image processing circuit configured to read a first correction data corresponding to the temperature from the first correction table and output the first correction data to the control circuit, wherein the transistor comprises an oxide semiconductor layer comprising a channel formation region, wherein one of a source and a drain of the transistor is electrically connected to the display element, wherein a first electrode of the capacitor is electrically connected to the display element, wherein the pixel portion is driven with a first frame frequency during the first mode, wherein the pixel portion is driven with a second frame frequency lower than the first frame frequency during the second mode, wherein a potential output from the D/A converter is applied to a second electrode of the capacitor, and wherein the potential applied to the second electrode of the capacitor is a first potential at a beginning of each frame period and the potential applied to the second electrode of the capacitor gradually rises or drops over time during each frame period.

2. The display device according to claim 1, wherein the second frame frequency is 30 Hz or less.

3. The display device according to claim 1, wherein the second frame frequency is 0.2 Hz or less.

4. The display device according to claim 1, wherein the display element is a liquid crystal element.

5. A display device comprising:

a pixel portion comprising a transistor, a display element, and a capacitor;

a driver circuit configured to drive the pixel portion in a first mode or in a second mode;

a temperature sensing unit configured to sense a temperature;

a first memory device storing a first correction table;

a control circuit comprising:

a D/A converter;

a second memory device storing a second correction table; and a D/A converter control circuit configured to read a second correction data corresponding to frame frequency from the second correction table and output the second correction data to the D/A converter; and an image processing circuit configured to read a first correction data corresponding to the temperature from the first correction table and output the first correction data to the control circuit, wherein the transistor comprises an oxide semiconductor layer comprising a channel formation region, wherein one of a source and a drain of the transistor is electrically connected to the display element, wherein a first electrode of the capacitor is electrically connected to the display element, wherein the pixel portion is driven with a first frame frequency during the first mode, wherein the pixel portion is driven with a second frame frequency lower than the first frame frequency during the second mode, and wherein a potential output from the D/A converter is applied to a second electrode of the capacitor.

6. The display device according to claim 5, wherein the second frame frequency is 30 Hz or less.

7. The display device according to claim 5, wherein the second frame frequency is 0.2 Hz or less.

8. The display device according to claim 5, wherein the display element is a liquid crystal element.

9. A display device comprising:

a pixel portion comprising a transistor, a display element, and a capacitor;

a temperature sensing unit configured to sense a temperature;

a first memory device storing a first correction table;

a control circuit comprising:

a D/A converter;

a second memory device storing a second correction table; and a D/A converter control circuit configured to read a second correction data corresponding to frame frequency from the second correction table and output the second correction data to the D/A converter; and an image processing circuit configured to read a first correction data corresponding to the temperature from the first correction table and output the first correction data to the control circuit, wherein the transistor comprises an oxide semiconductor layer comprising a channel formation region, wherein one of a source and a drain of the transistor is electrically connected to the display element, wherein a first electrode of the capacitor is electrically connected to the display element, and wherein a potential output from the D/A converter is applied to a second electrode of the capacitor.

10. The display device according to claim 9, wherein the display element is a liquid crystal element.

* * * * *